US010794080B2

(12) United States Patent
Johnson et al.

(10) Patent No.: US 10,794,080 B2
(45) Date of Patent: Oct. 6, 2020

(54) RAPIDLY DEPLOYABLE MODULAR SHELTER SYSTEM

(71) Applicant: WEATHERHAVEN GLOBAL RESOURCES LTD., Coquitlam (CA)

(72) Inventors: Brian D. Johnson, Mill Bay (CA); Ryan Douglas Savenkoff, Vancouver (CA); Matt Christensen, Vancouver (CA); Jean-Marc Bennett, Surrey (CA)

(73) Assignee: WEATHERHAVEN GLOBAL RESOURCES LTD., Coquitlam (CA)

( * ) Notice: Subject to any disclaimer, the term of this patent is extended or adjusted under 35 U.S.C. 154(b) by 0 days.

(21) Appl. No.: 16/287,539

(22) Filed: Feb. 27, 2019

(65) Prior Publication Data

US 2019/0194972 A1 Jun. 27, 2019

Related U.S. Application Data

(63) Continuation-in-part of application No. 16/072,124, filed as application No. PCT/CA2017/050071 on Jan. 25, 2017, now Pat. No. 10,392,828.

(60) Provisional application No. 62/287,313, filed on Jan. 26, 2016.

(51) Int. Cl.

| | |
|---|---|
| ***E04H 15/46*** | (2006.01) |
| ***E04H 15/52*** | (2006.01) |
| *E04H 15/58* | (2006.01) |

(52) U.S. Cl.

CPC ..... *E04H 15/46* (2013.01); *E04H 15/52* (2013.01); *E04H 15/58* (2013.01)

(58) Field of Classification Search

CPC ..... E04H 15/46; E04H 15/52
USPC ..... 135/905
See application file for complete search history.

(56) References Cited

U.S. PATENT DOCUMENTS

| | | | | |
|---|---|---|---|---|
| 1,170,188 | A | 2/1916 | Rassmussen et al. | |
| 2,771,896 | A | 11/1956 | Call | |
| 2,828,756 | A | 4/1958 | Worley | |
| 3,367,348 | A * | 2/1968 | Kirkham | E04H 15/46 135/140 |
| 3,564,784 | A | 2/1971 | Mollinger | |
| 4,066,089 | A | 1/1978 | Rainwater | |
| 4,365,908 | A | 12/1982 | Thiboutot | |
| 4,667,692 | A | 5/1987 | Tury et al. | |
| 5,159,790 | A | 11/1992 | Harding | |

(Continued)

FOREIGN PATENT DOCUMENTS

| | | | |
|---|---|---|---|
| CA | 1287725 | A | 8/1991 |
| CN | 201169955Y | A | 12/2008 |

(Continued)

OTHER PUBLICATIONS

International Search Report dated Oct. 25, 2019 issued on PCT/CA2019/050237.

*Primary Examiner* — Noah Chandler Hawk

(74) *Attorney, Agent, or Firm* — Bruce M. Green; Oyen Wiggs Green & Mutala LLP

(57) ABSTRACT

A modular tent frame system comprises a number of folding frame elements which permit the shelter to be rapidly deployed in extreme environmental conditions. Telescopically sliding legs permit the tent frame to be unfolded, and the tent fabric attached to the frame, which the frame is on the ground and the tent can then be raised by sliding the outer leg elements up the inner leg elements to thereby raise the tent to the desired height, even in high winds.

9 Claims, 67 Drawing Sheets

(56) References Cited

U.S. PATENT DOCUMENTS

| | | | | |
|---|---|---|---|---|
| 5,167,246 | A | 12/1992 | Mortenson | |
| 5,263,507 | A | 11/1993 | Chuang | |
| 5,771,651 | A | 6/1998 | Shiina | |
| 5,884,647 | A | 3/1999 | Dwek | |
| 6,550,491 | B1 | 4/2003 | Bixler et al. | |
| 6,575,656 | B2 | 6/2003 | Suh | |
| 6,591,849 | B1 * | 7/2003 | Swetish | E04H 15/46 135/123 |
| 7,290,553 | B2 | 11/2007 | Prevost | |
| 7,395,830 | B2 | 7/2008 | Seo | |
| 7,975,712 | B2 | 7/2011 | Beacco | |
| 8,033,289 | B2 | 10/2011 | Buckley | |
| 8,186,369 | B2 | 5/2012 | Reeb et al. | |
| 8,205,627 | B2 | 6/2012 | Zhou | |
| 9,637,947 | B2 * | 5/2017 | LeMoine | E04H 15/48 |
| 2005/0217713 | A1 | 10/2005 | Chu et al. | |
| 2006/0051159 | A1 | 3/2006 | Tsai | |
| 2006/0062632 | A1 | 3/2006 | Jang | |
| 2011/0284044 | A1 | 11/2011 | Baldussi | |
| 2016/0265246 | A1 | 9/2016 | Becher et al. | |

FOREIGN PATENT DOCUMENTS

| | | | |
|---|---|---|---|
| CN | 101463671 | A | 6/2009 |
| EP | 0020770 | A1 | 1/1981 |
| EP | 0248540 | A | 12/1987 |
| EP | 0494053 | A1 | 7/1992 |
| EP | 0534843 | A1 | 3/1993 |
| GB | 680294 | A | 10/1952 |
| GB | 982411 | A | 2/1965 |
| GB | 2254630 | A | 10/1992 |
| GB | 2475512 | A | 5/2011 |
| WO | 2008120071 | A2 | 10/2008 |

* cited by examiner

RAPIDLY DEPLOYABLE MODULAR SHELTER SYSTEM

REFERENCE TO RELATED APPLICATIONS

The present application is a continuation-in-part of U.S. patent application Ser. No. 16/072,124 entitled "RAPIDLY DEPLOYABLE MODULAR SHELTER SYSTEM" filed Jul. 23, 2018 which is and claims the benefits, under 35 U.S.C. § 119(e), of U.S. Provisional Application Ser. No. 62/287,313 filed Jan. 26, 2016 entitled "RAPIDLY DEPLOYABLE MODULAR SHELTER SYSTEM" and which is a 371 of international application no. PCT/CA2017/050071 Jan. 25, 2017 filed Jan. 25, 2017 "Method and Apparatus for Automated Vertical Horticulture and Agriculture", all of which are incorporated herein by this reference.

TECHNICAL FIELD

The invention relates to the field of collapsible structures, in particular fabric-covered structures such as tents and collapsible frames for supporting same.

BACKGROUND

Numerous designs have been developed for large-scale collapsible fabric-covered structures which are portable and can be rapidly erected and disassembled. Such structures have use in military applications, for resource exploration, for large public events such as concerts and festivals and the like. Typically the frames for such structures consist of multiple separate pieces which can become misplaced and are complicated to assemble, dis-assemble and pack for shipment. There is therefore a need for more simple and efficient frames for large-scale collapsible structures.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above described problems have been reduced or eliminated, while other embodiments are directed to other improvements.

The present invention therefore provides a leg element for use in a folding tent frame system, the folding tent frame system having a roof frame comprising arch brackets configured to receive a plurality of the leg elements, each leg element comprising: a) a first inner leg element comprising a base and a rigid vertical element mounted on the base, the rigid vertical element having a plurality of vertically spaced latch-receiving slots; and b) a second outer sliding leg element slideably movable vertically on the first inner leg element, the second outer sliding leg element comprising a horizontally extending lifting bar secured thereto and a spring-biased latch element for securing the outer sliding leg element at selected vertical locations on the inner leg element.

According to a further aspect there is provided a folding tent frame comprising a folding roof frame, and a plurality of leg elements engageable with the folding roof frame wherein the folding roof frame comprises a plurality of arch brackets located on the periphery thereof for releasably receiving and securing the plurality of leg elements. each arch bracket comprises a vertical passage open on the outer side thereof for receiving one of the outer sliding leg elements and opposed tapered interior surfaces for bearing against an outer surface of the outer sliding leg elements. The outer sliding leg elements may comprise tapered outer surfaces configured to engage the tapered interior surfaces of the plurality of arch brackets. There is further provided a shelter system comprising the folding tent frame described above, and a flexible tent body removably suspended from the folding tent frame when the folding tent frame is in an unfolded and locked configuration.

According to a further aspect there is provided a method of deploying a shelter wherein the shelter comprises a folding tent frame as described above and a flexible tent body, the method comprising the steps of: a) unfolding the roof frame, reversibly locking the roof frame in an unfolded configuration and placing the unfolded roof frame on a generally horizontal surface such as the ground; b) removably securing the flexible tent body to the unfolded roof frame at a plurality of points; c) securing the plurality of leg elements to the arch brackets of the unfolded roof frame wherein the leg elements are in a first lowered configuration to thereby raise one or both sides of the unfolded roof frame above the generally horizontal surface; d) raising the roof frame further above the generally horizontal surface by sliding each outer sliding leg elements of the plurality of leg elements vertically on each first inner leg element to thereby secure each leg element in a further extended configuration; e) repeating step d) until the unfolded roof frame has been raised to a selected extended height; f) before or in the course of any one of steps c), d) or e) securing each base of the plurality of leg elements to the generally horizontal surface; and g) further securing the flexible tent body to the roof frame and extended leg elements and the generally horizontal surface. Where the bases of the leg elements comprise apertures each base of the plurality of leg elements may be secured to the generally horizontal surface using stakes extending through the apertures into the generally horizontal surface. The outer sliding leg elements may slid vertically on each first inner leg element by lifting the horizontally extending lifting bars.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
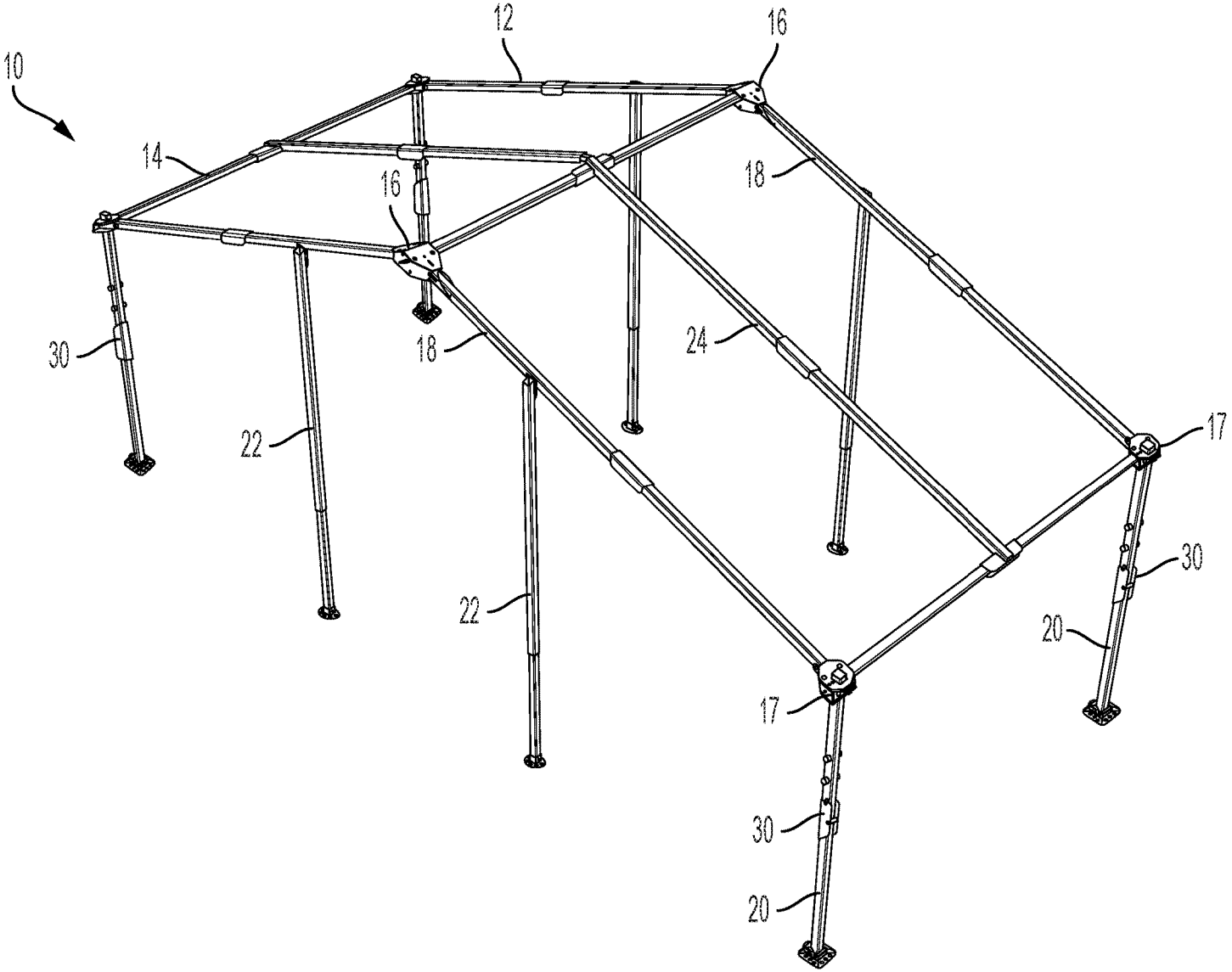
FIG. 1 is a perspective view of the unfolded assembled frame for a one bay structure according to an embodiment of the invention.
Figure 34:
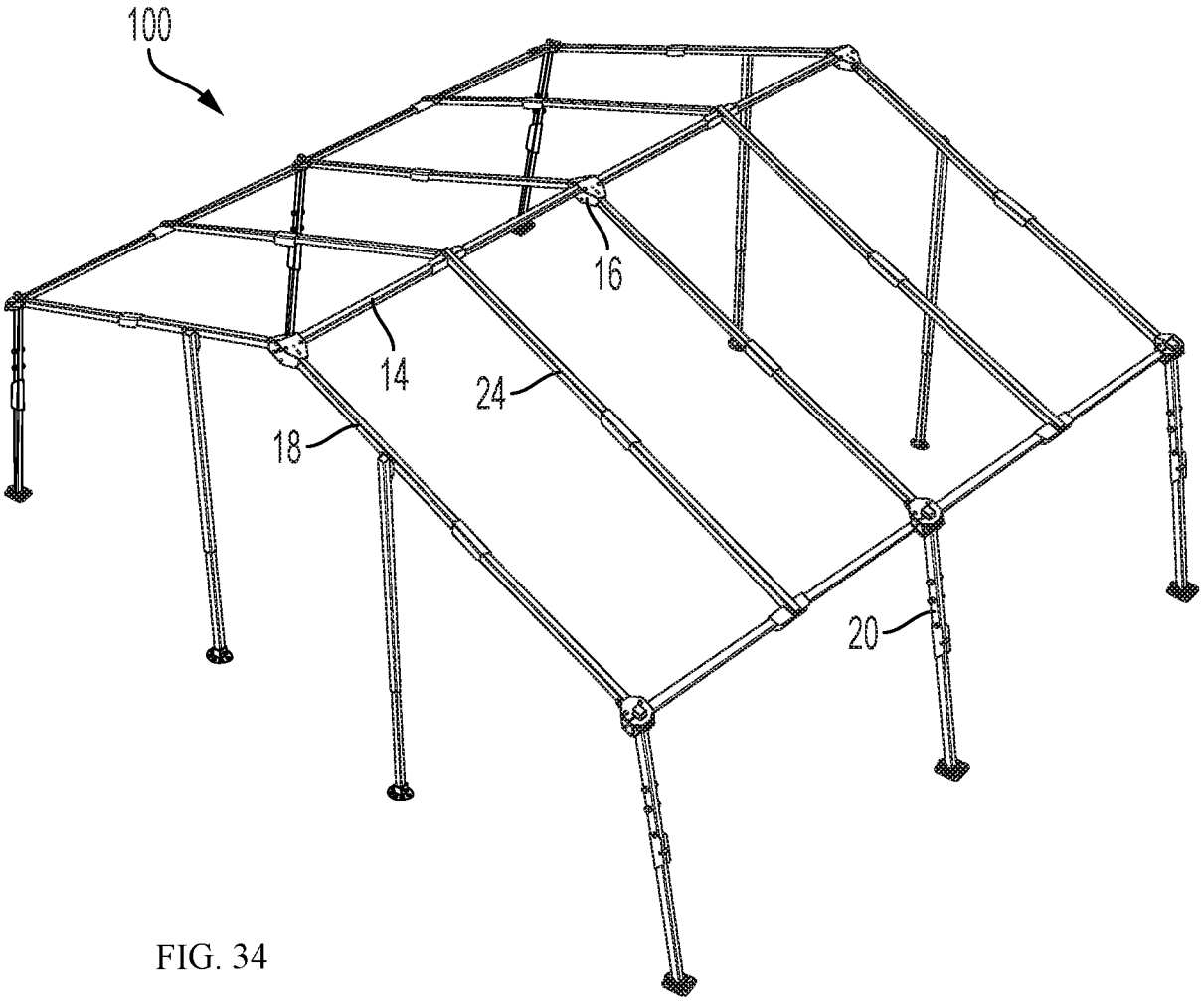
FIG. 34 is a perspective view of the unfolded assembled frame for a two bay structure according to an embodiment of the invention.
Figure 35:
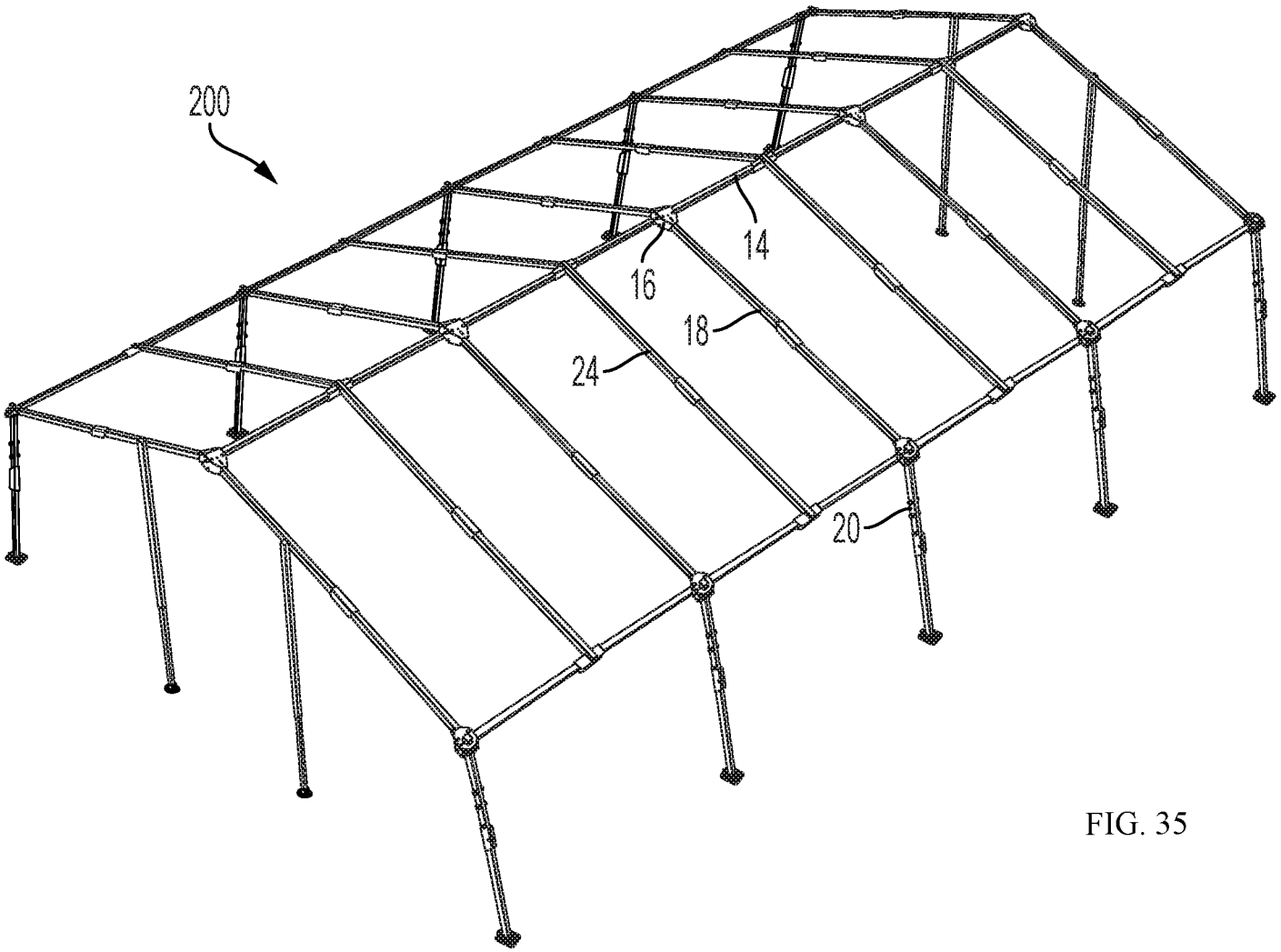
FIG. 35 is a perspective view of the unfolded assembled frame for a four bay structure according to an embodiment of the invention.

With reference to FIG. 1, an unfolded frame assembly 10 for a one bay structure according to an embodiment of the invention is shown. Unfolded frame assemblies 100 and 200 for two and four bay structures according to an embodiment of the invention are shown in FIGS. 34 and 35. Each frame assembly 10 comprises an upper section assembly 12 (FIG. 2) which includes fully attached folding purlins 14. Frame assembly 10 also comprises peak brackets 16, eave brackets 17, chords 18, legs 20, wind kit posts 22, midspan chords 24, chord knee joints 26, purlin knee joints 28, and leg knee joints 30. Such joints contain self-resetting lock mechanisms as described below. During set up they lock the joints into place without needing to be touched. Once unlocked they reset to automatically lock the joints into place on the next setup.

Peak bracket and chord joint locks contain a secondary feature which allows joints to be set into an unlocked position until the joint is bent, at which time the lock resets, ready to lock the joint into position on the next setup. This facilitates the pack up procedure, as multiple joint locks need not be manually held unlocked at the same time.

Figure 2:
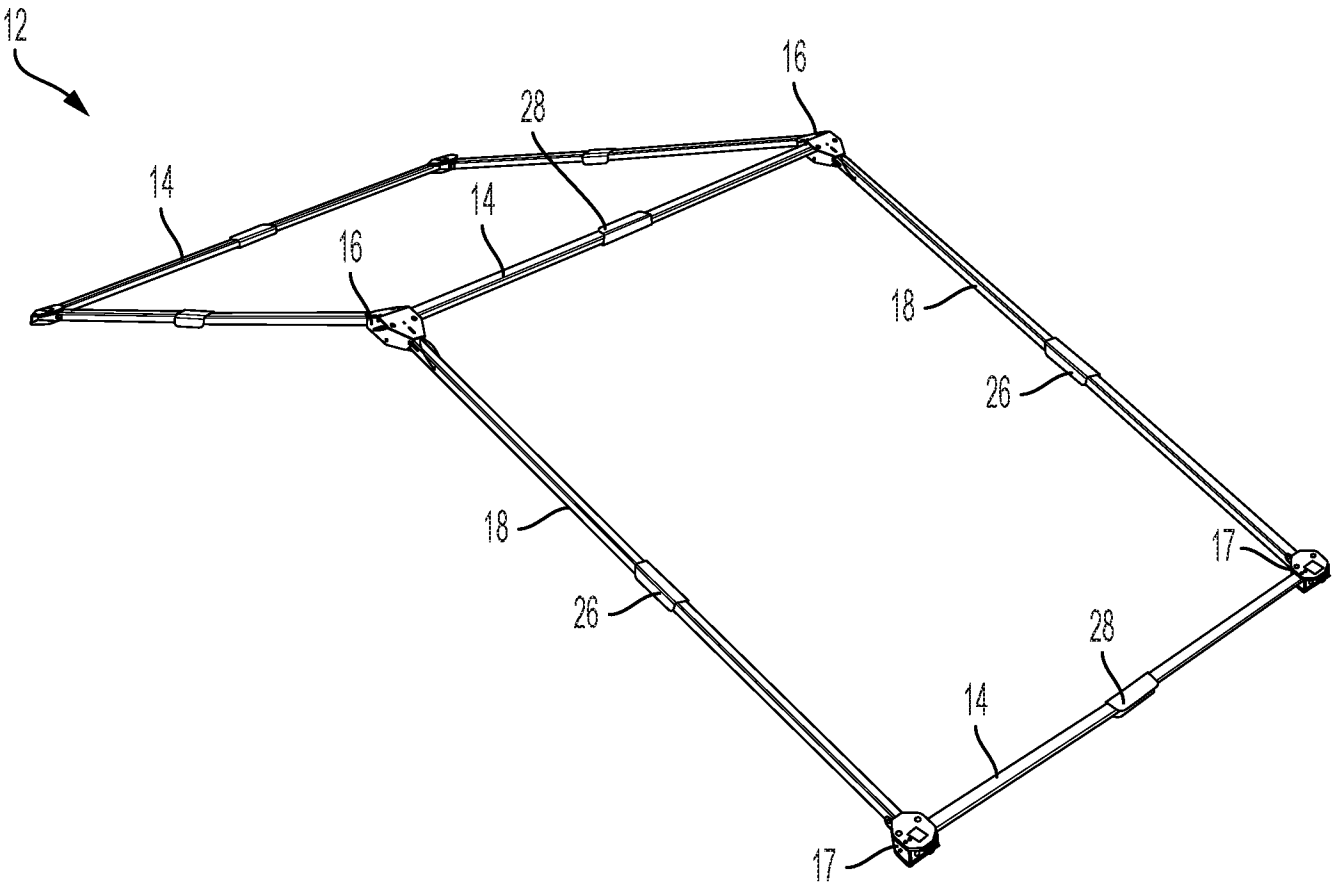
FIG. 2 is a perspective view of the upper folding assembly for the frame in FIG. 1, expanded with frame components unfolded.
Figure 3:
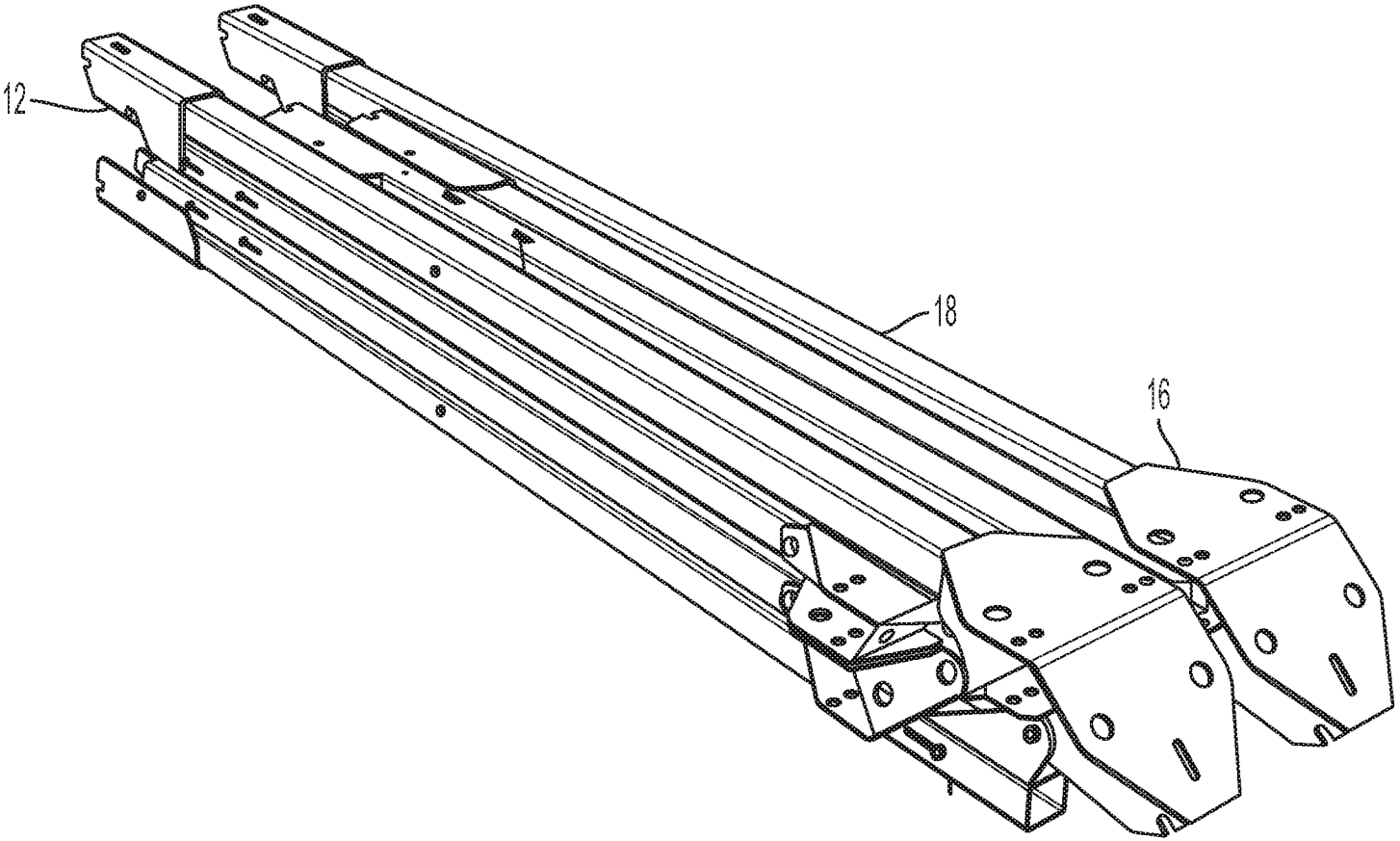
FIG. 3 is a perspective view of the upper folding assembly for the frame as shown in FIG. 2, folded for packing.
Figure 4:
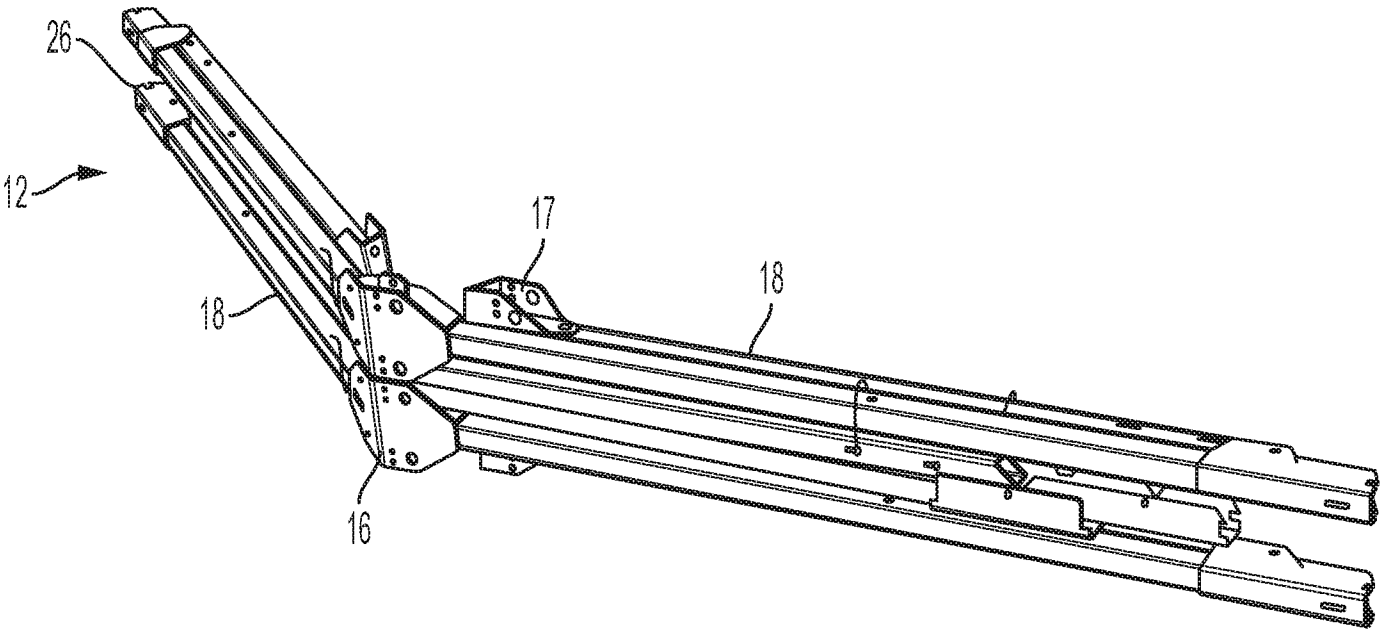
FIG. 4 is a perspective view of the upper folding assembly for the frame as shown in FIG. 2, partially unfolded.
Figure 5:
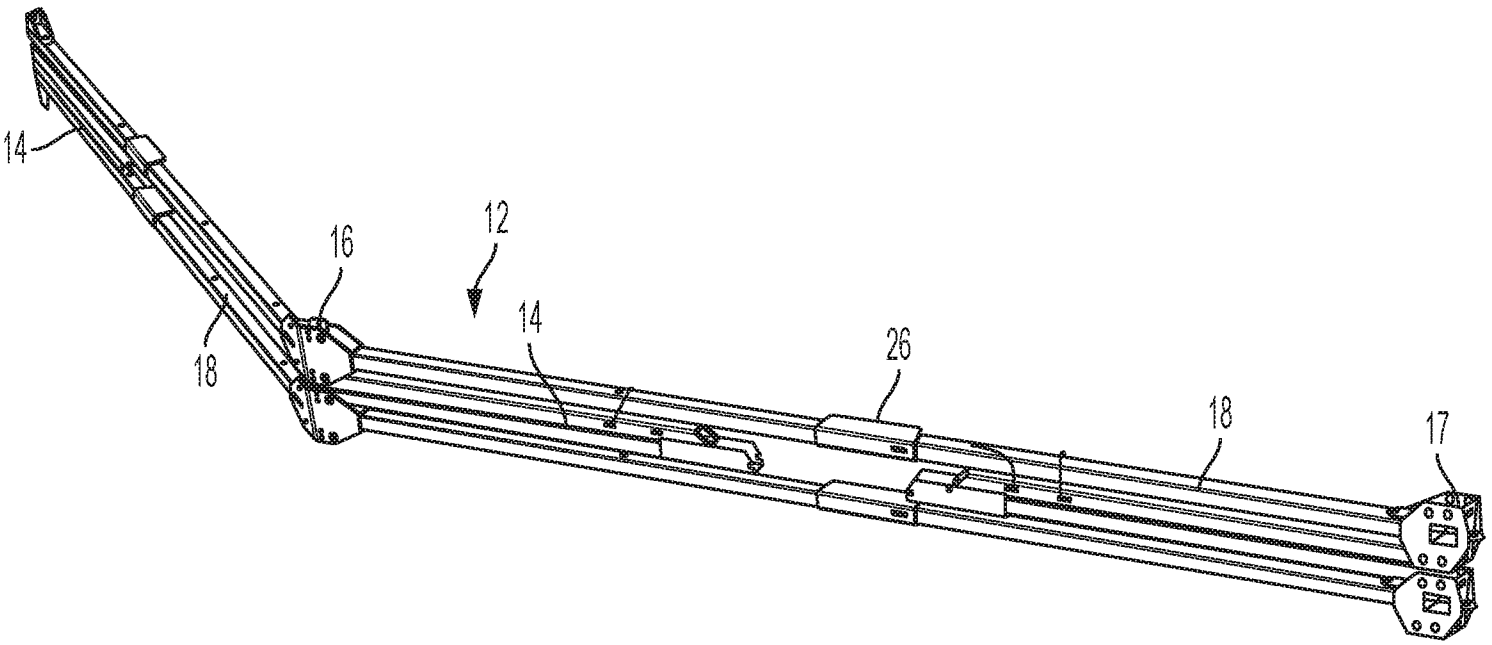
FIG. 5 is a perspective view of the upper folding assembly for the frame as shown in FIG. 2, further unfolded.
Figure 6:
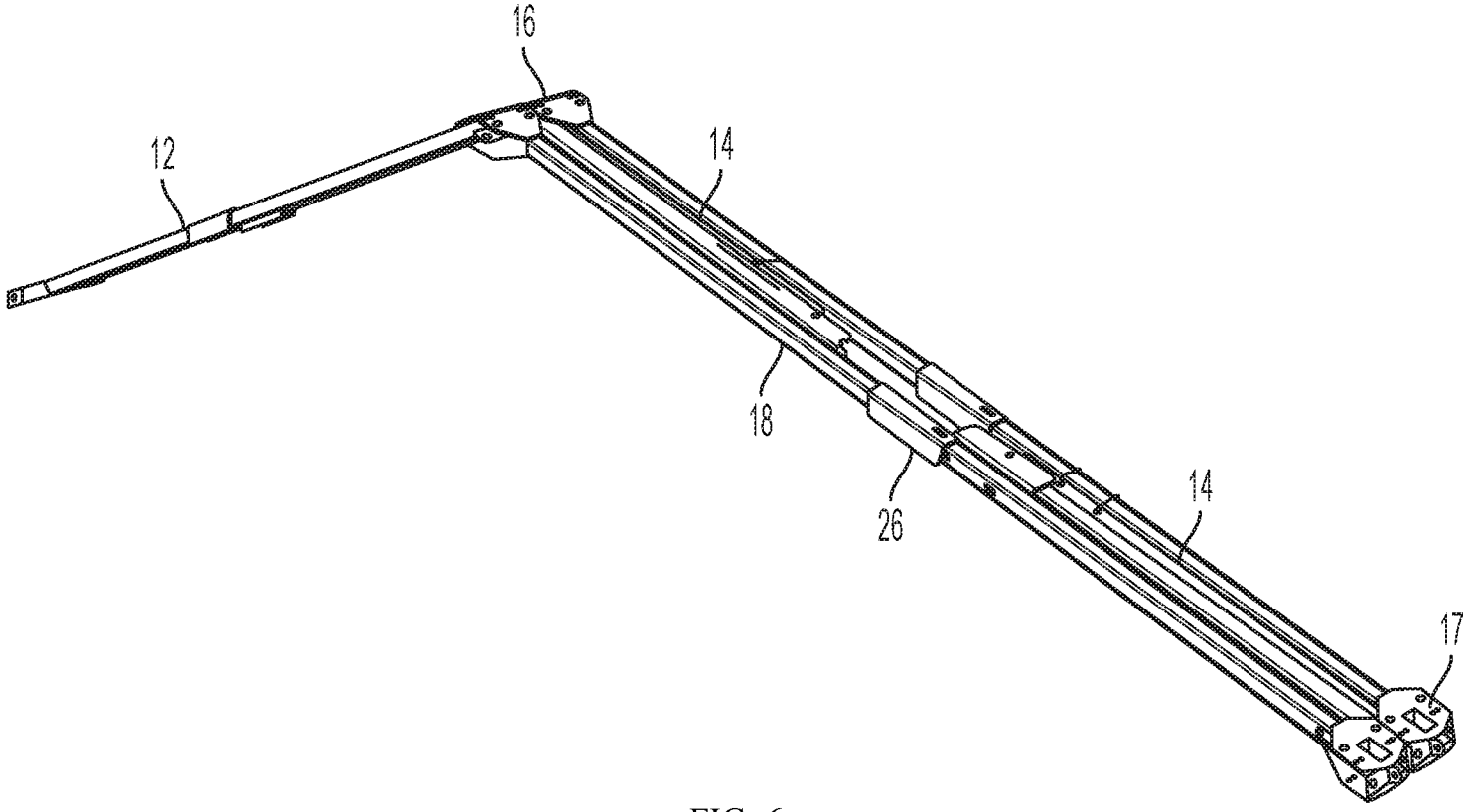
FIG. 6 is a perspective view of the upper folding assembly for the frame as shown in FIG. 2, further unfolded and standing upright.
Figure 7:
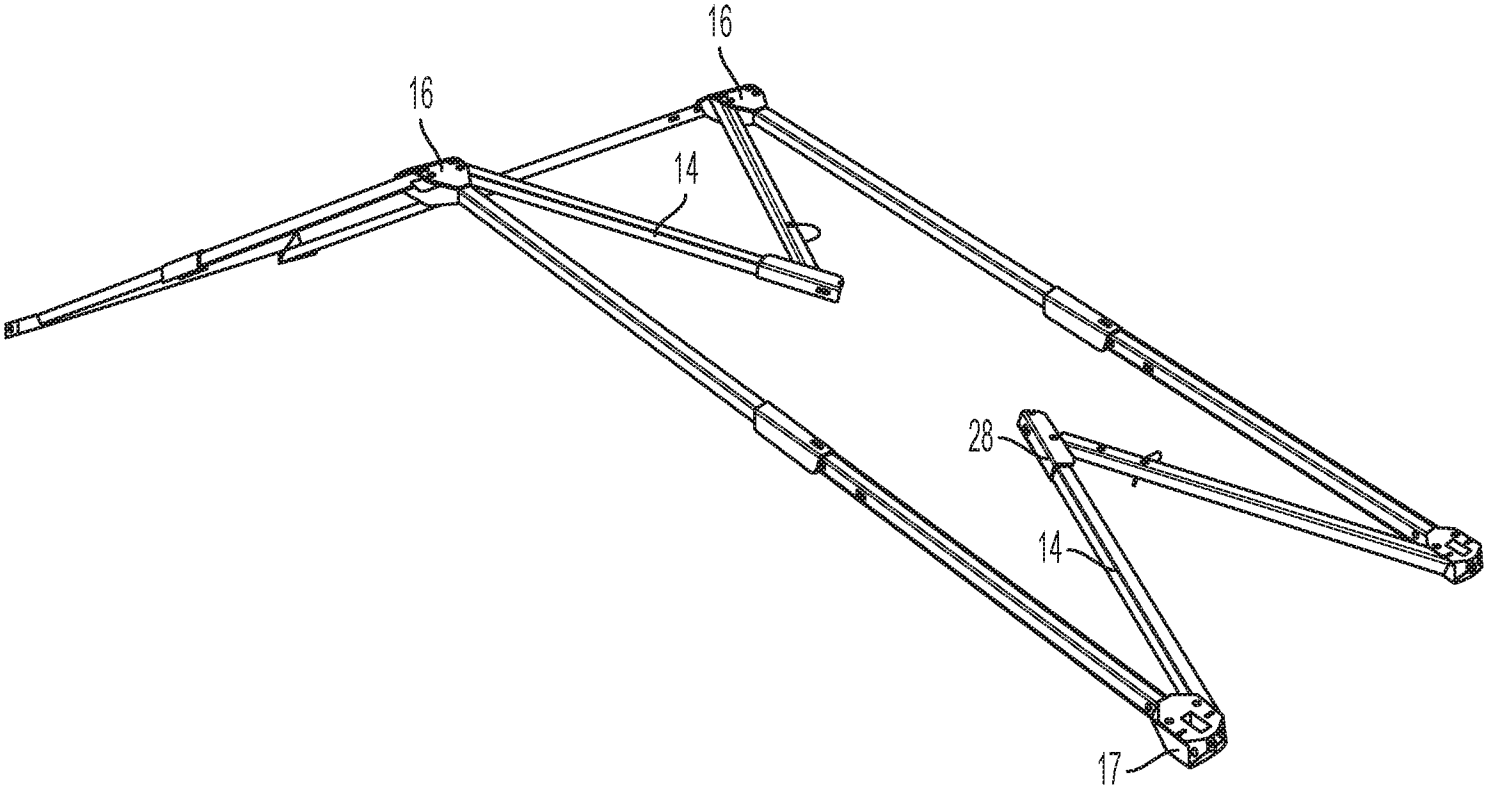
FIG. 7 is a perspective view of the upper folding assembly for the frame as shown in FIG. 2, standing upright further unfolded.

FIG. 3 shows the upper folding assembly 12 for the frame as shown in FIGS. 1 and 2, folded for packing. In FIG. 4 one set of two folded chords 18 and one folded purlin 14 are rotated about the hinged peak bracket 16 to separate from the set of two folded chords 18 and two folded purlin 14. In FIG. 5 the chords 18 are unfolded by rotating at chord knee joints 26. In FIG. 6 the partially unfolded upper frame assembly is placed in an upright position and as shown in FIG. 7 purlins 14 are unfolded about hinged purlin knee joints 28, to reach the unfolded configuration shown in FIG. 8.

Figure 9:
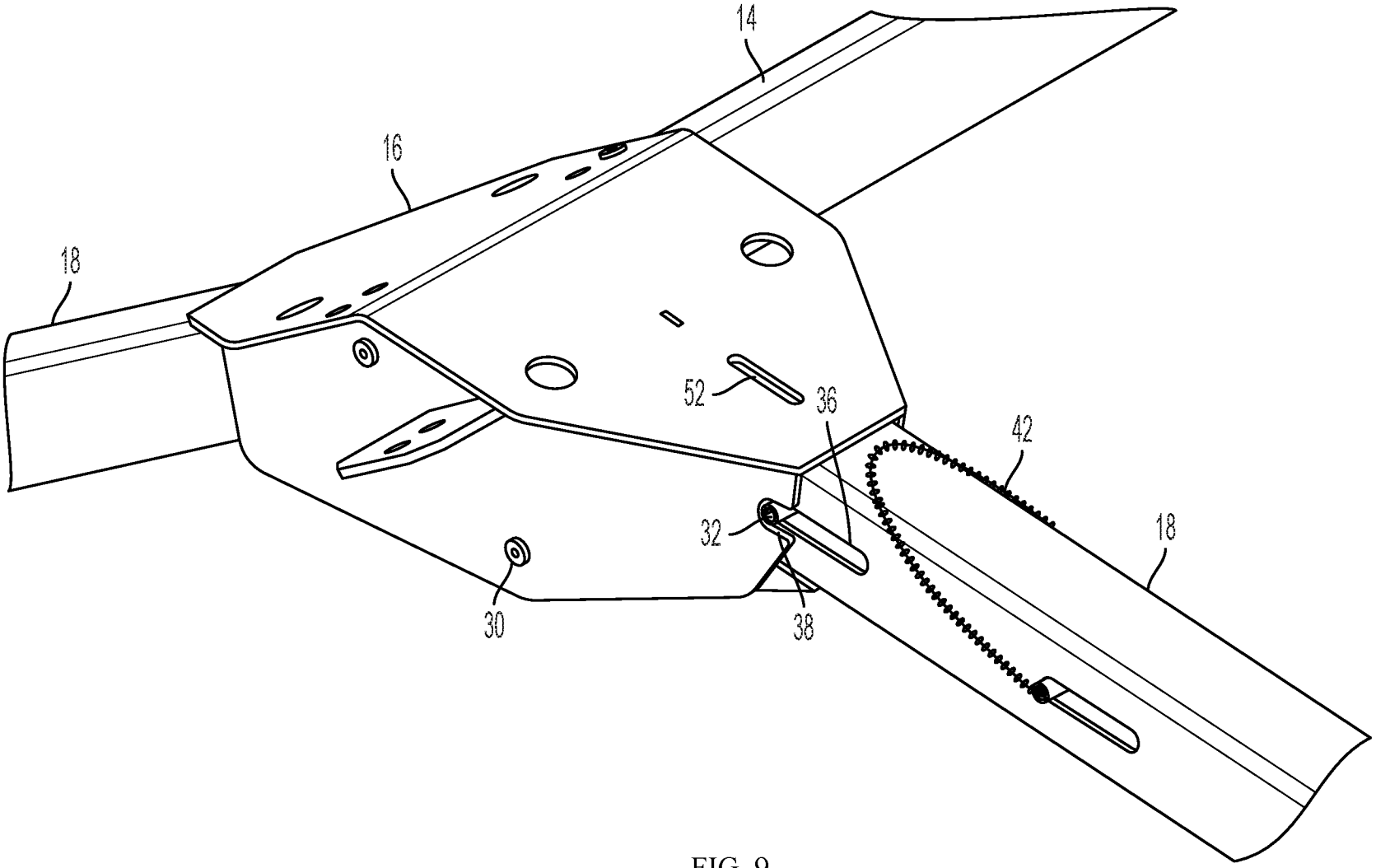
FIG. 9 is a perspective view of a Peak Bracket.
Figure 10:
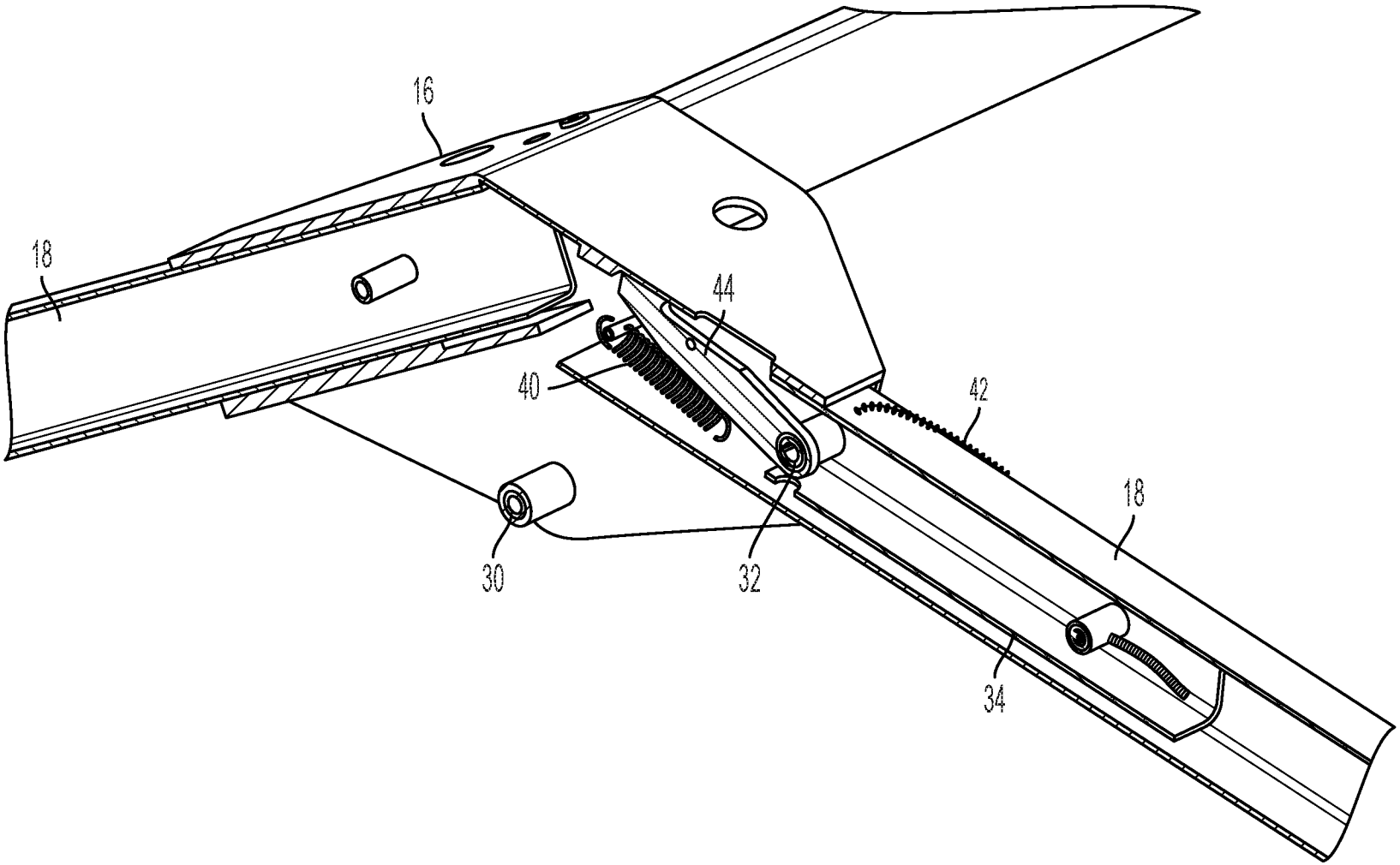
FIG. 10 is a perspective view of the Peak Bracket shown in FIG. 9 partially in cross-section, showing chord connections, peak hinge, and sliding lock mechanism with lockout feature.

Peak brackets 16 are hingedly connected to chord 18 about axis 30. When in the unfolded position shown in FIGS. 9 and 10, the chord 18 is locked in place by pins 32 which are mounted on interior sliding locking frame 34 and extend through slots 36 in the sides of chords 18, and into slots 38. Pins 32 are biased by spring 40 into the locked position shown in FIG. 9. Pulling on cable 42 slides subframe 34 away from the peak bracket 16, releasing pin 32 from slot 38 and allowing chord 18 to rotate.

Thus peak bracket joints, chord knee joints, purlin knee joints, and leg knee joints all contain self-resetting lock mechanisms. During set up they lock the joints into place without needing to be touched. Once unlocked they reset to automatically lock the joints into place on the next setup.

Figure 11:
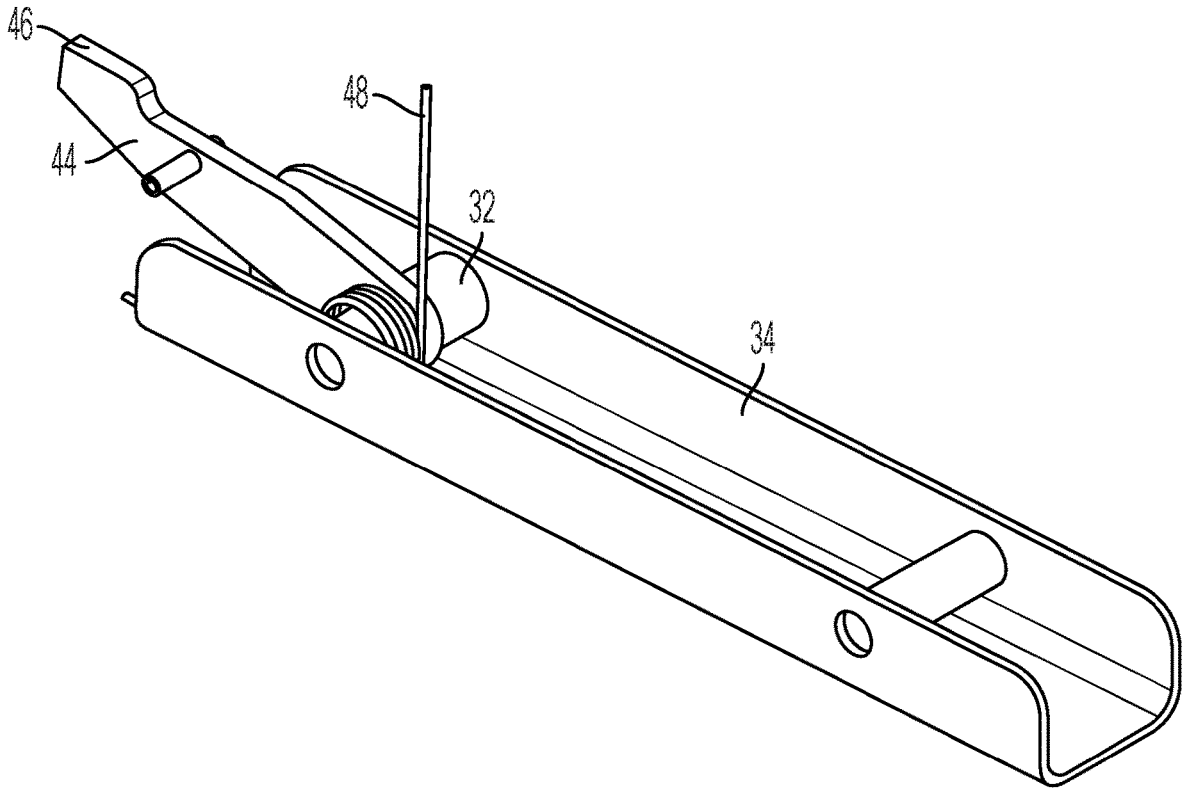
FIG. 11 is a perspective view of a detail of the sliding lock mechanism with lockout feature.

As previously noted peak brackets 16 and chord knee joints 26, contain a secondary lockout feature which allows joints to be set into an unlocked position until the joint is bent, at which time the lock resets, ready to lock the joint into position on the next setup. This assists the pack up procedure, as multiple joint locks didn't need to be manually held unlocked at the same time. Lockout bars 44 permit the chords 18 to be kept in an extended unfolded position without locking. With reference to FIG. 11, lockout bar 44 is hingedly mounted on pin 32 on sliding locking frame 34. It is biased to an upward position by spring 48. Head 46 is sized to move upwardly into slot 50 of chord knee joint 26 or slot 52 of peak bracket 16. By pulling on cable 42 the operator can unlock the joint by allowing head 46 to extend into slot 50/52 to prevent the joint from re-locking while keeping the joint unfolded. Once the joint is bent, head 46 comes out of slot 50/52 at which time the lock resets, ready to lock the joint into position on the next setup.

Figure 12:
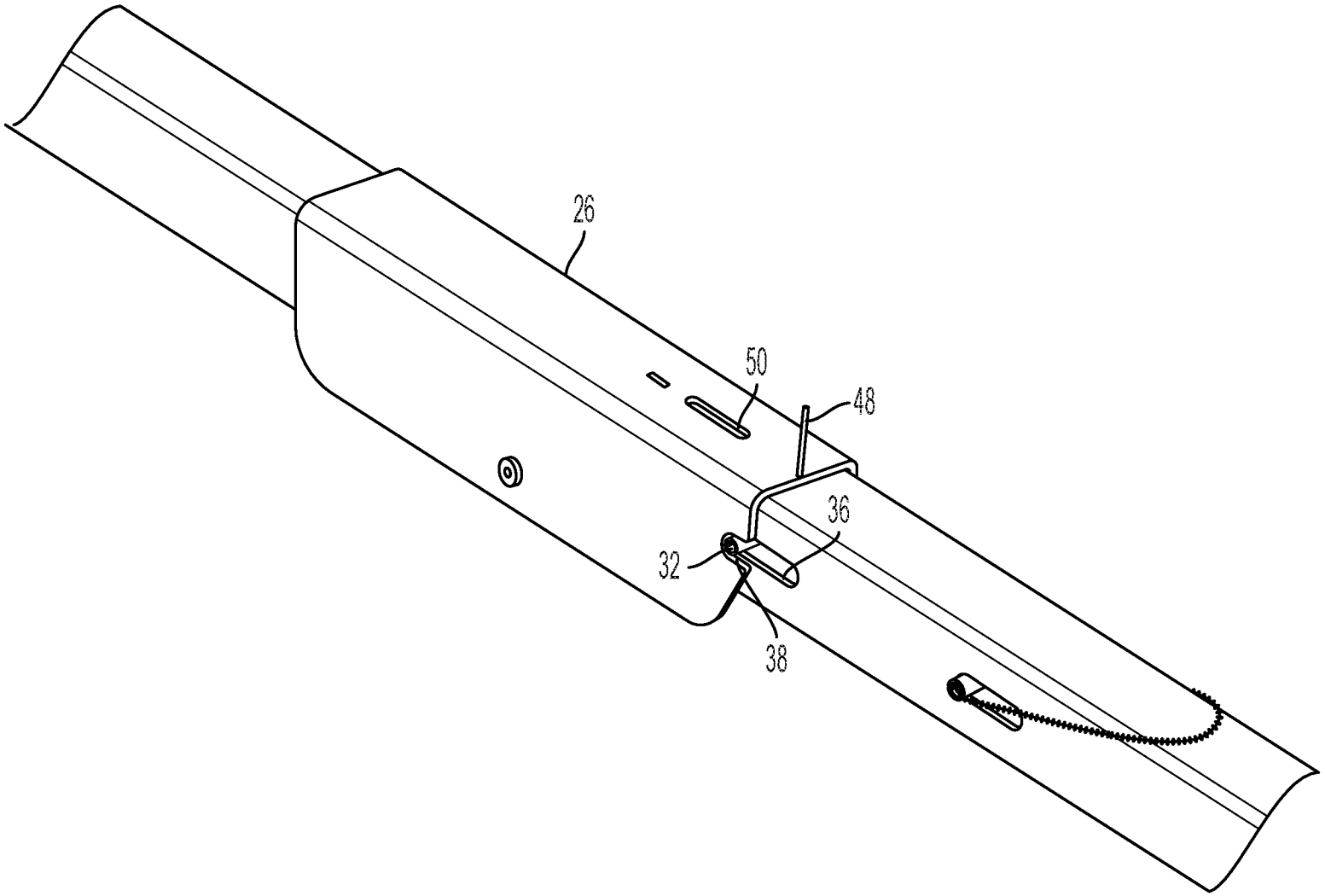
FIG. 12 is a perspective view of the chord knee bracket.
Figure 13:
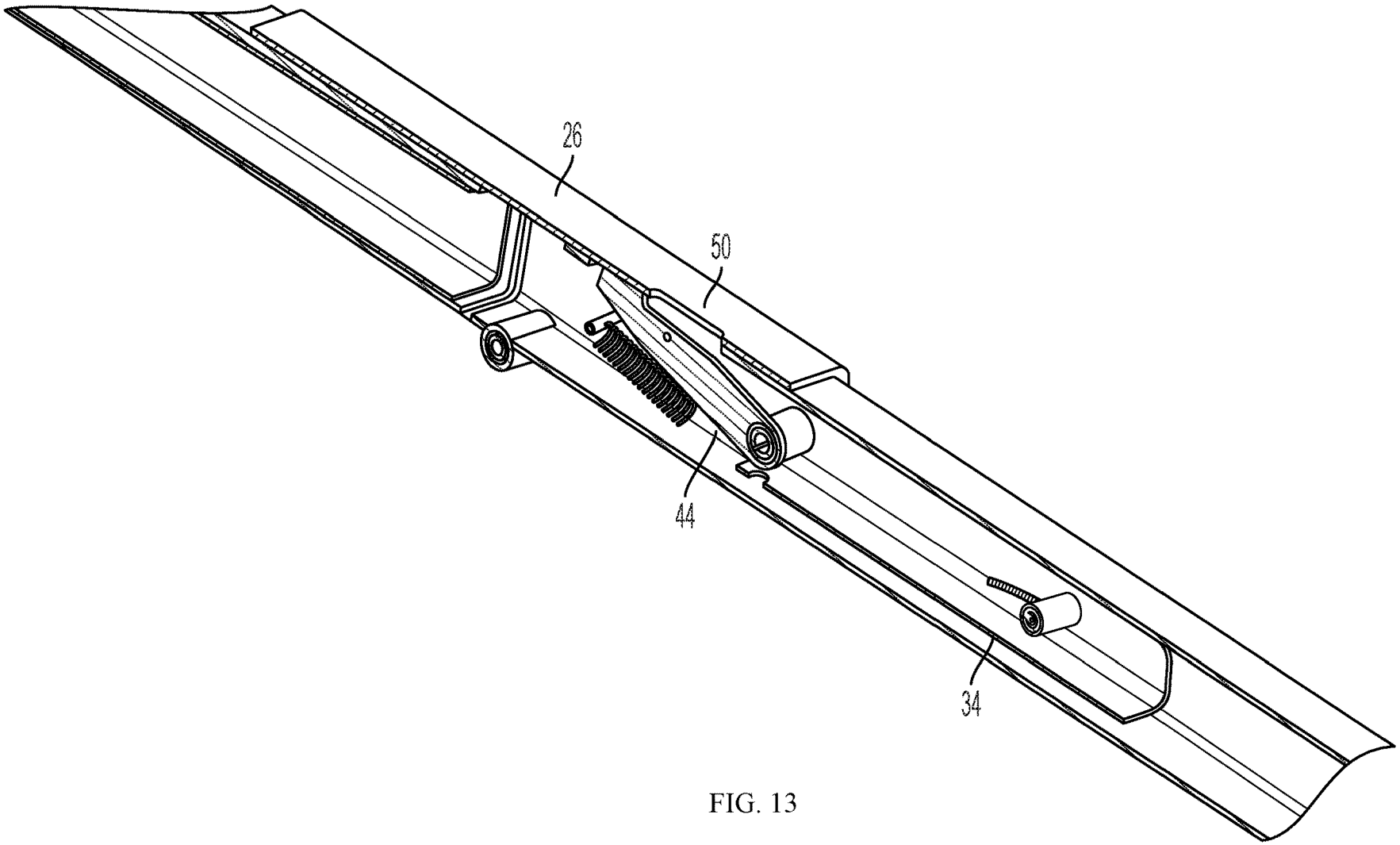
FIG. 13 is a perspective view partially in cross-section of the chord knee bracket of FIG. 12 showing the sliding lock mechanism with lockout feature.

Chord knee bracket shown in FIGS. 12 and 13 operates in the same way as the peak bracket 16 using sliding locking frame 34.

Figure 14:
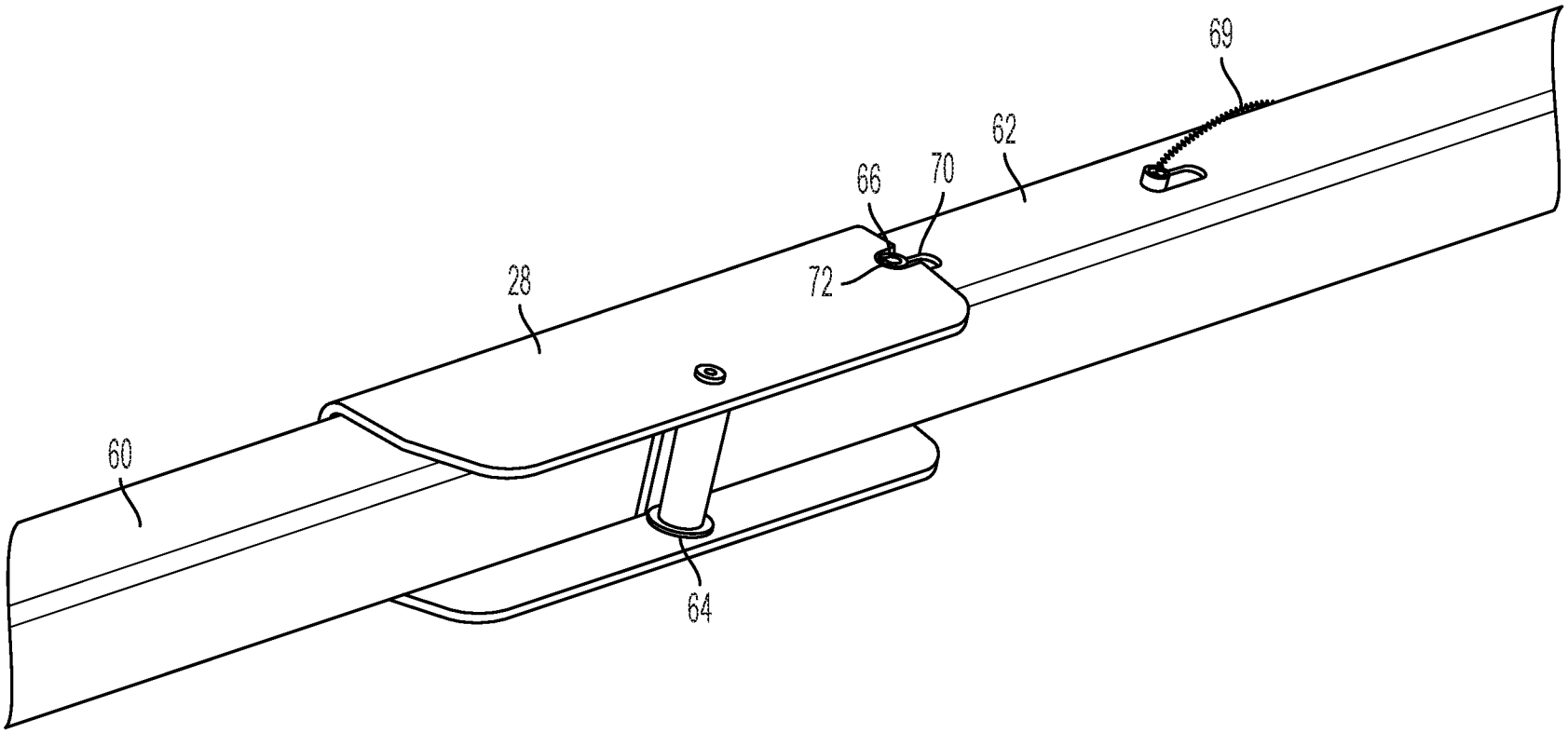
FIG. 14 is a perspective view of a purlin knee bracket.
Figure 15:
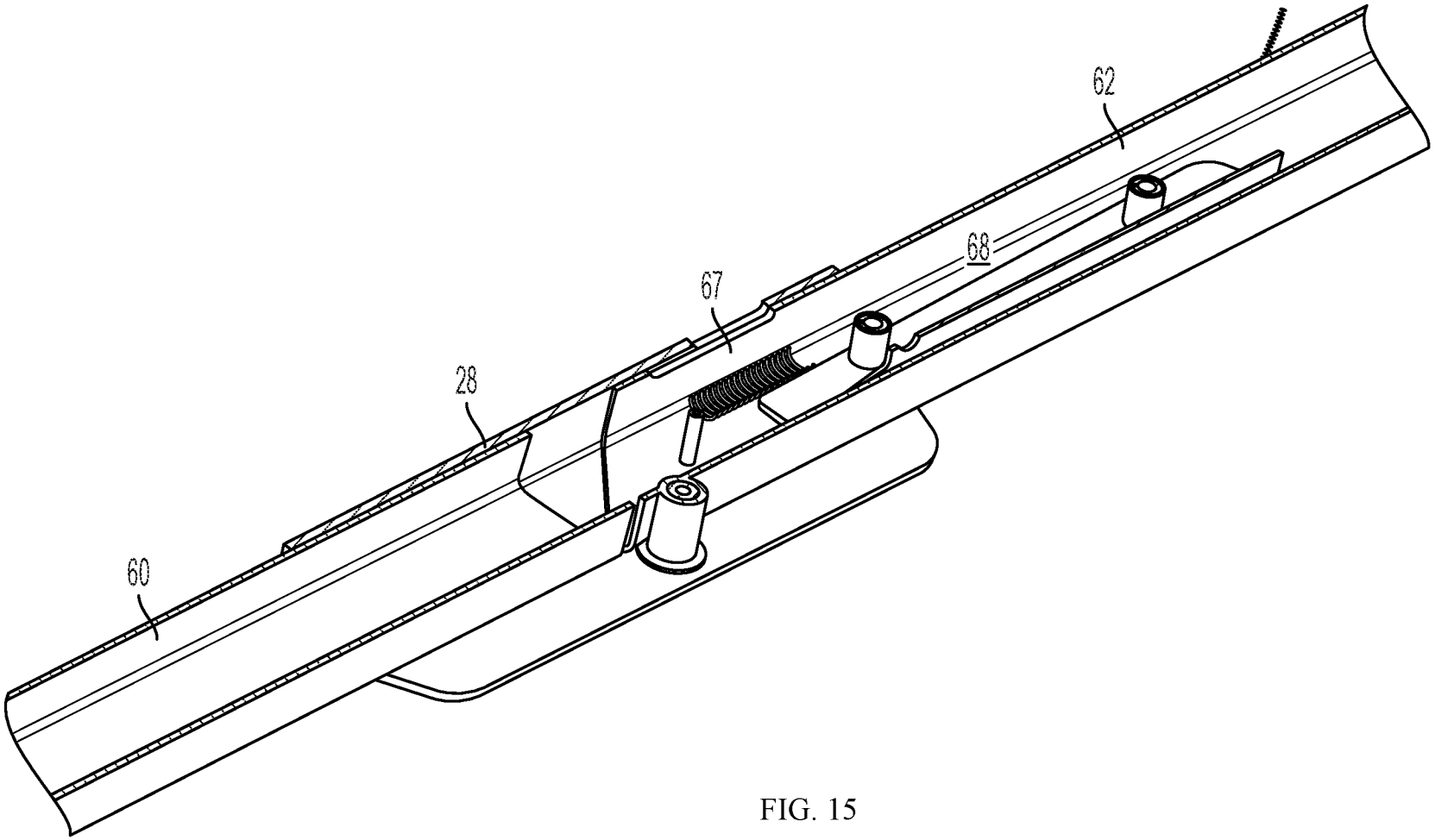
FIG. 15 is a detail front perspective view partially in cross-section of the purlin knee Bracket of FIG. 14, with sliding lock mechanism but no lockout feature.
Figure 16:
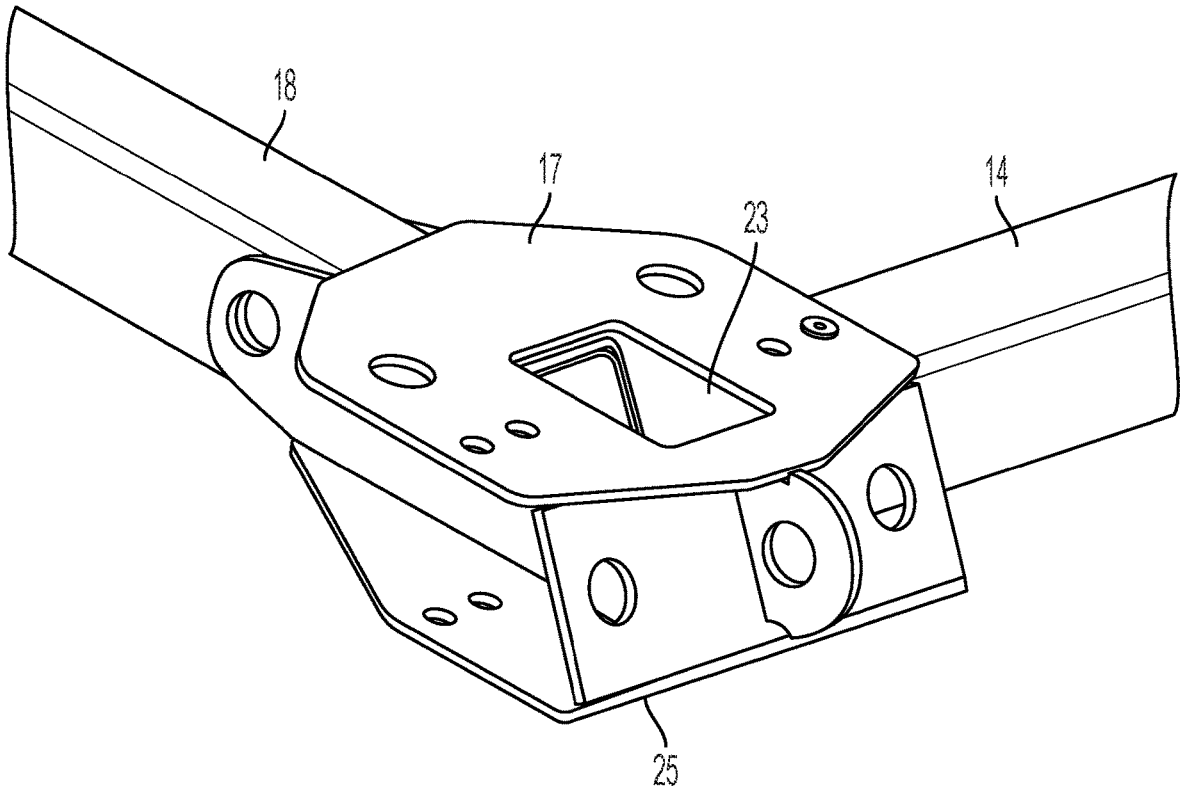
FIG. 16 is a detail rear perspective view of an eave bracket.
Figure 17:
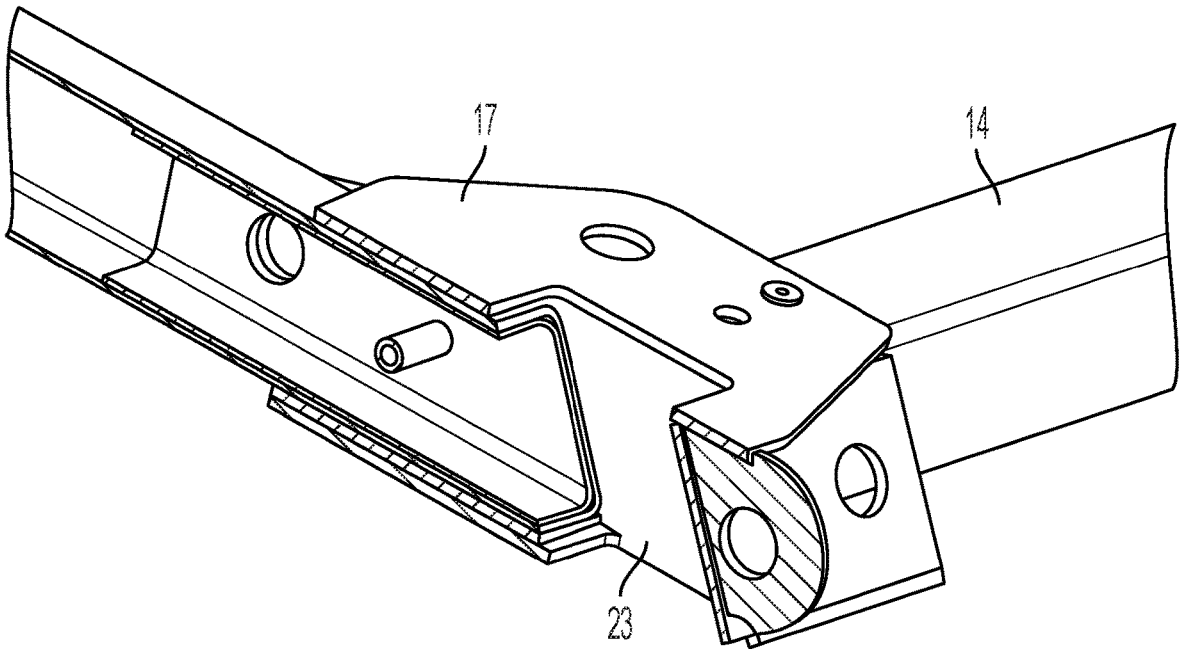
FIG. 17 is a detail perspective view partially in cross-section of the eave bracket of FIG. 16.
Figure 18:
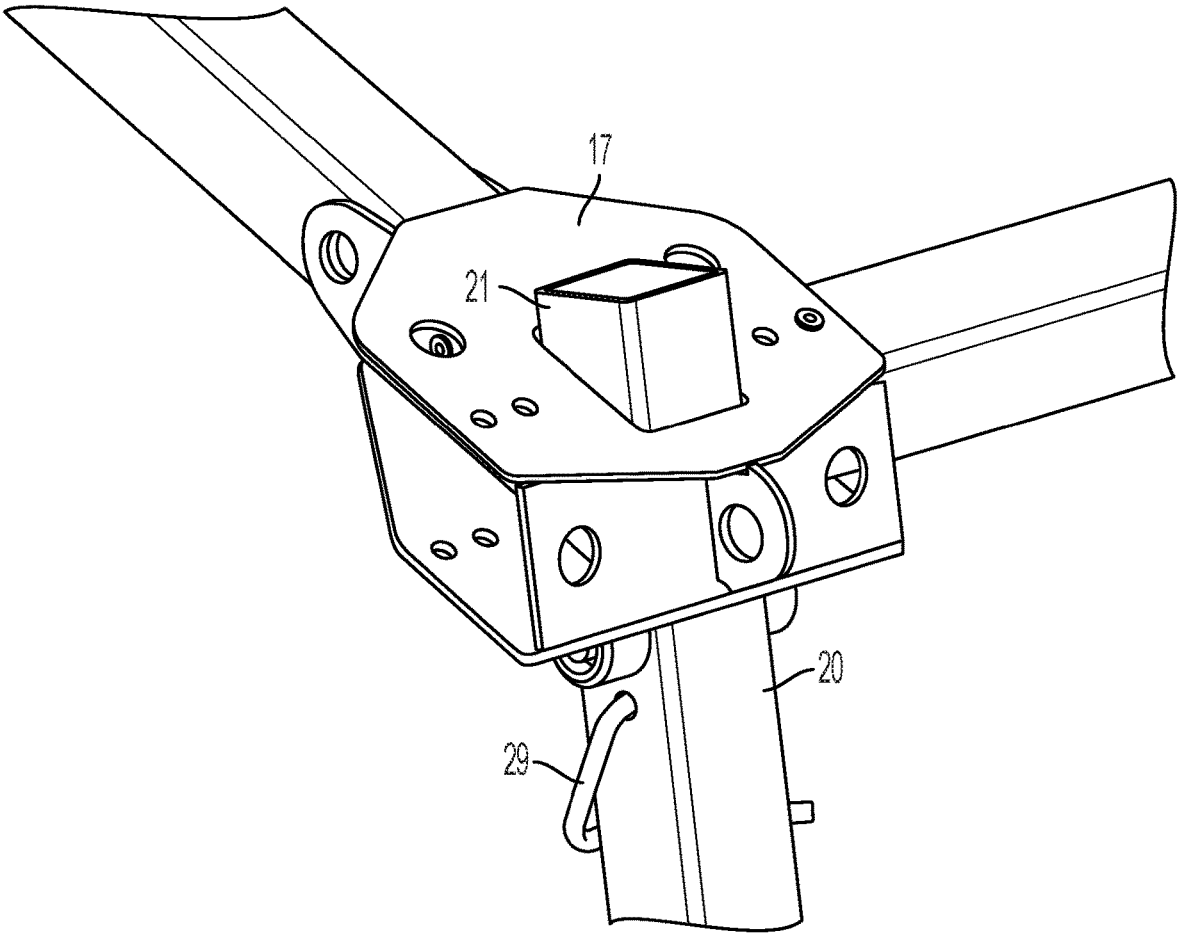
FIG. 18 is a detail front perspective view of the eave bracket of FIG. 16 with a leg inserted.

Purlin knee joints 28, and leg knee joints 30 operate in the same manner as the chord knee bracket 26 and the peak bracket 16 without the secondary lockout feature. Purlin knee bracket 28 is shown in FIG. 14. Purlin sections 60, 62 are hingedly connected about axis 64. When in the unfolded position shown in FIGS. 14 and 15, the purlin sections 60, 62 are locked in place by pins 66 which are mounted on interior sliding locking frame 68 and extend through slots 70 in the sides of the purlins, and into slots 72. Pins 66 are biased by spring 67 into the locked position shown in FIG. 14. Pulling on cable 69 slides locking frame 68, releasing pins 66 from slot 72 and allowing purlin sections 60, 62 to rotate.

Eave brackets 17 receive the upper end 21 of legs 20 through apertures 23.

Figure 19:
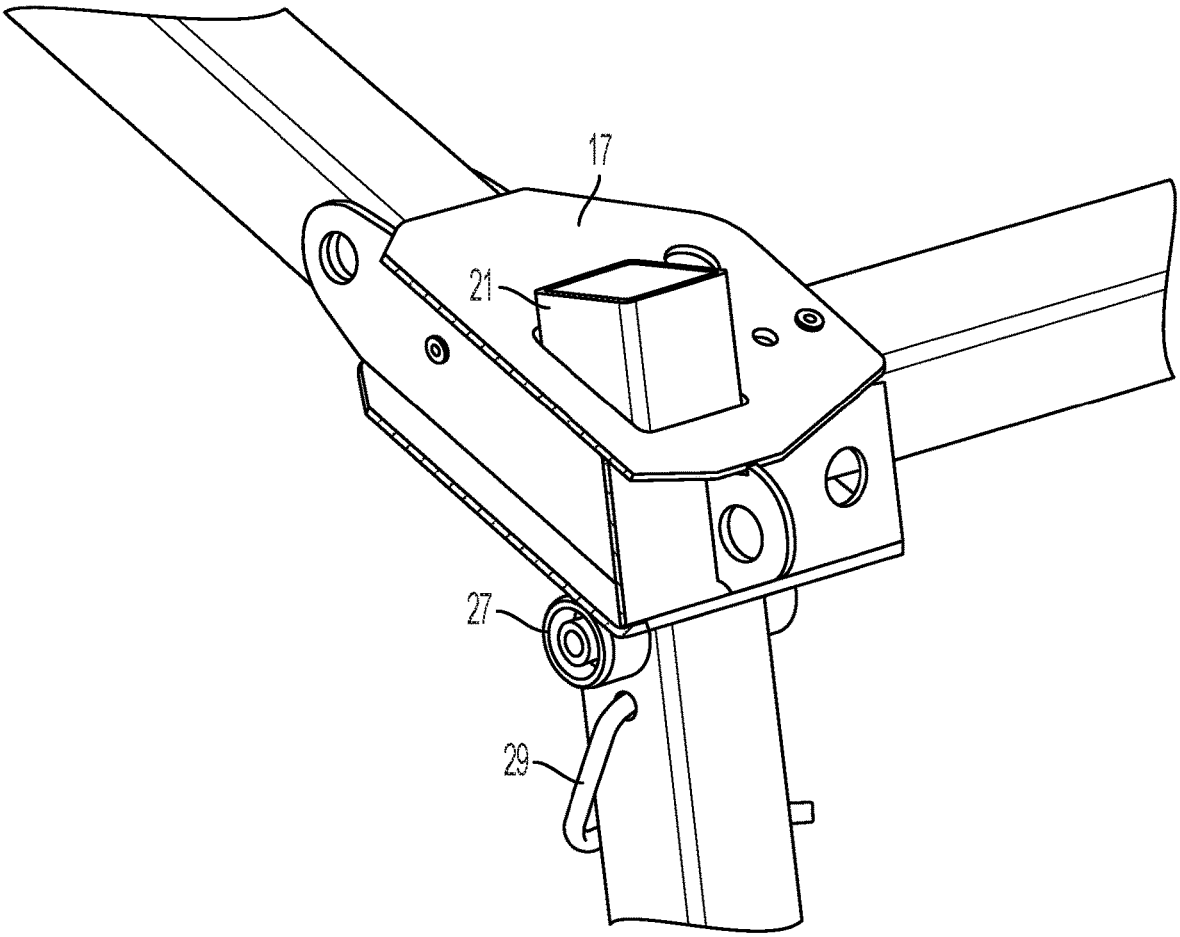
FIG. 19 is a detail front perspective view in partial cross-section of the eave bracket of FIG. 18 with leg inserted, shown resting in place on the upper leg bosses.
Figure 20A:
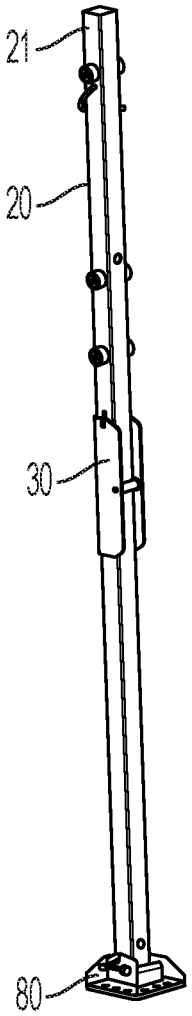
FIG. 20A is a detail front perspective view of a leg assembly.
Figure 20B:
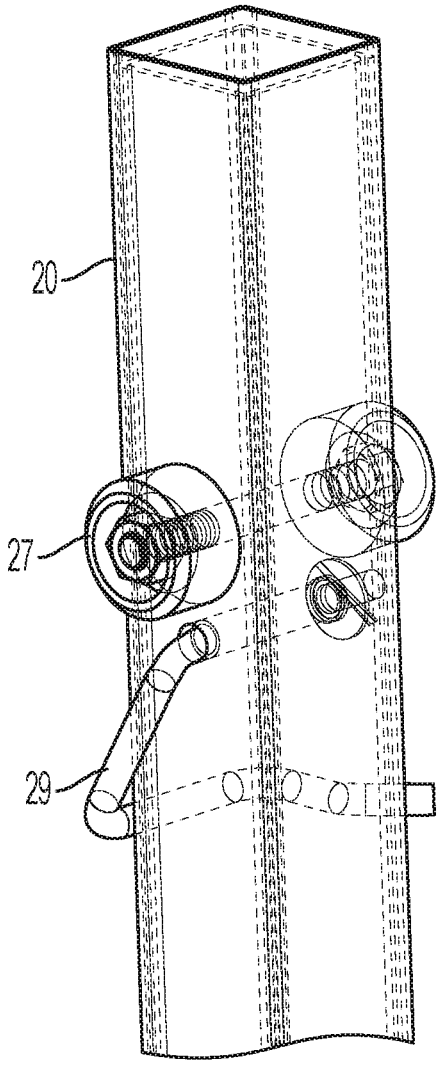
FIG. 20B is a detail front perspective view of a top portion of the leg assembly of FIG. 20A showing pinned bosses and a close haul wire hook for cover connection.
Figure 21A:
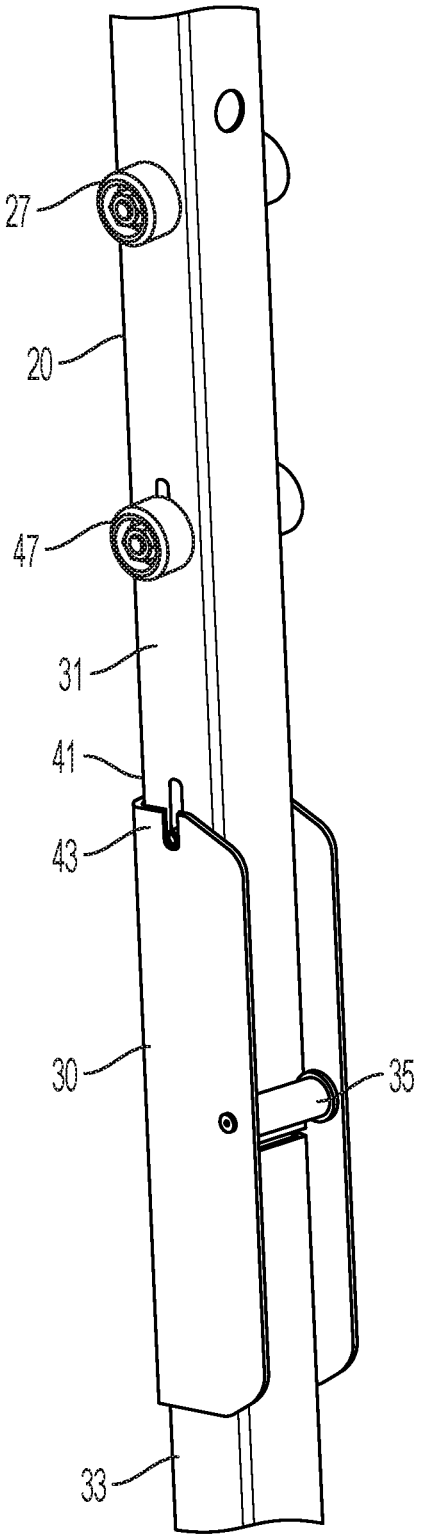
FIG. 21A is a detail front view of a leg knee joint.
Figure 21B:
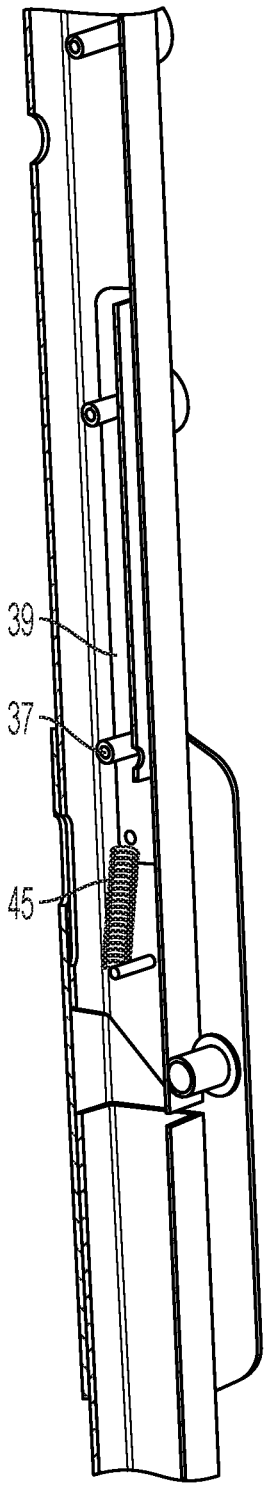
FIG. 21B is a detail front view of the leg knee joint of FIG. 21A partially in cross-section showing a locking slider.

The lower surface 25 of bracket 17 rests on upper leg bosses 27 when the legs are in place. As shown in FIGS. 19 and 20B, leg 20 may be provided with close haul wire j-hook 29 for cover connection. As noted above, leg knee joints 30 operate in the same manner as the chord knee bracket 26 and the peak bracket 16 without the secondary lockout feature. Leg knee joint 30 is shown in FIGS. 21A and 21B. Leg sections 31, 33 are hingedly connected about axis 35. When in the unfolded position shown in FIGS. 21A and 21B, leg sections 31, 33 are locked in place by pins 37 which are mounted on interior sliding locking frame 39 and extend through slots 41 in the sides of the legs 20, and into slots 43. Pins 37 are biased by spring 45 into the locked position shown in FIG. 21A. Pulling on boss 47 slides locking frame 39, releasing pins 37 from slot 43 and allowing leg sections 31, 33 to rotate. This lock mechanism allows for a two-handed grip when lowering the shelter.

Figure 22:
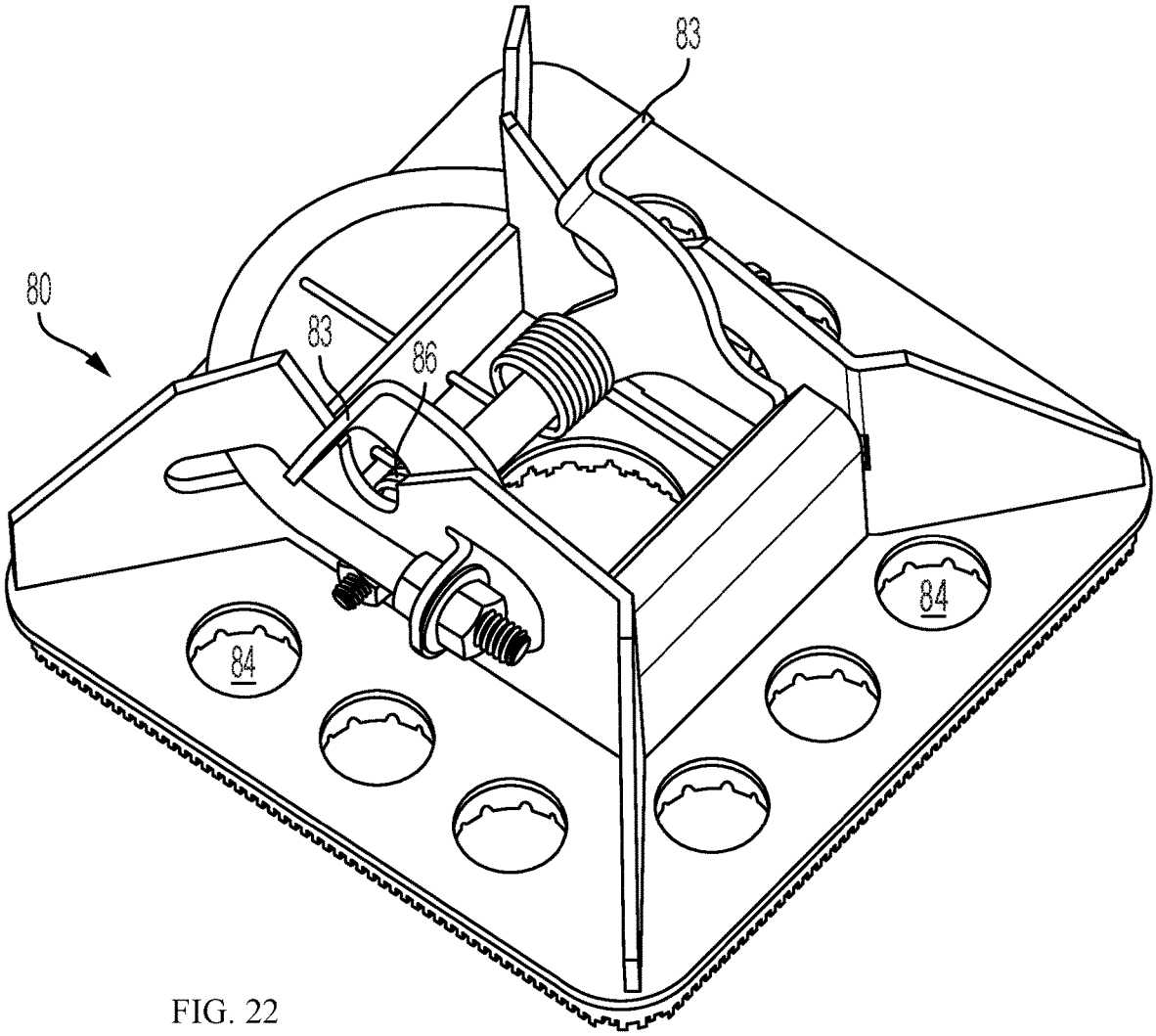
FIGS. 22 and 23 are perspective detail views of a quick release foot assembly.
Figure 23:
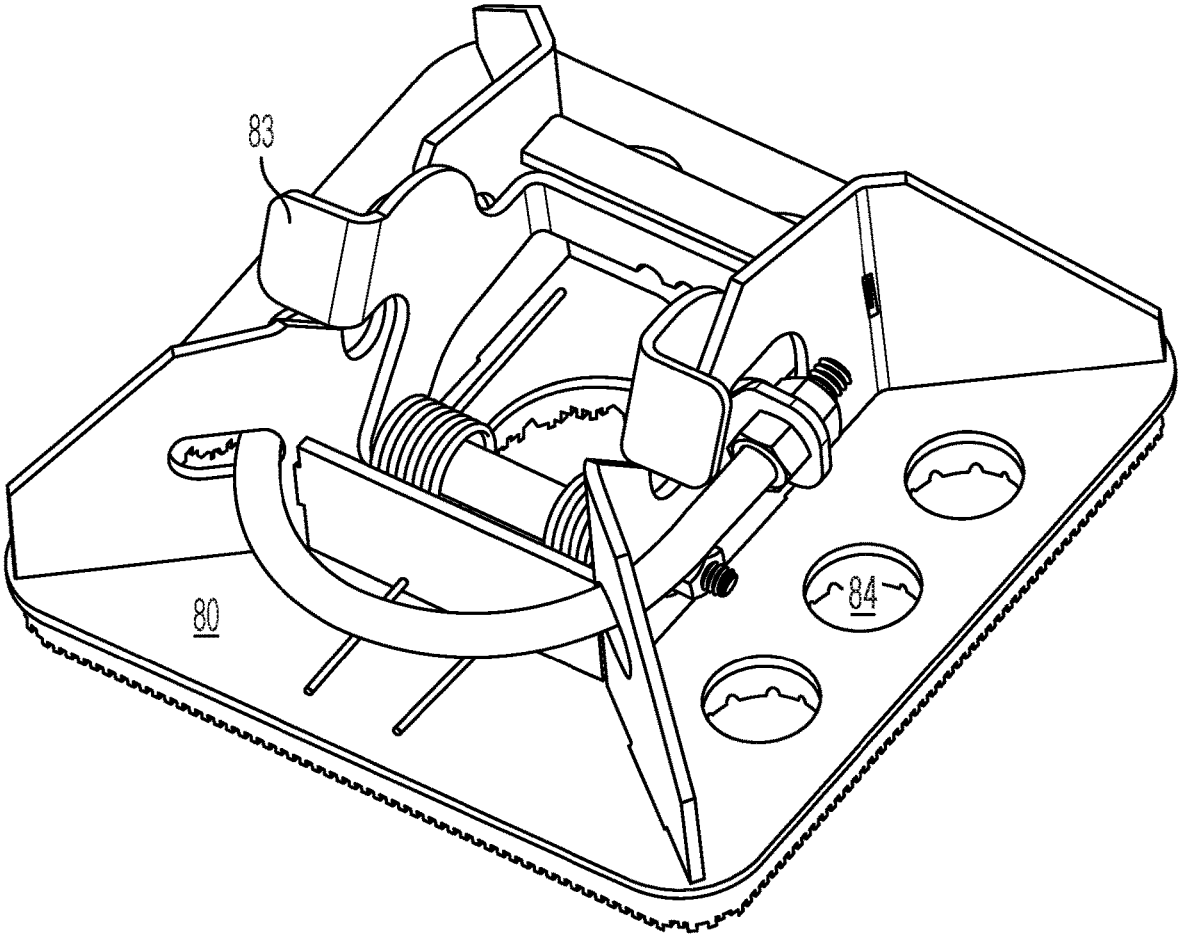

FIGS. 22 and 23 show a quick release foot assembly 80 for attachment to legs 20. Such quick release feet allow a high wind set up and tear down procedure, where the feet 80 are removed from the legs 20 before setup, attached to the shelter's floor and securely anchored to the ground through apertures 84. When the frame is erected, horizontal cylindrical extensions (not shown) on the legs 20 snap into slots 86 in the pre-anchored feet 80 to be held in place by spring-biased hinged arms 83, greatly reducing the risk of injury to personnel or damage to equipment. High wind take down is the opposite of set up, where the shelter feet can be released from the leg assembly by using a foot to force open arms 83, which allows a steady two-handed grasp on the leg at all times. Foot pads 80 are also sized to allow a low enough ground pressure, even with a snow loaded shelter, such that any ground capable of supporting a walking individual, or a vehicle driving on normal tires, is sufficient to support the shelter.

Figure 24:
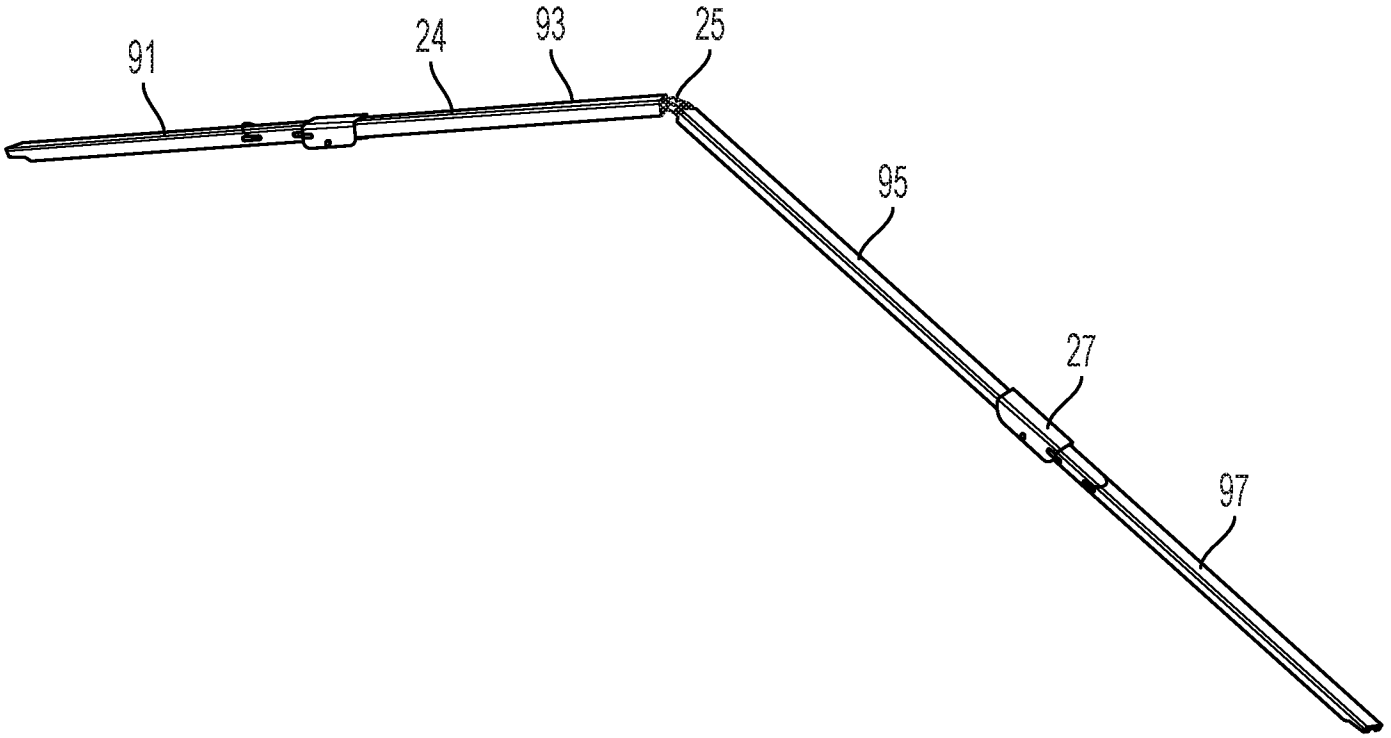
FIG. 24 is a perspective view of the midspan chord.
Figure 25:
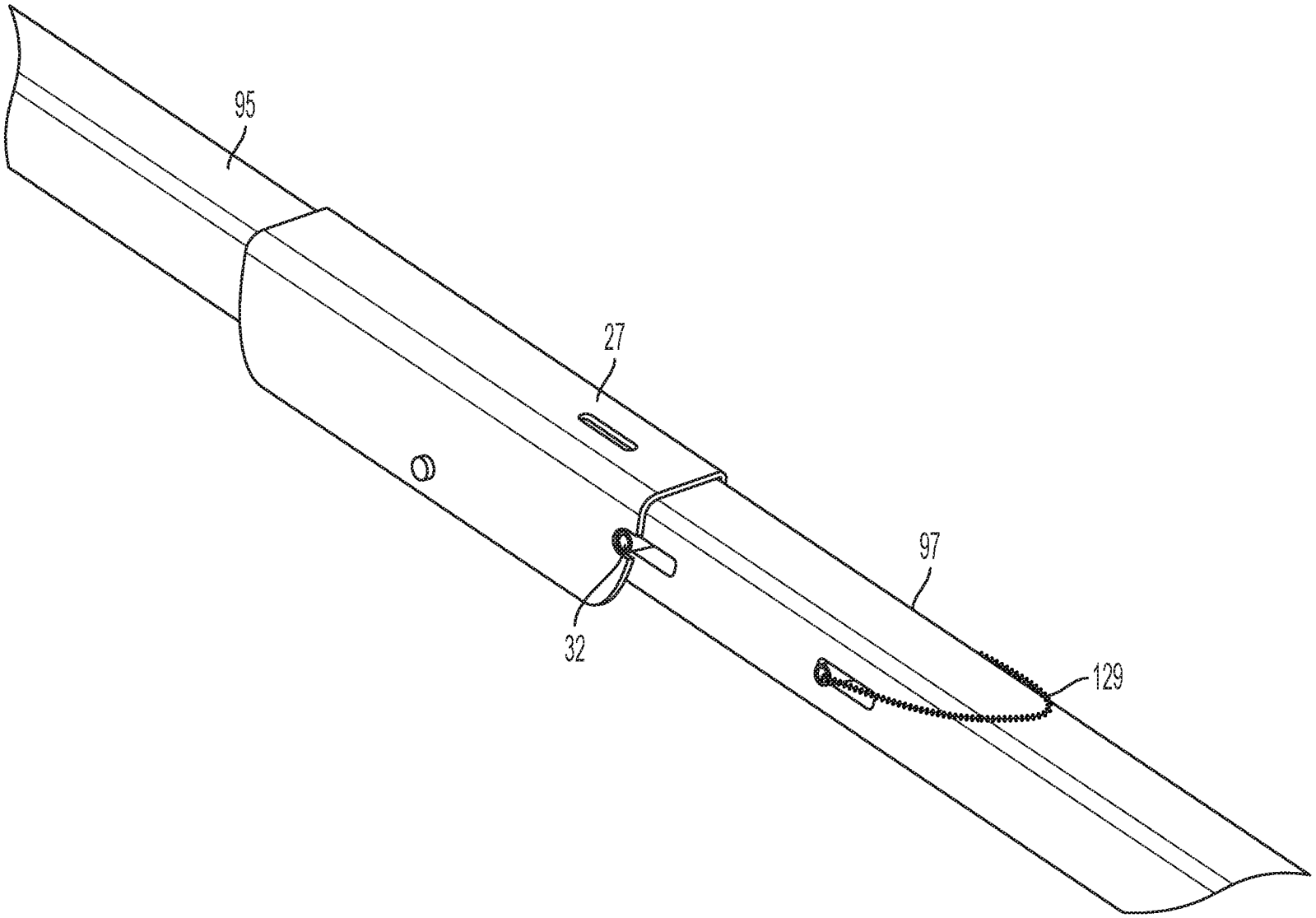
FIG. 25 is a detail perspective view of the midspan chord knee joint.
Figure 26:
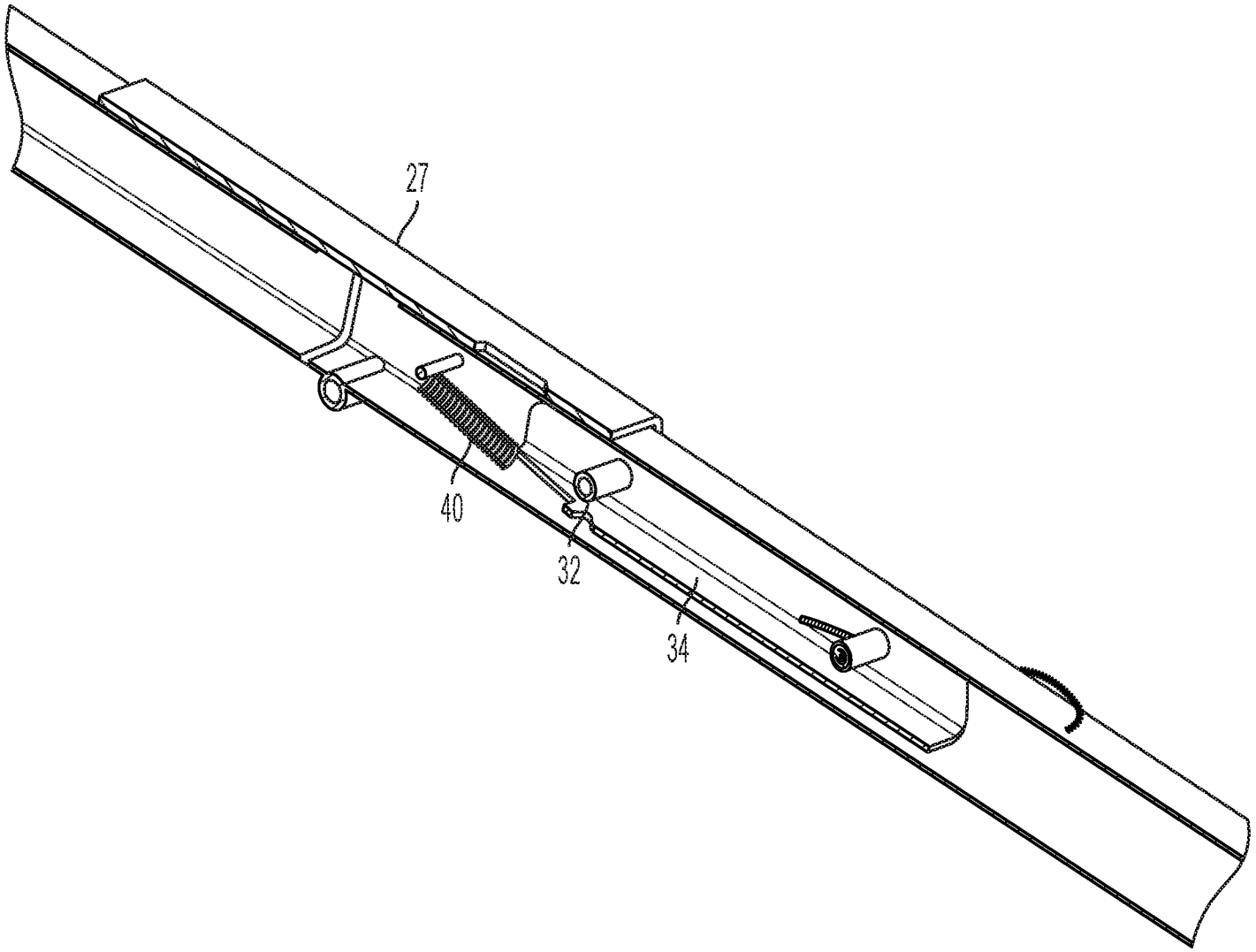
FIG. 26 is a detail perspective view partially in cross-section showing the midspan chord knee joint with lock slider.
Figure 27:
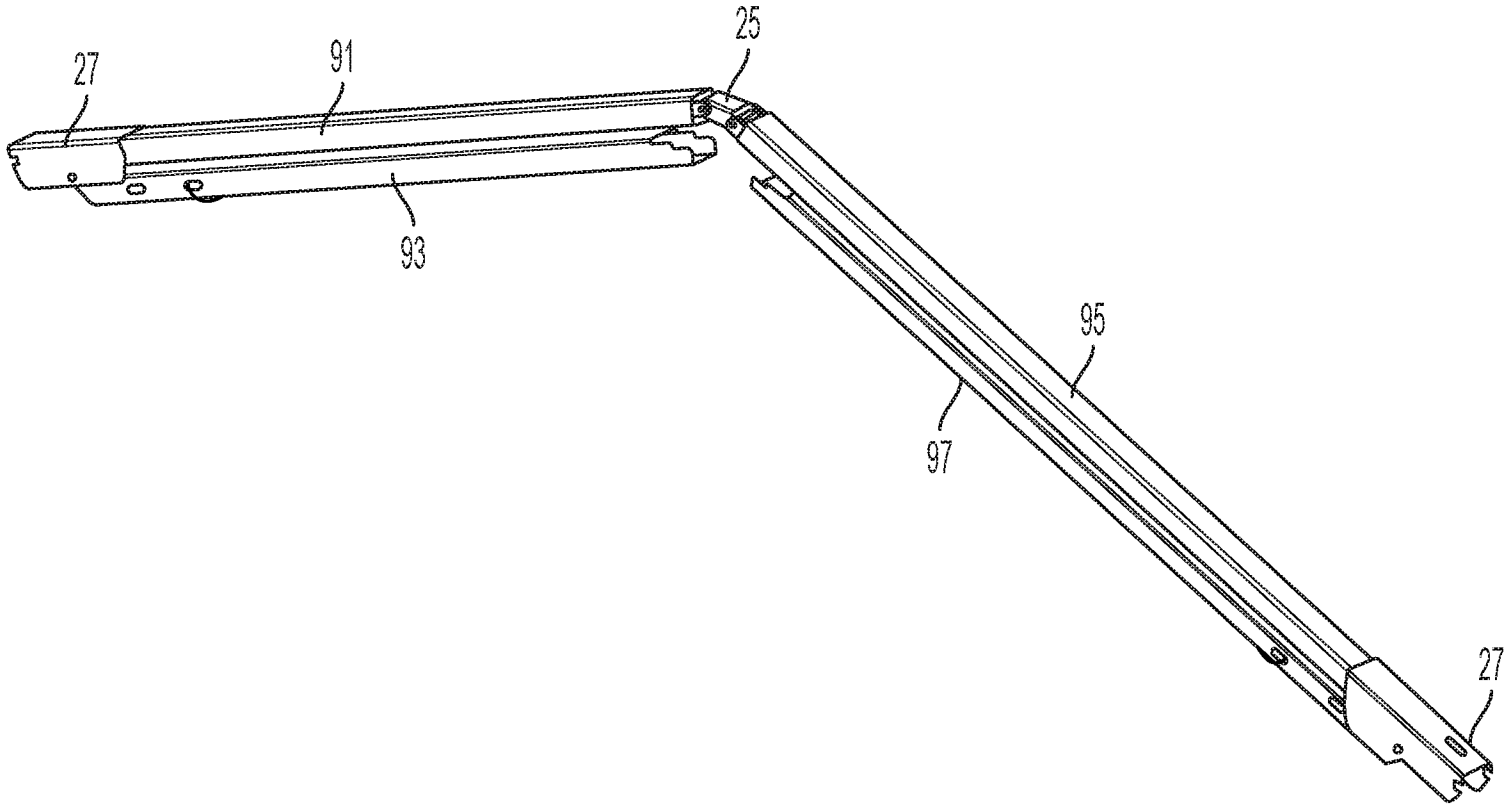
FIG. 27 is a perspective view of the midspan chord partially folded.
Figure 28:
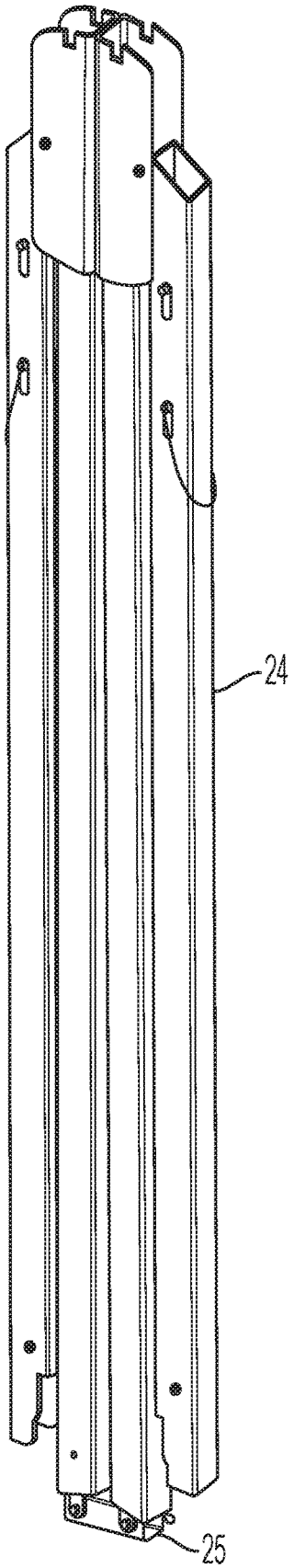
FIG. 28 is a perspective view of the midspan chord fully folded.
Figure 29:
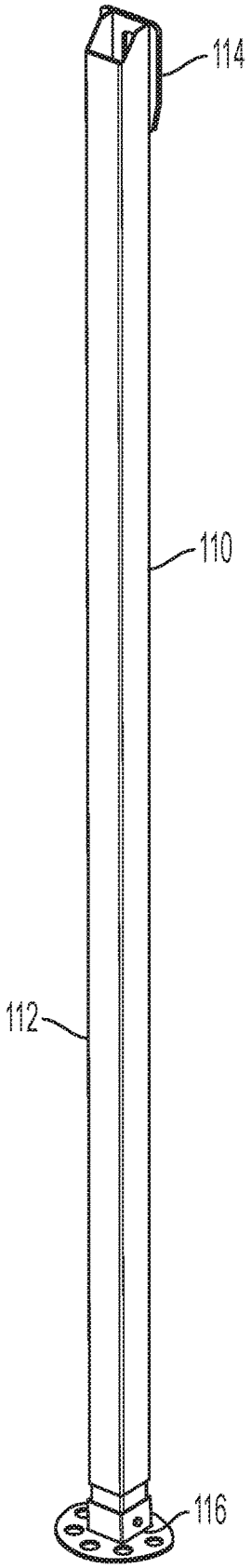
FIG. 29 is a perspective view of a telescoping wind kit post.
Figure 30:
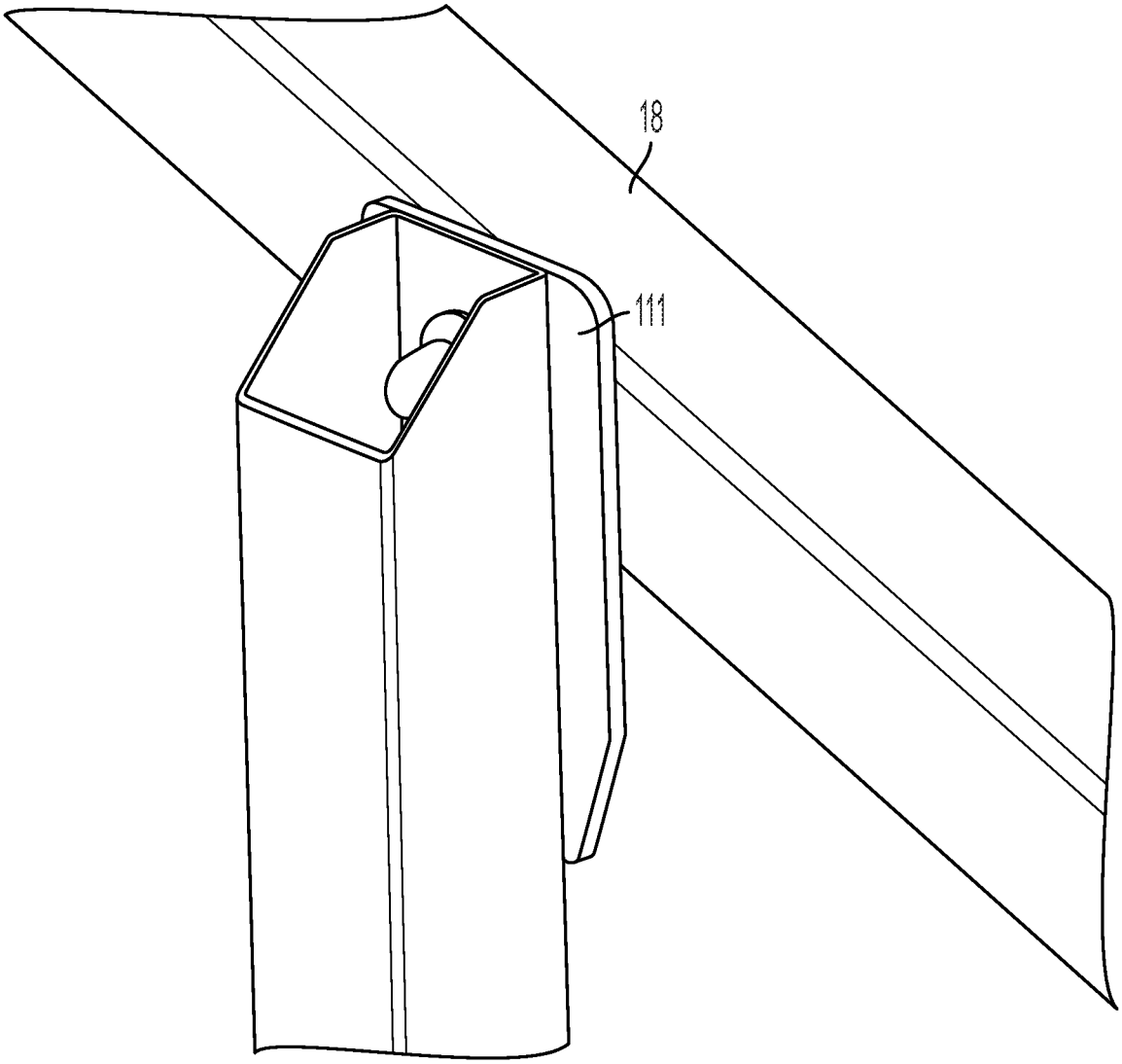
FIG. 30 is a detail perspective view of the wind kit post connection.
Figure 31:
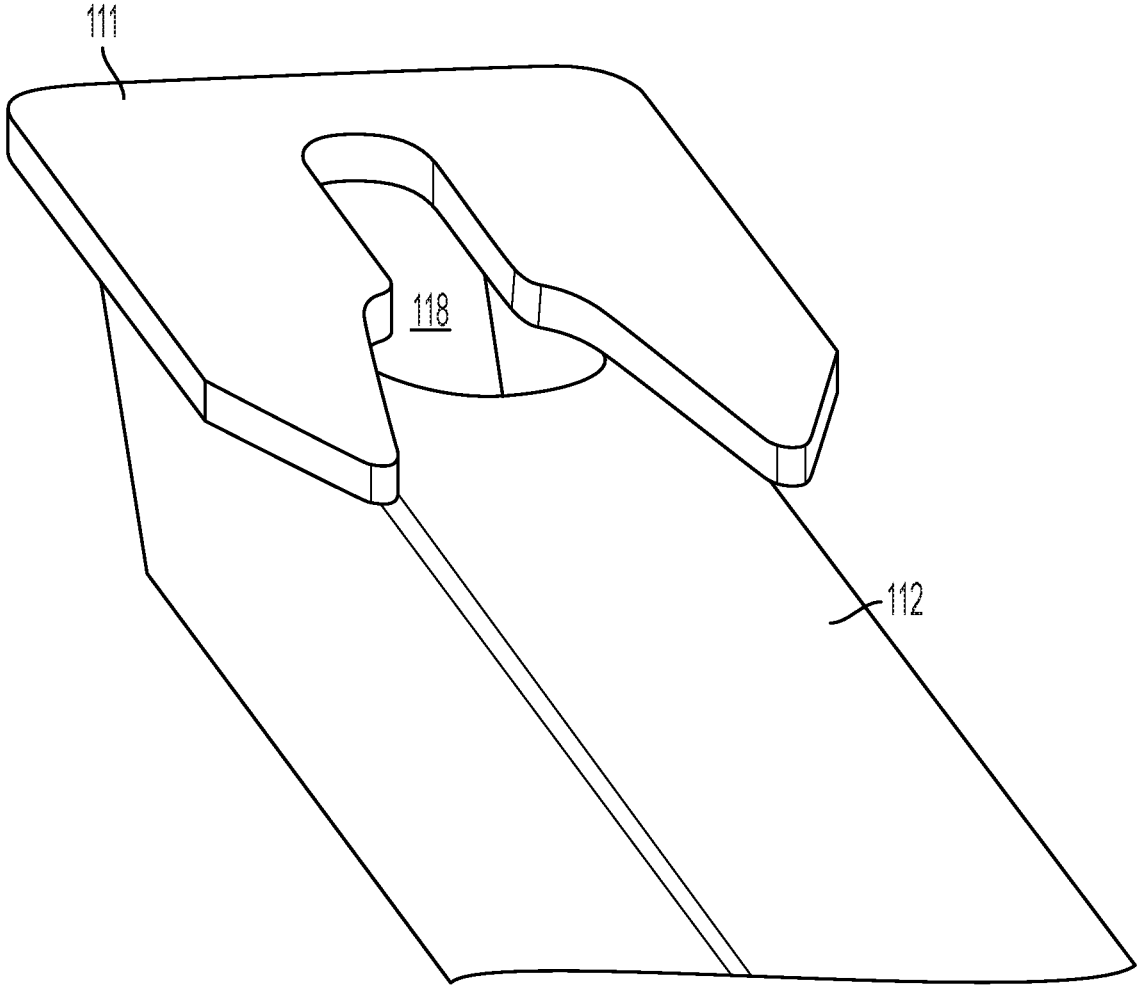
FIG. 31 is an isolated detail perspective view of the connecting bracket of the wind kit post.
Figure 32:
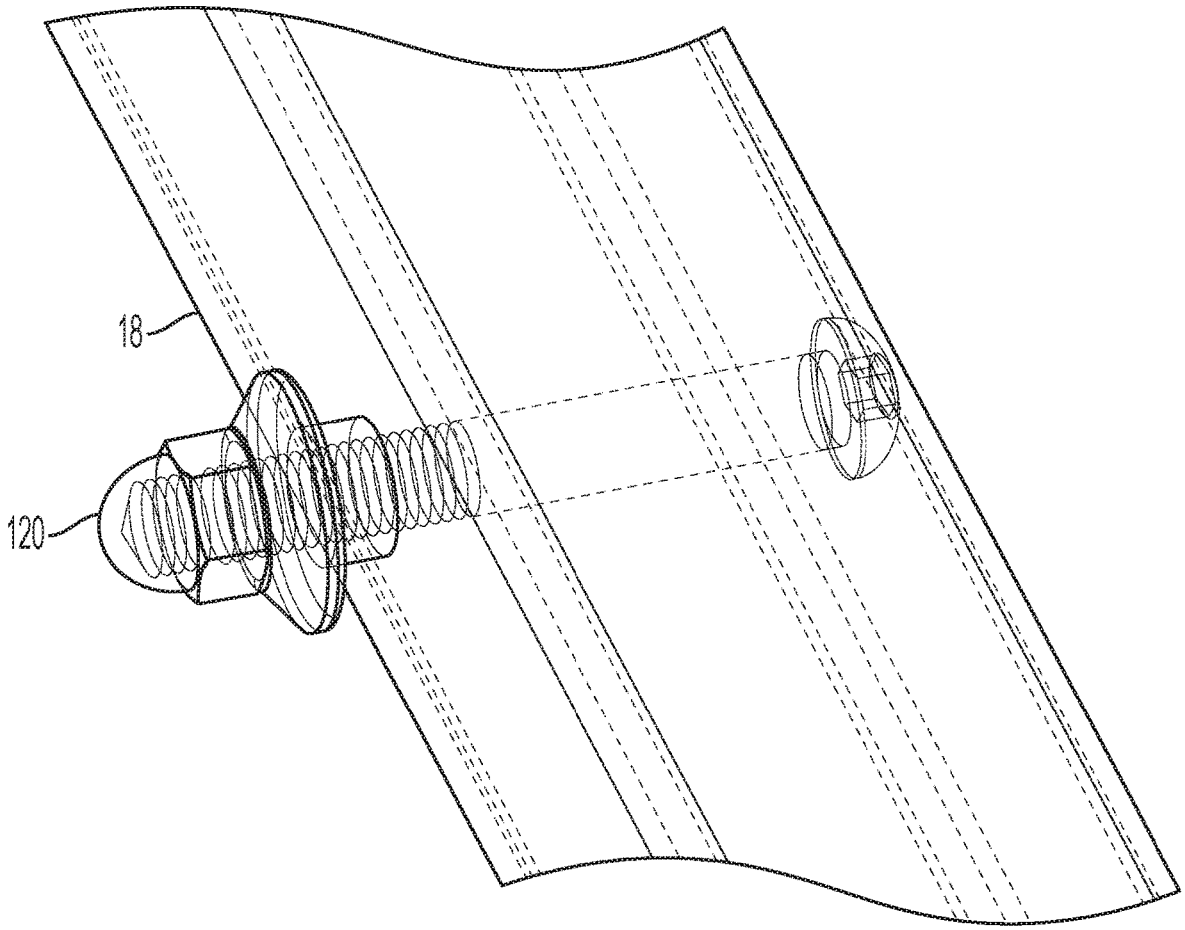
FIG. 32 is an isolated detail perspective view of the connecting fastener on the chord for the wind kit post.
Figure 33:
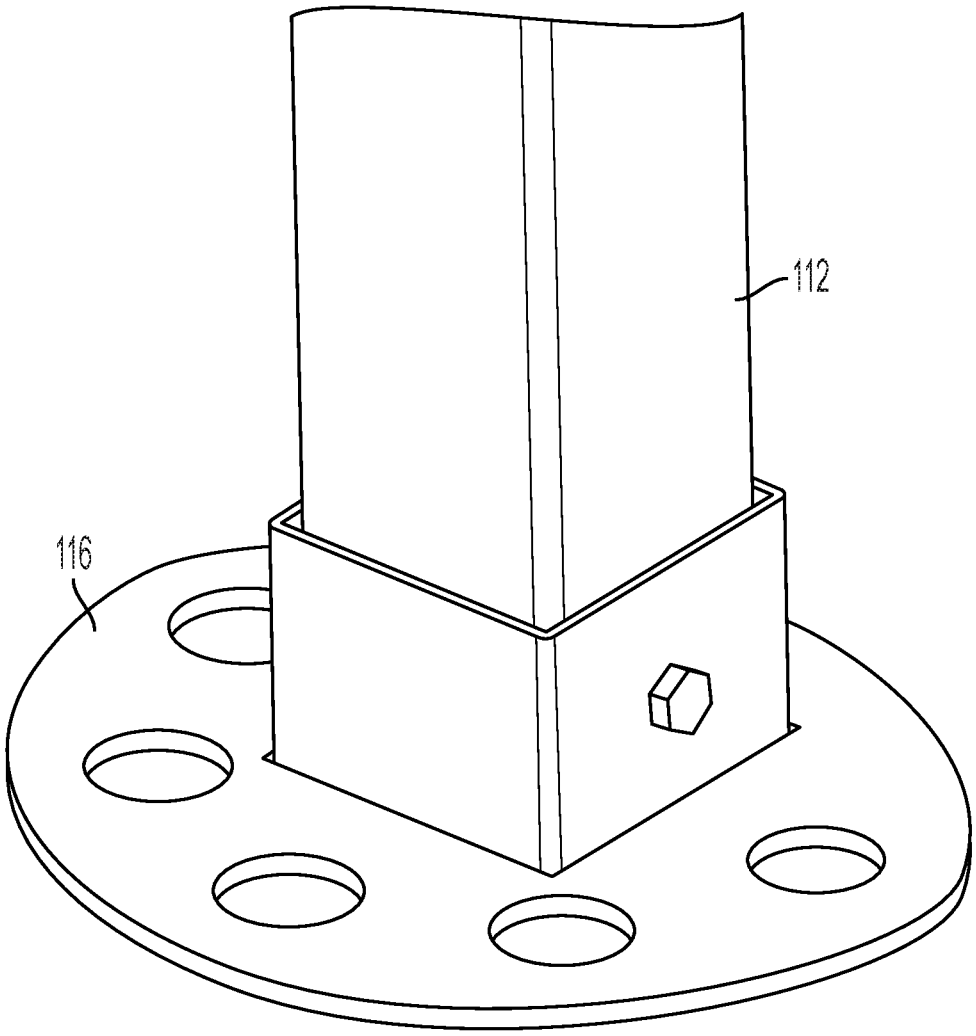
FIG. 33 is a detail perspective view of the wind kit foot.

Midspan chords 24 are shown in FIG. 24 through 28. Each chord 24 comprises a single folding element which, when unfolded as shown in FIG. 24, rests on upper frame assembly 12, with its central hinge 25 on peak purlin bracket 28 and its ends on lower purlin brackets 28. The midspan chord knee joints 27 fold and lock/unlock the chord sections 91, 93, 95, 97 in the same manner as the purlin knee joints 28, using cable 129 to unlock the joint.

A telescoping wind kit post 110 is illustrated in FIG. 29 through 33. Such posts can be attached to chords 18 at either end of the frame 10, in order to assist in securing the cover to the structure, as follows. Each post 110 has a telescoping vertical post 112, the interior telescopic section being secured at its lower end to wind kit post foot 116. At its upper end the post 112 is provided with a bracket 113 having a keyhole slot 118 which engages a bolt 120 on chord 18.

As shown in FIGS. 34 and 35, the size of the modular structure can be increased by increasing the number of chords 18, purlins 14 and peak brackets 16 in the upper frame assembly 12, with proportionate increase in the number of legs 20 and midspan chords 24. The resulting structure may thereby accommodate a two or four bays for equipment storage.

Figure 36:
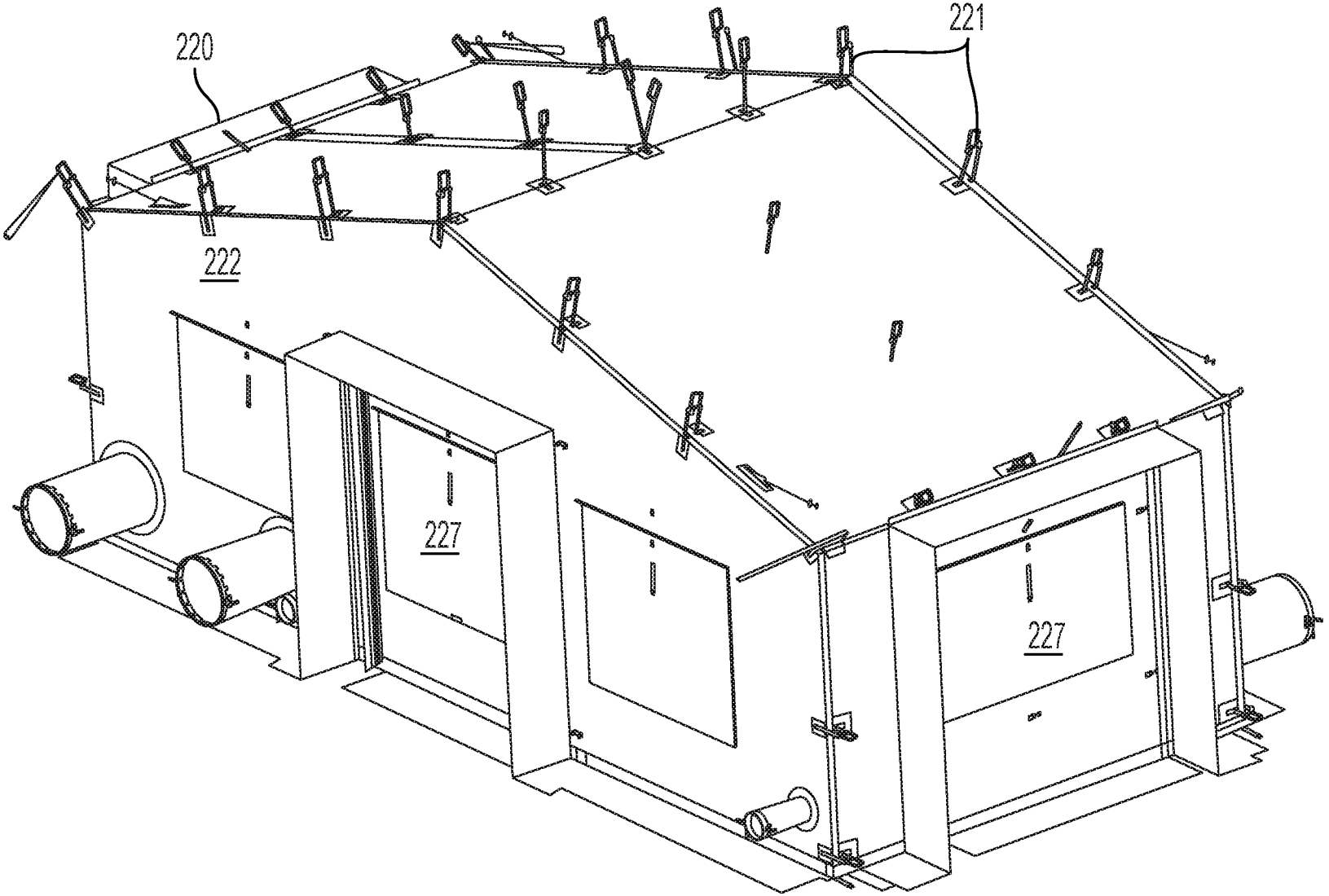
FIG. 36 is a perspective view of a completed cover for a one bay structure.
Figure 37:
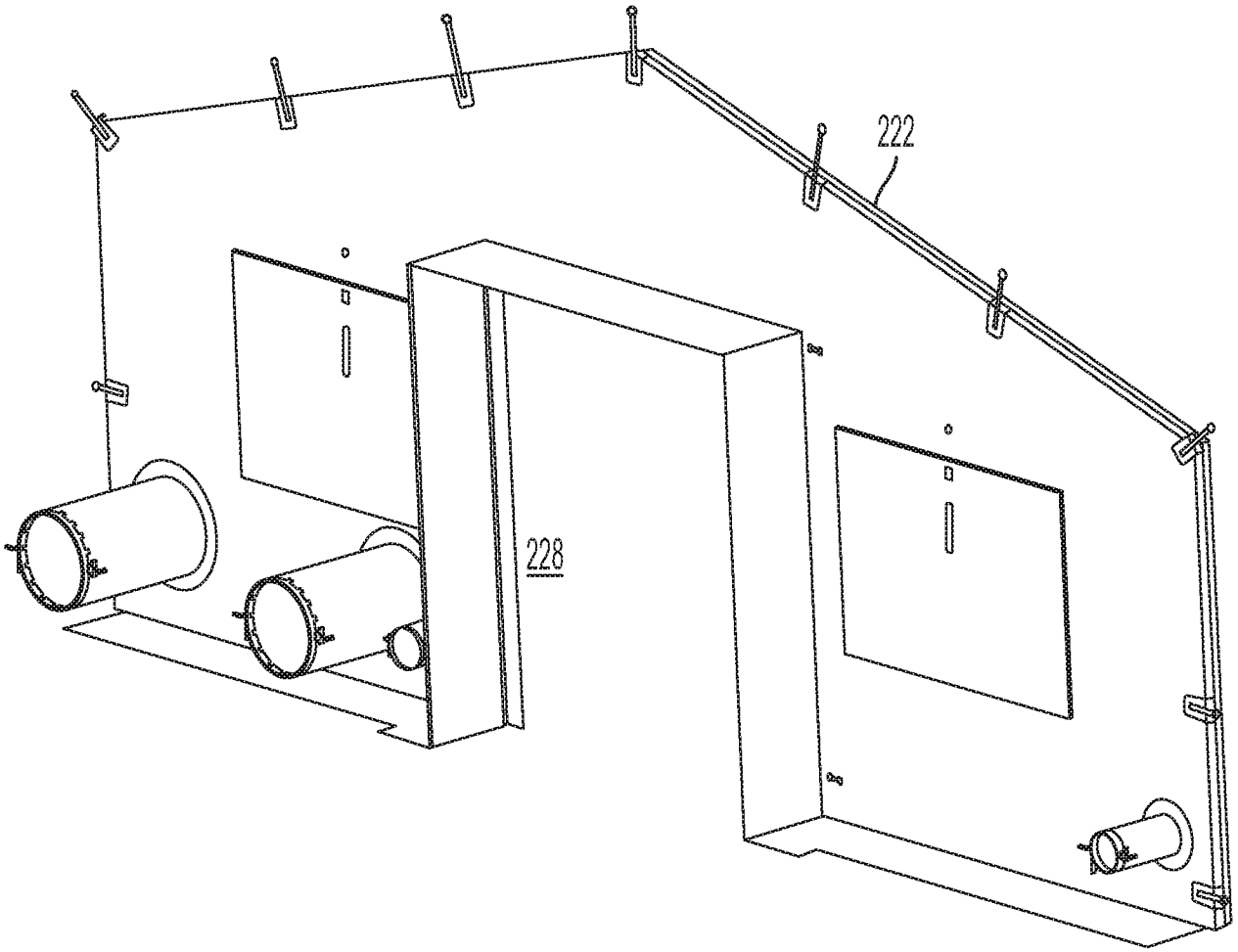
FIG. 37 is a detail perspective view of one endwall for the cover shown in FIG. 36.
Figure 38:
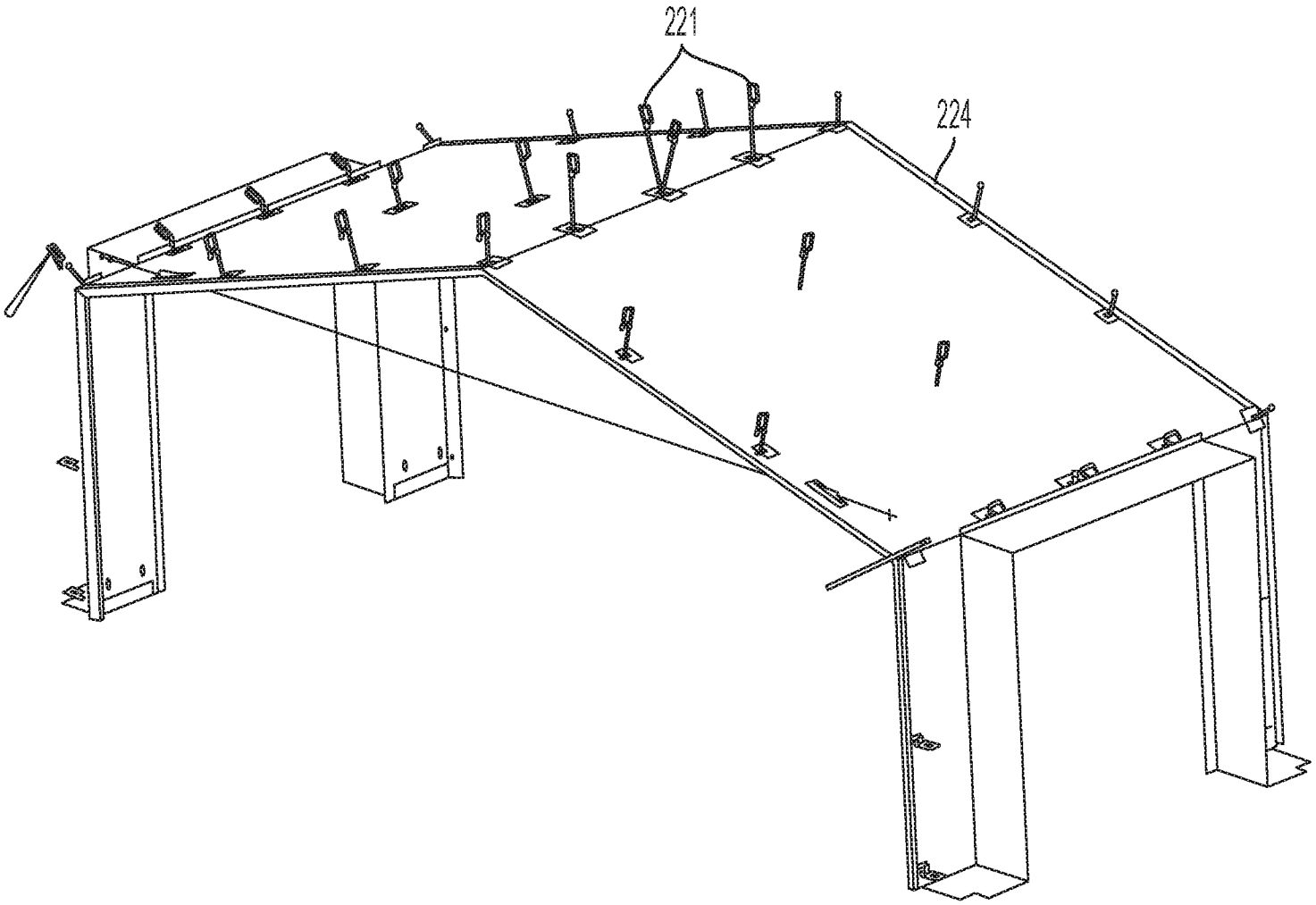
FIG. 38 is a detail perspective view of the barrel section for the cover shown in FIG. 36.
Figure 39:
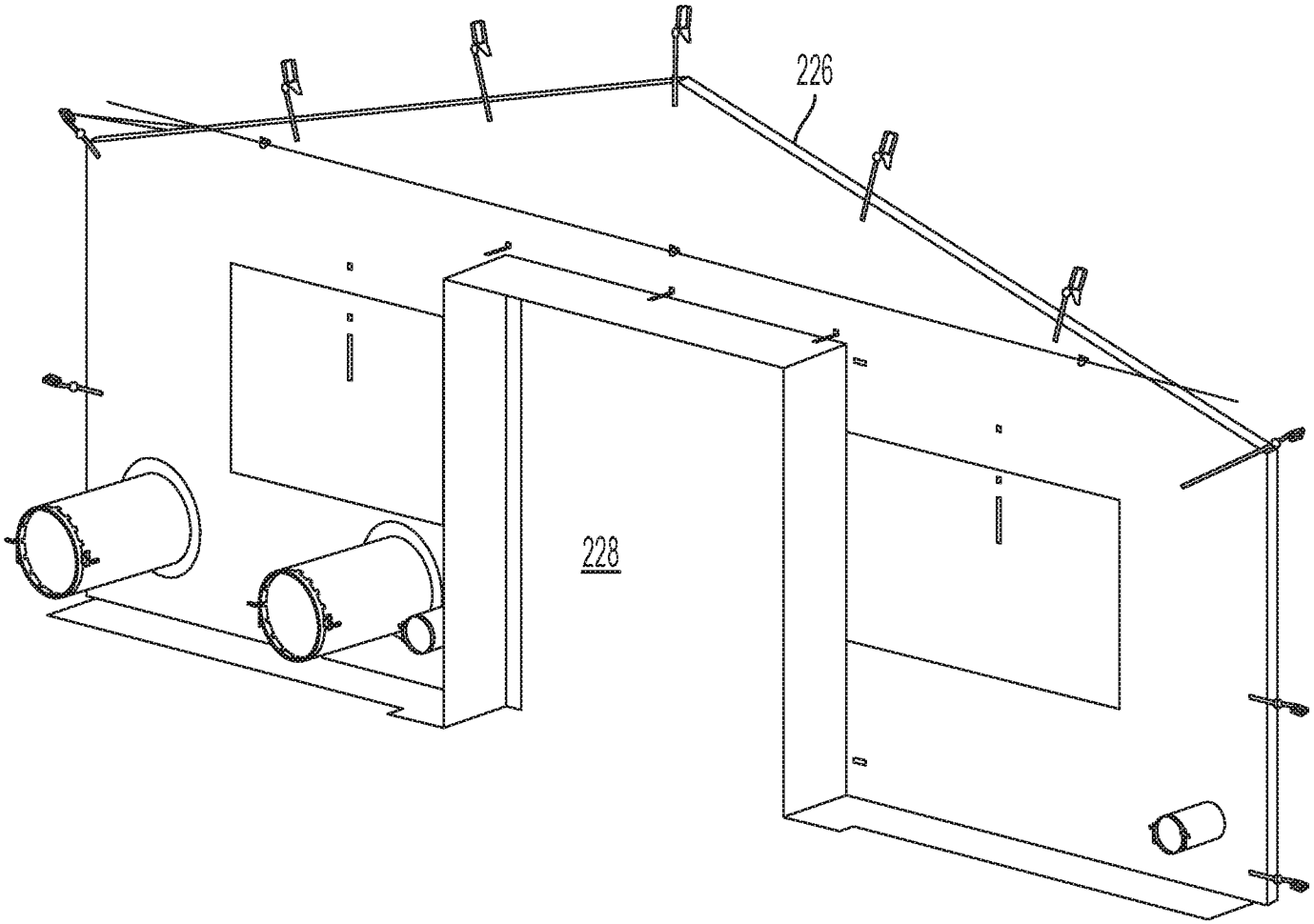
FIG. 39 is a detail perspective view of the second endwall for the cover shown in FIG. 36.
Figure 40:
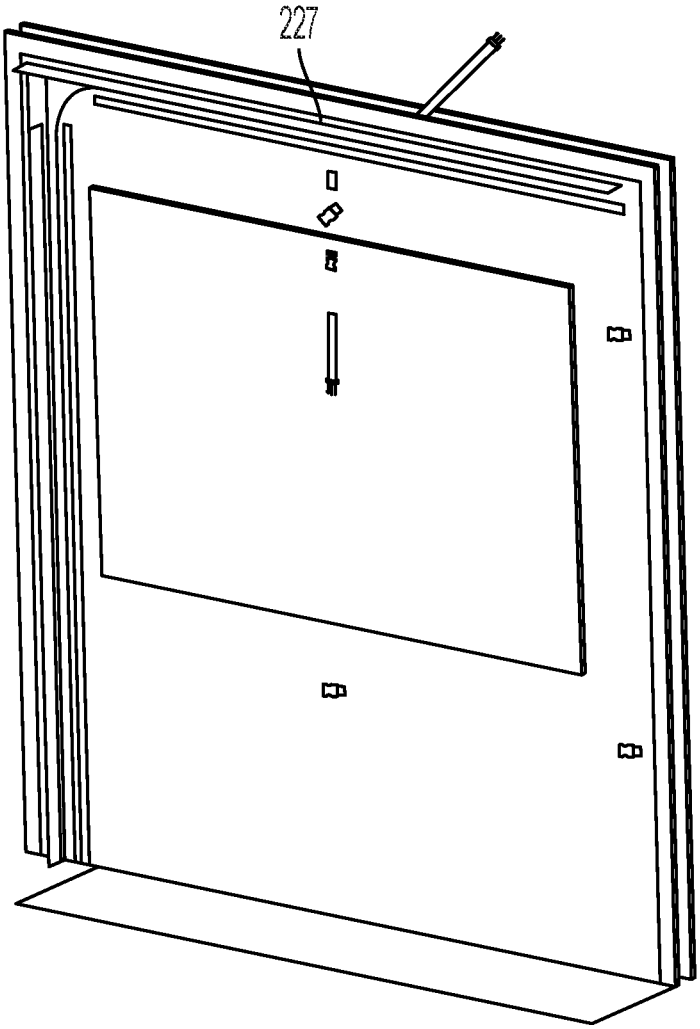
FIG. 40 is a detail perspective view of the exterior of a soft door assembly for the cover shown in FIG. 36.
Figure 41:
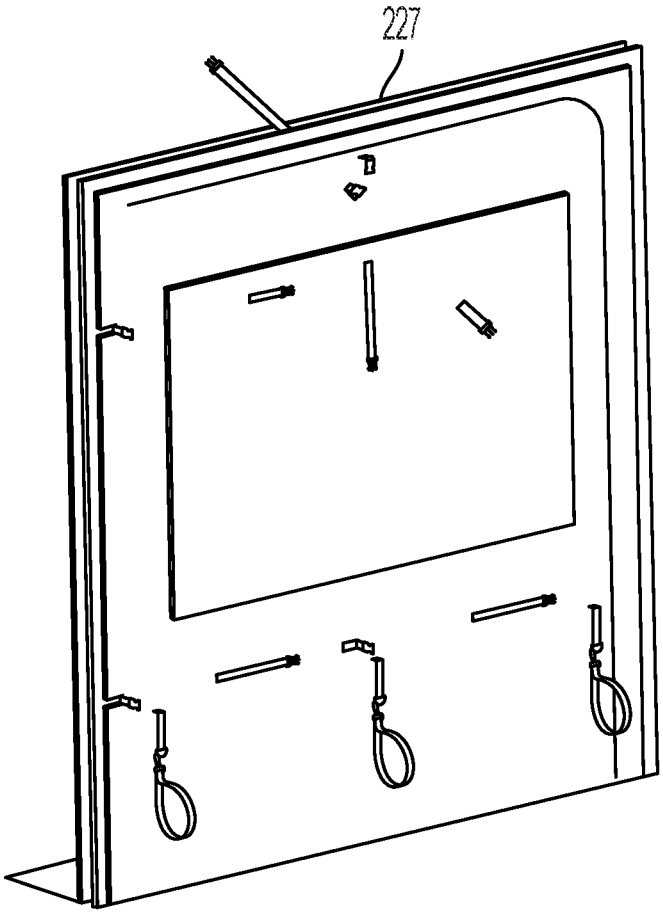
FIG. 41 is detail perspective view of the interior of the soft door assembly for the cover shown in FIG. 36.
Figure 42:
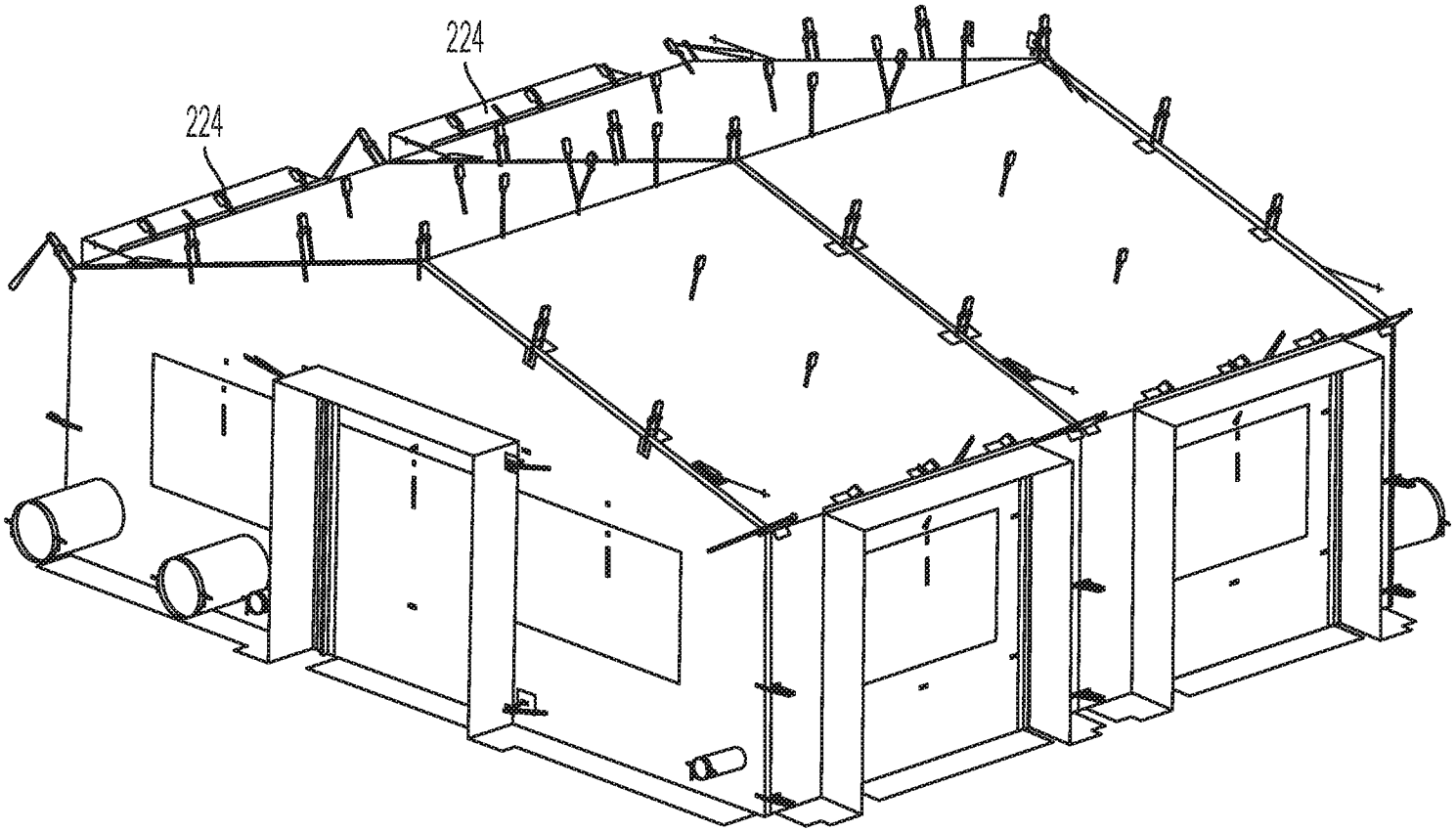
FIG. 42 is a perspective view of a completed cover for a two bay structure.
Figure 43:
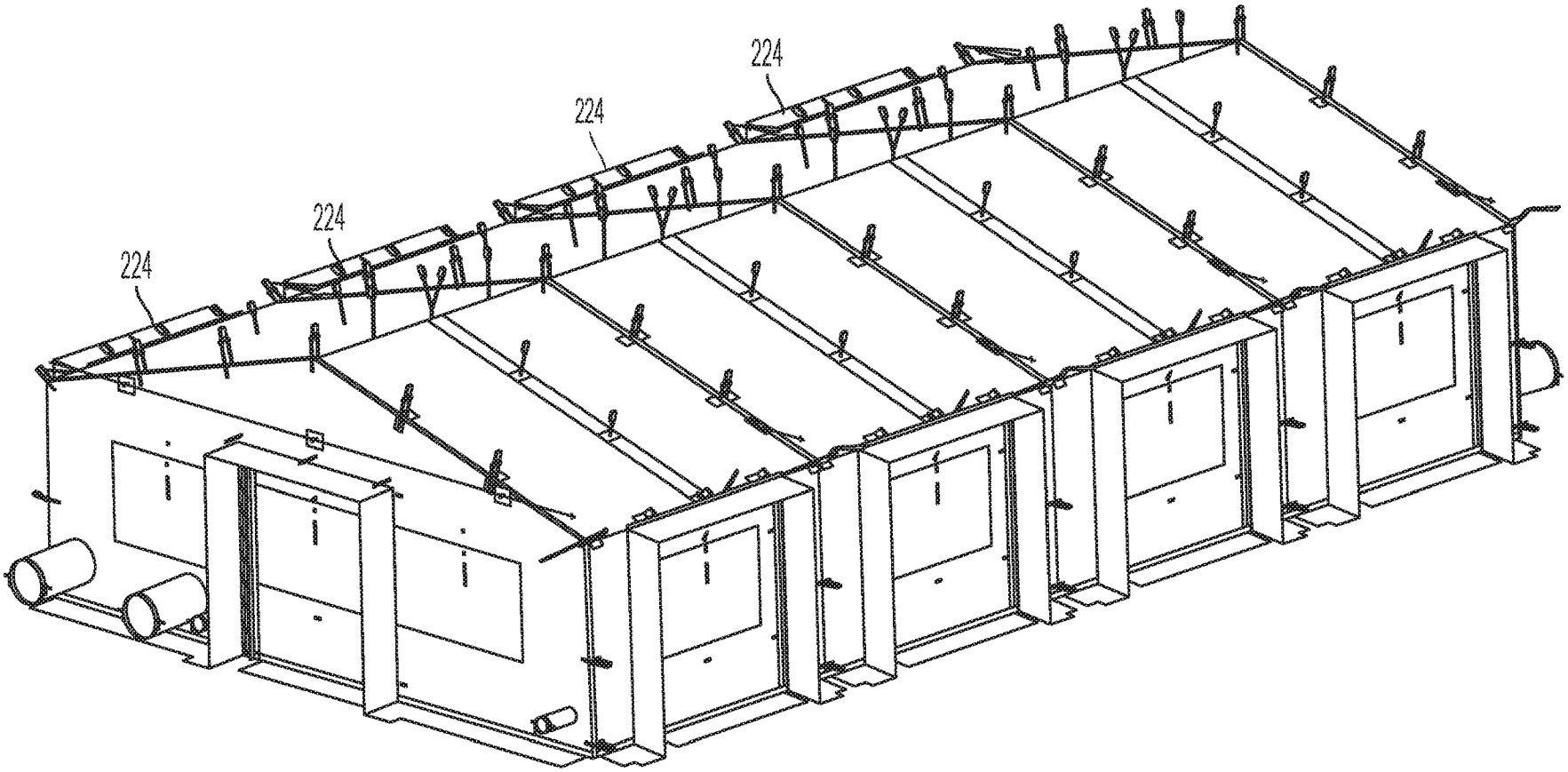
FIG. 43 is a perspective view of a completed cover for a four bay structure.

FIG. 36 illustrates a completed fabric cover 220 for the one bay structure whose frame 10 is shown in FIG. 1. It includes an endwall 222 shown in FIG. 37, a barrel section 224 shown in FIG. 38, and a second endwall 226 shown in FIG. 39. A soft door assembly 227 may be used for doors 228, whose exterior is shown in FIG. 40 and interior in FIG. 41. For the two bay structure shown in FIG. 42, two barrel sections 224 are used and four are used for the four bay structure shown in FIG. 43.

Figure 44:
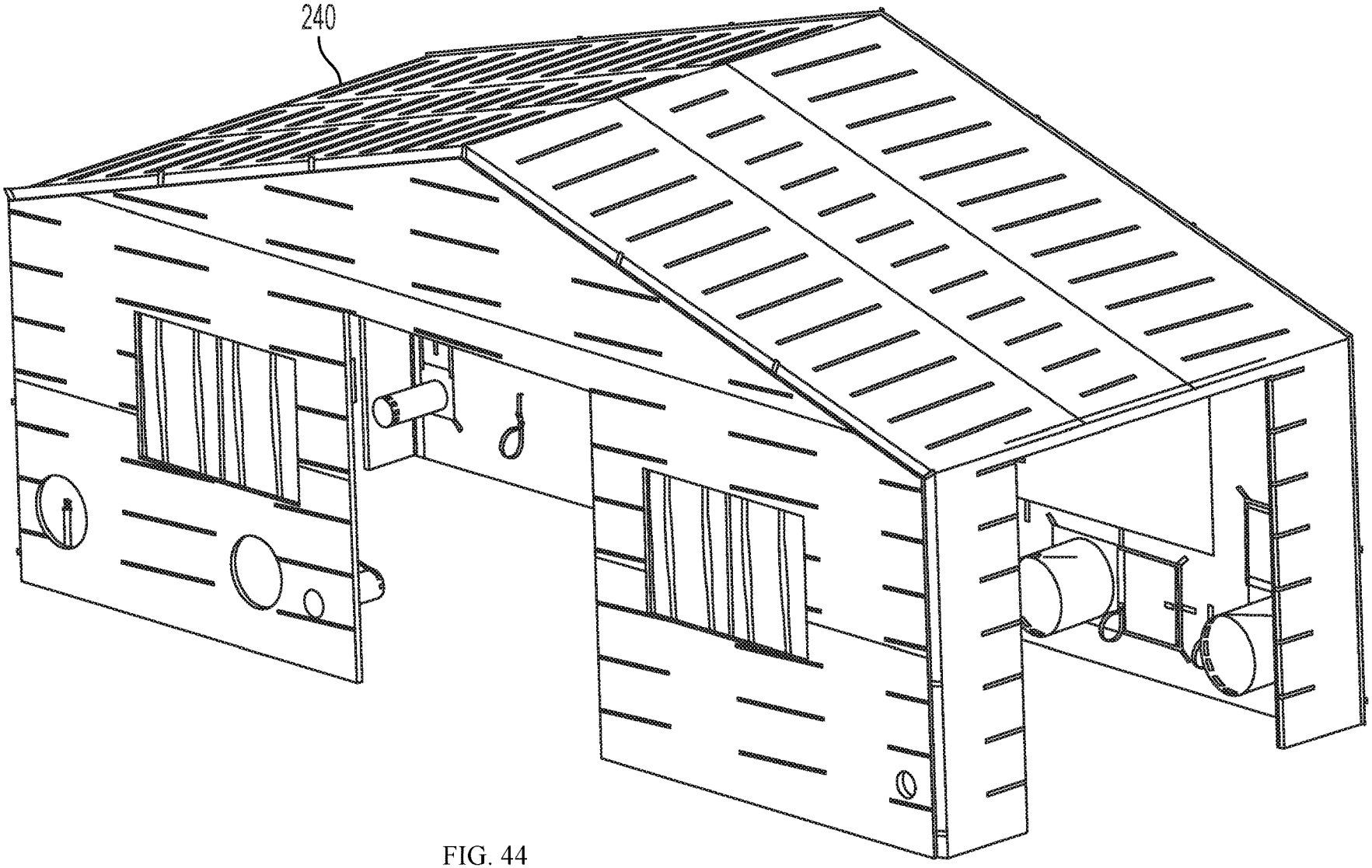
FIG. 44 is a perspective view of a removable insulation package for a single bay structure.
Figure 45:
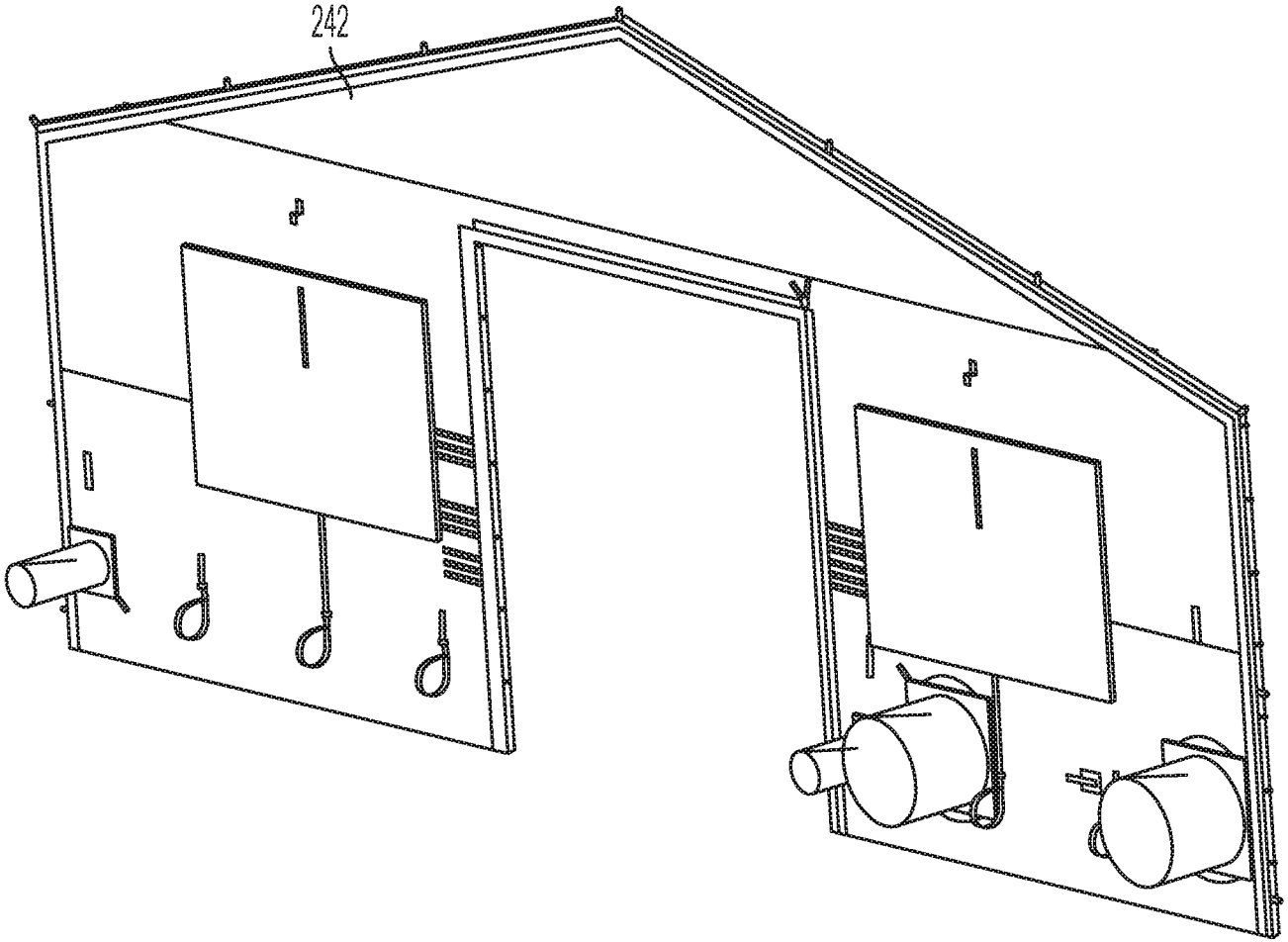
FIG. 45 is a perspective view of the endwall for the removable insulation package shown in FIG. 44, both endwalls being the same.
Figure 46:
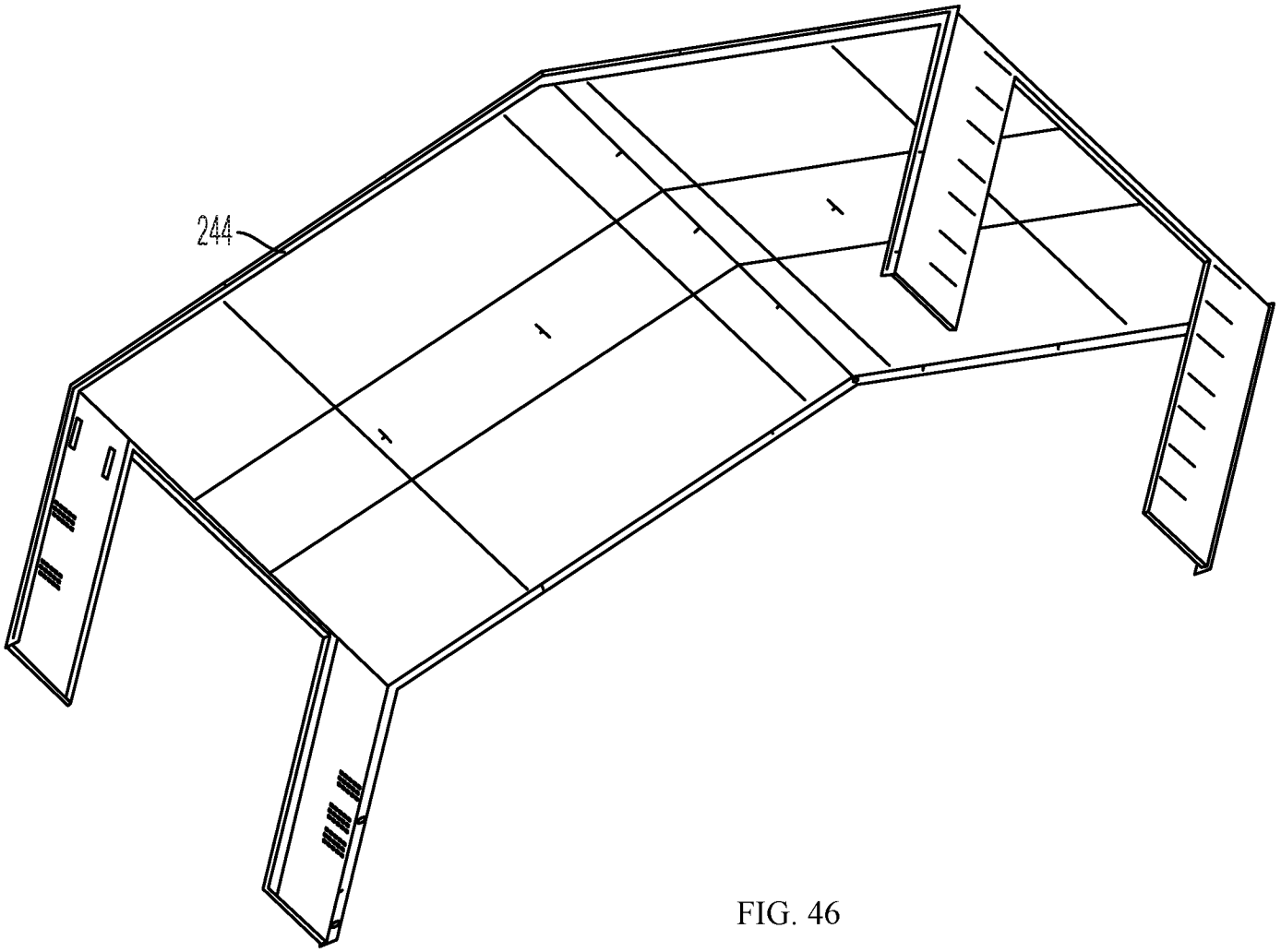
FIG. 46 is a perspective view of the barrel for the removable insulation package shown in FIG. 44.
Figure 47:
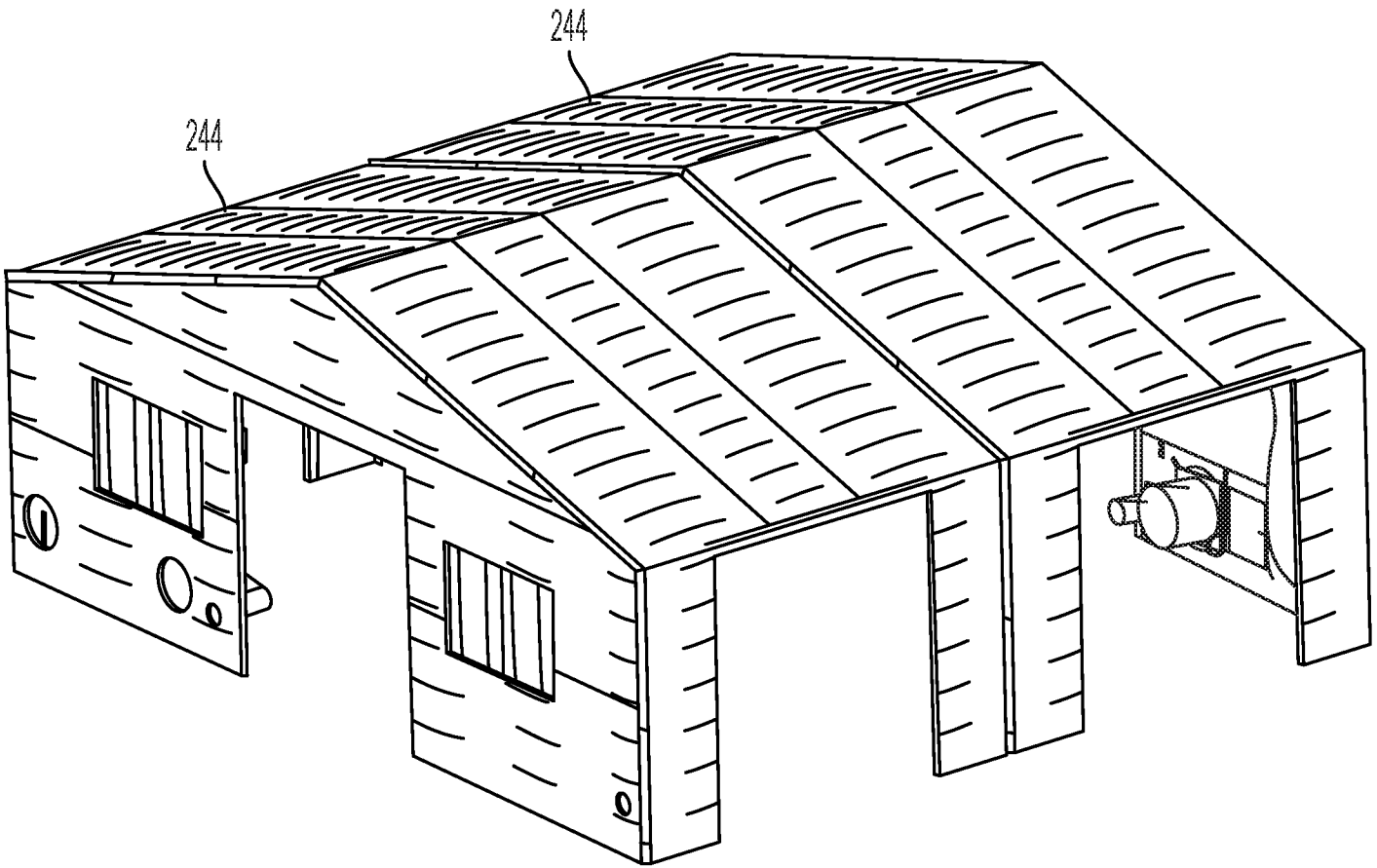
FIG. 47 is a perspective view of the removable insulation package for a two bay structure.
Figure 48:
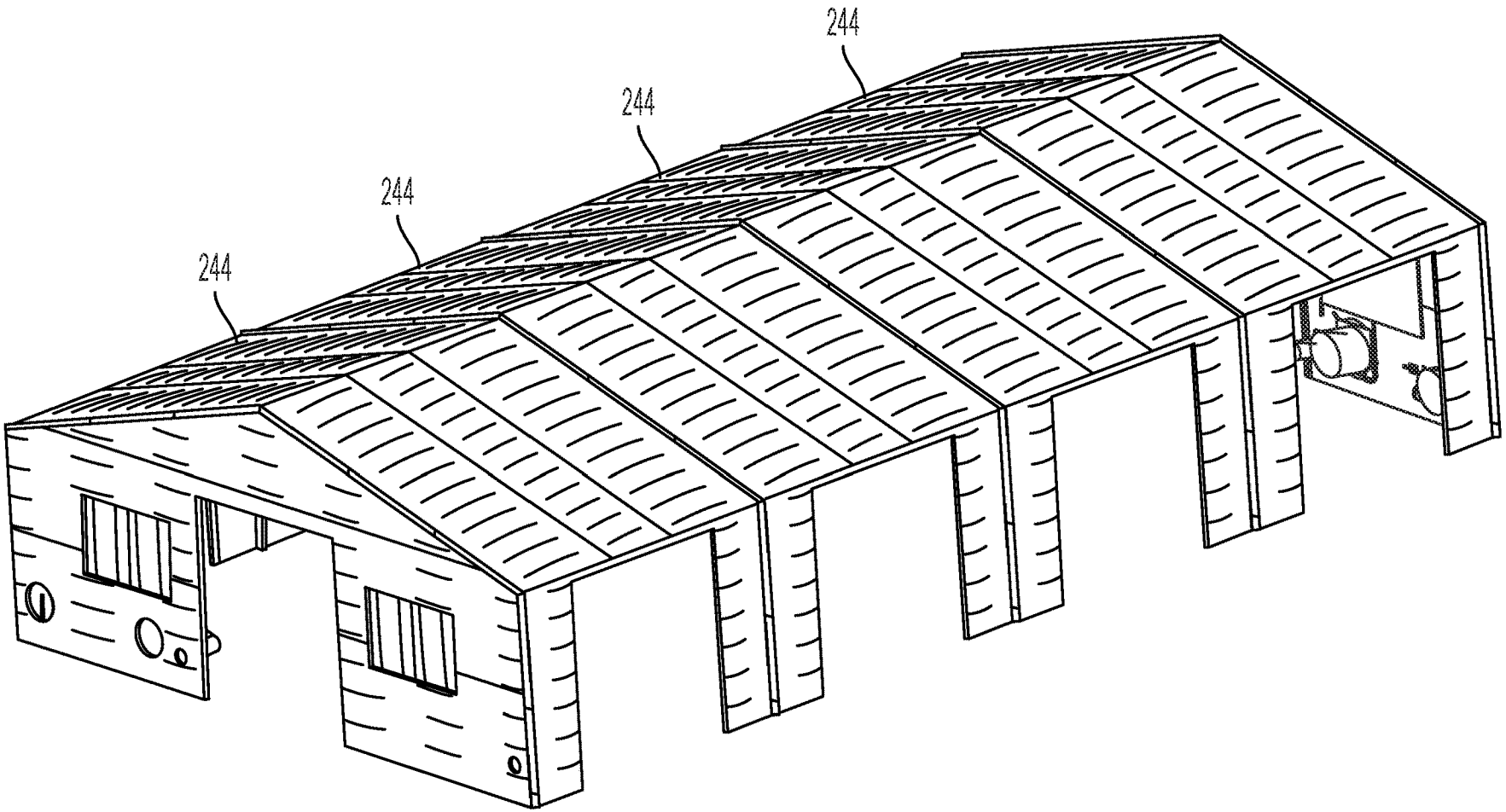
FIG. 48 is a perspective view of the removable insulation package for a four bay structure.

Insulation 240 can be added to the structure as shown in FIG. 44 for a single bay structure. It comprises two insulation endwalls 242 for the removable insulation package shown in FIG. 45, both endwalls being the same. The barrel 244 for the removable insulation package is shown in FIG. 46. Again for the two bay structure as shown in FIG. 47, two barrel sections 244 are used and four are used for the four bay structure shown in FIG. 48.

Figure 49:
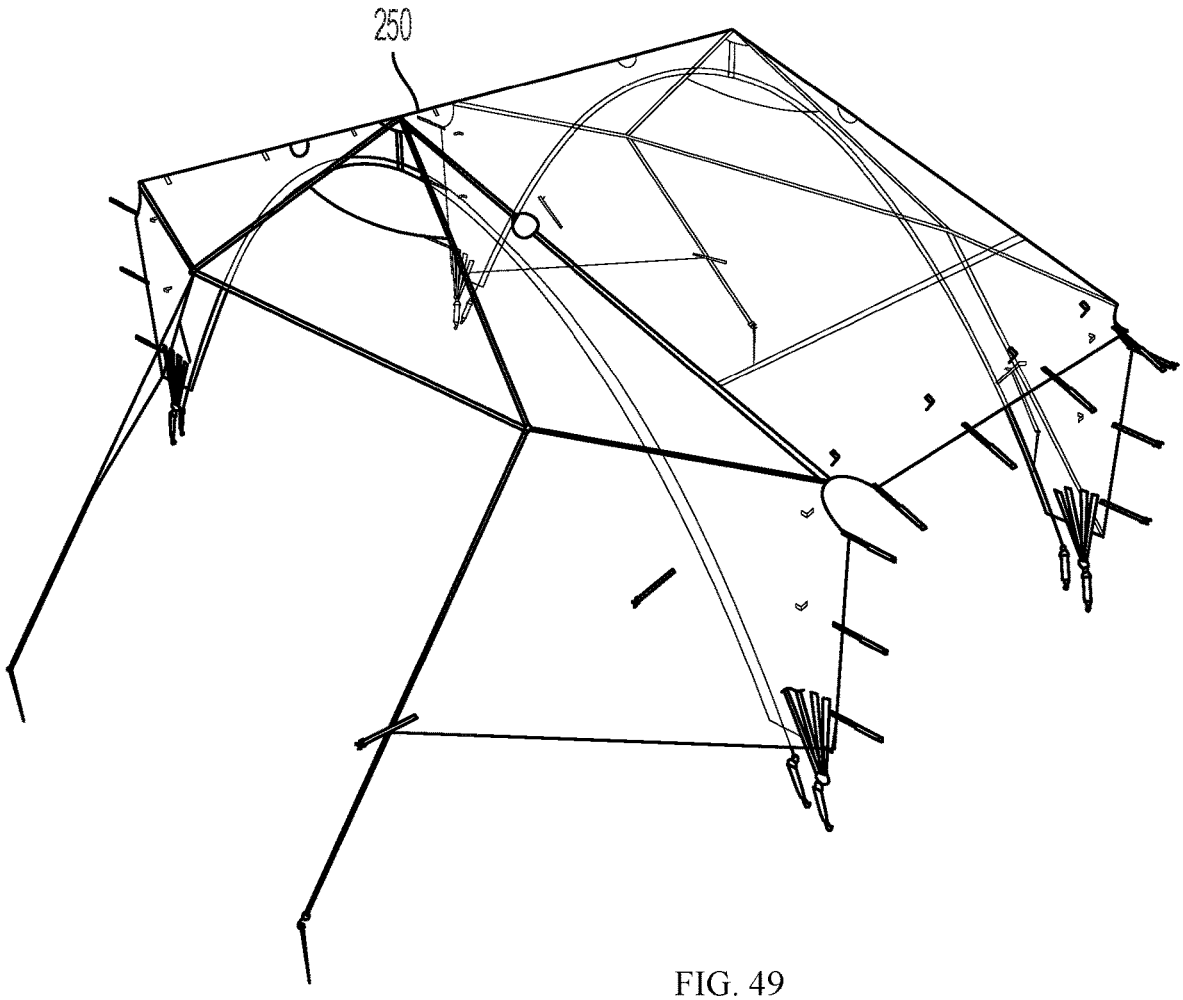
FIG. 49 is a perspective view of a solar shade for use with the shelter shown in FIG. 36.
Figure 50:
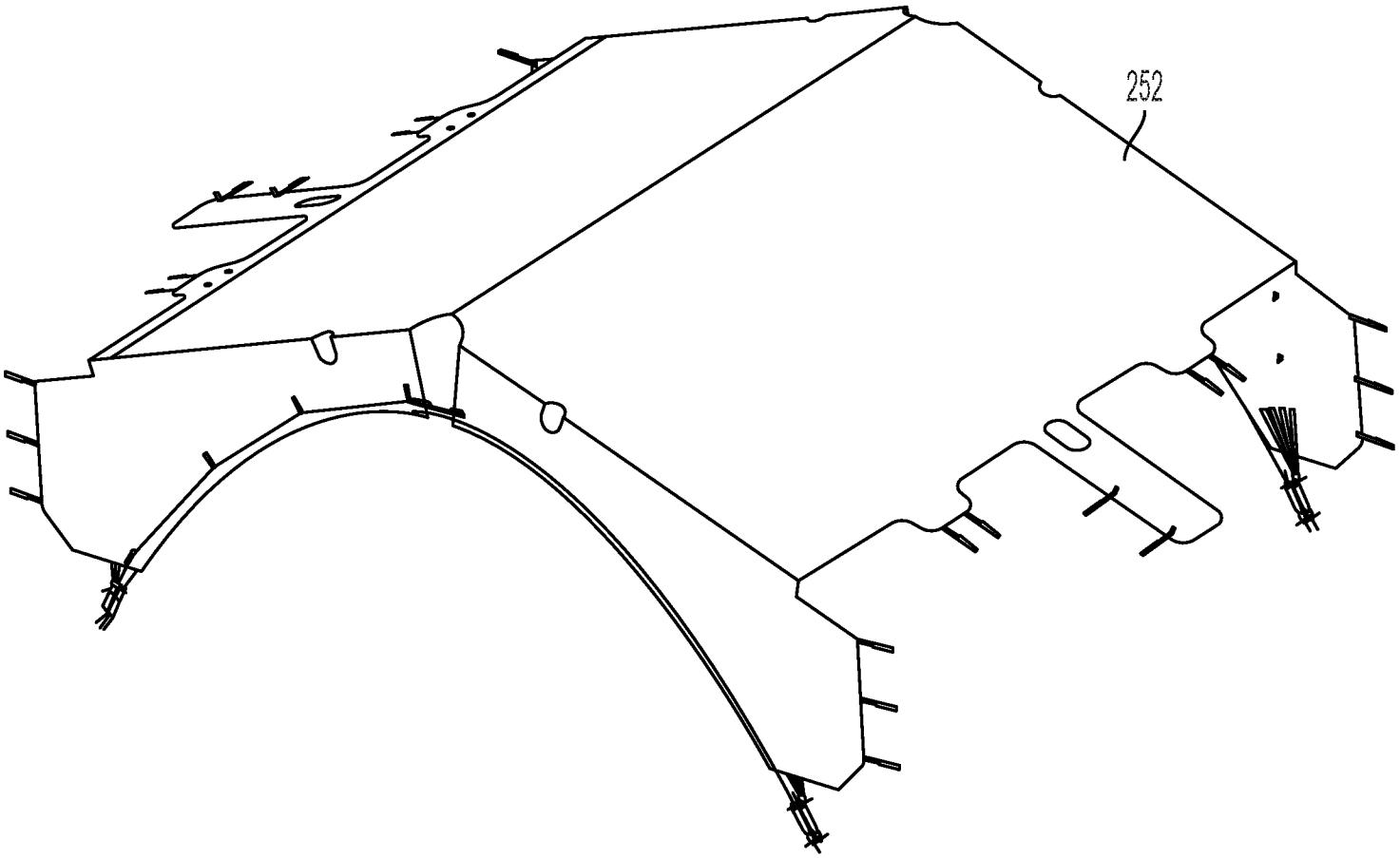
FIG. 50 is a perspective view of a winter fly for use with the shelter shown in FIG. 36.

FIG. 49 illustrates a solar shade 250 for use with the one bay shelter shown in FIG. 36, and FIG. 50 illustrates a winter fly 252 for use with the one-bay shelter. Both assemblies are tensioned just at the gable ends with a parabolically curved wire rope which is anchored to the feet on the corner legs. This wire rope acts similarly to the main support cable in a tension bridge, only inverted. This makes fitment and proper tensioning simpler.

The fabric cover 220 can be attached after the frame has been erected. Fabric cover 220 may be suspended from the frame elements using fasteners such as hooks or hook and loop fasteners 221 and in particular close haul j-hooks 29 at the eaves as previously noted above. Fabric dry bag style port closures are preferred. PALS (Pouch Attachment Ladder System)/Modular Lightweight Load-carrying Equipment i.e. PALS/MOLLE webbing attachment patches as universal hardware mounts may be incorporated. Universal webbing strip/patches may be sewn into the ceiling for attaching accessories such as air distribution ducts, lights, room dividers, etc. Glow in the dark, reversible, fabric exit signs may be used. Double layered windows allow visibility without losing insulating air gap between cover and insulation layer.

FIG. 51 through 63 illustrate a further variation of a tent-based shelter system using rapidly deployable frame elements. In this embodiment the leg elements are modified to facilitate set-up of the shelter particularly in high winds. The leg elements comprise sliding rather than folding elements. The main body of the leg is always the full length and the portion of the leg to which the roof frame attaches to is able to slide up and down the main leg body. In this way the roof section and attached tent fabric can be assembled at the ground level and attached to the slidable leg section in lowered position with the main leg sections secured to the ground at their base. The roof and tent assembly can then be raised by sliding the slidable leg section up the main leg section. This facilitates assembling the tent, particularly in high winds. Also in this variation midspan chords are replaced in the roof frame by removable purlins which run in the opposite direction to the midspan chords previously disclosed.

Figure 51:
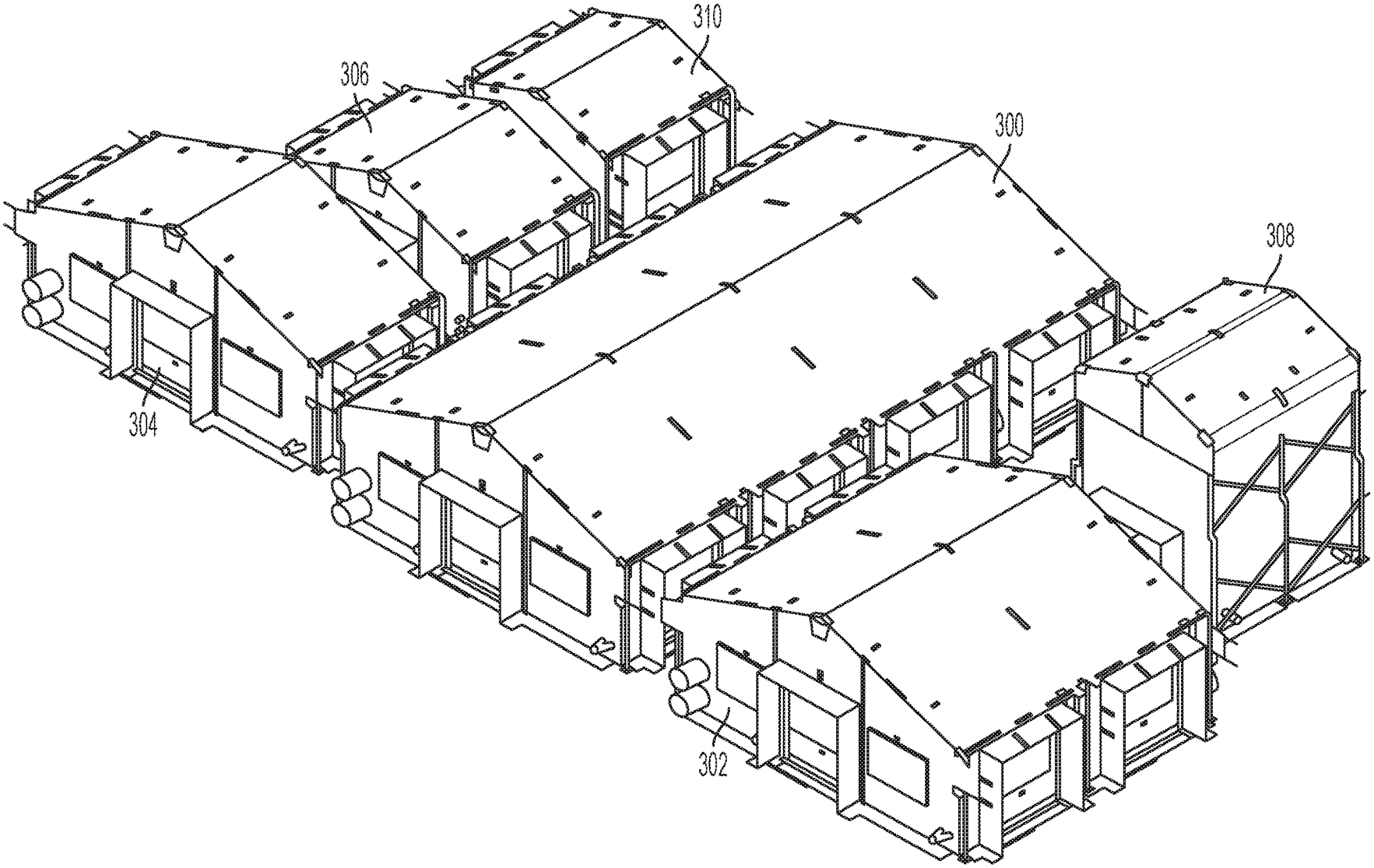
FIG. 51 is a perspective view of a further embodiment of a tent-based shelter system designed for rapid erection and mobility to perform under adverse environmental conditions.

With reference to FIG. 51, as in the previous embodiment there is disclosed a tent-based shelter system designed for rapid erection and mobility to perform under adverse environmental conditions. The system can be configured for example as a deployable command post, accommodation, medical facility or as operations and command centres for disaster relief, for example. For handling and stowage, the shelter system breaks down into various packed bags that are small and light enough for users to carry and pack.

Figure 52:
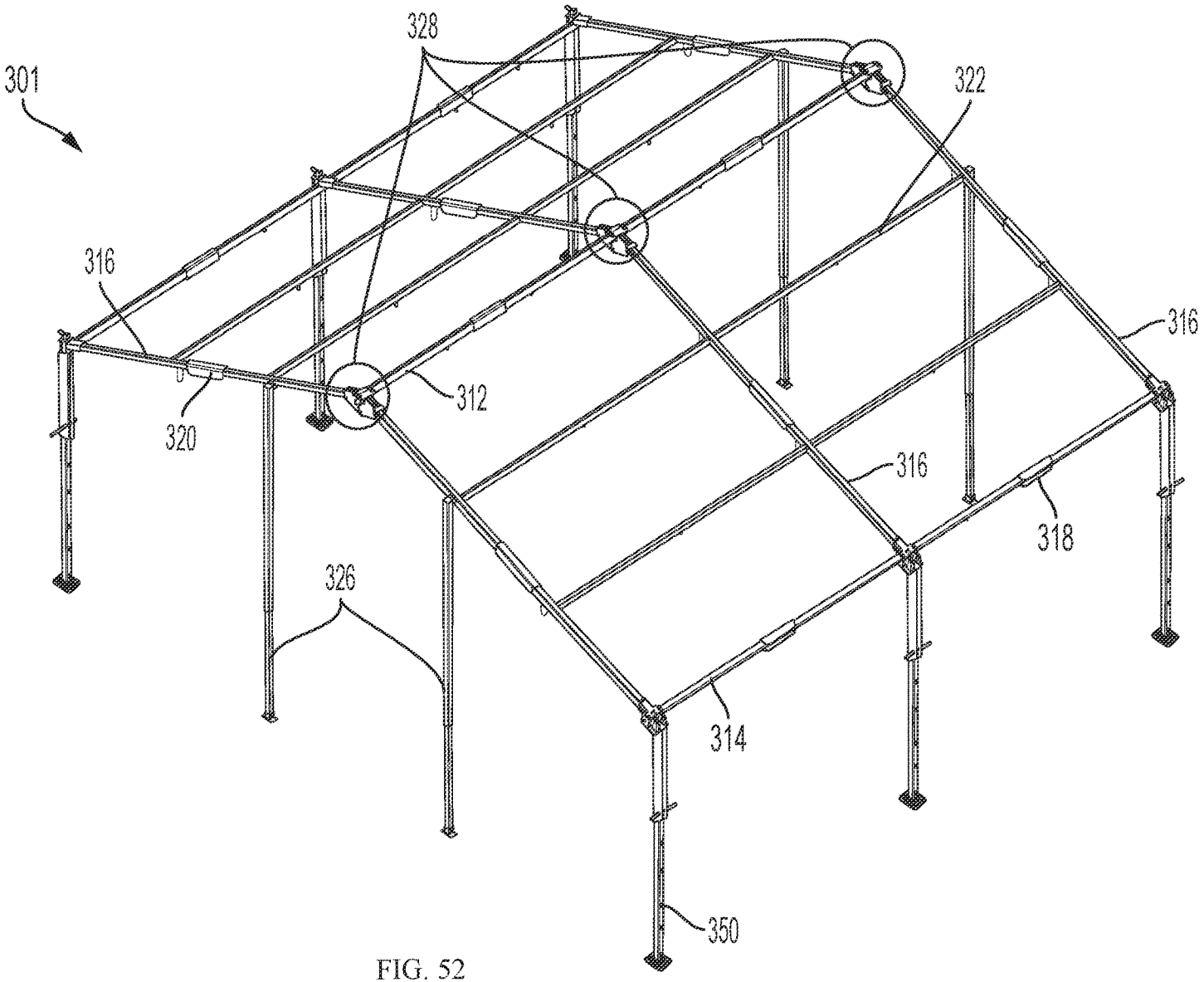
FIG. 52 is a perspective view of a 2-module frame used in the tent-based shelter system as shown in FIG. 51.

The different shelter modules provided in the system, using common components, are shown in FIG. 51 in a standard configuration, however the particular arrangement may be changed to suit the particular requirements of the deployment. The system includes the following shelter modules: 4-module shelter 300; 2-module shelter 302; 1-module shelter 304; 4-Door Hub 306 for shelter interconnection; Vehicle Interface shelter 308; and entrance Vestibule 310. As in the previous embodiment, the shelter system is a self-standing, external-frame all-weather tent system. The tent frame is the structural component of the shelter and is external to the tent, with the tent body suspended under the frame. This external frame design provides significant advantage for deployment and tear-down timing. The frame for the various modules is designed with a minimum number of unique parts. The 2-module frame 301 is shown in FIG. 52 as exemplary, however the assembly concept is the same for all of the frames. The primary difference between the various frames is the number of arch sections and legs used to accommodate the length of the shelter. The illustrated 2-module shelter frame 301 shows the three-arch folding frame 301 supported on six telescoping legs 350 and four end stanchions 326. The folding frame includes the arches 316, ridge beams 312, and eave beams 314. Each arch and beam section is hinged to allow folding for stowage. The frame 301 is preferably constructed of powder coated aluminum for reduced weight and corrosion protection.

The basic frame assembly 301 in this embodiment consists of folding beams (horizontal elements that form the ridge beam 312 and eave beams 314), and folding arches 316 (sloping beams that join the ridge and eave beams 312, 314). Each beam and arch has a latched hinge 318, 320 at its mid-point allowing the entire assembly to fold to minimize its size for transportation and storage as shown in Frig. 62A. Arches 316 are hingedly connected to ridge beam 312 at peak brackets 328. Once the main frame is unfolded during deployment, separate removable purlins 322 are secured between the arches 316 to provide additional rigidity to the frame and support points for the roof fabric. The beam and arch latched hinges 318, 320 comprise automatic spring-loaded latches which automatically lock into place during erection. These are constructed as disclosed in the previous embodiment. The arch latches have a 'free' position during teardown, which resets itself into a primed position for subsequent deployment when the frame is fully collapsed. See FIG. 9-13. The beam latches must be held open while they are initially folded. See FIG. 25, 26.

The frame 310 is supported on legs 350 that attach by inserting them into brackets 368 (FIG. 60) at the junction of each arch and eave beam 316, 314. Separate endwall stanchions 326 attach to each end of the shelter to provide additional support for the end walls. The modular purlins 322 are beam elements installed between the arches 316, parallel with the eave and ridge beams 312, 314. The purlins 322 provide frame rigidity and support for the tent fabric.

Endwall stanchions 326 at the end walls provide additional support for the tent fabric and hard door if installed.

Figure 53:
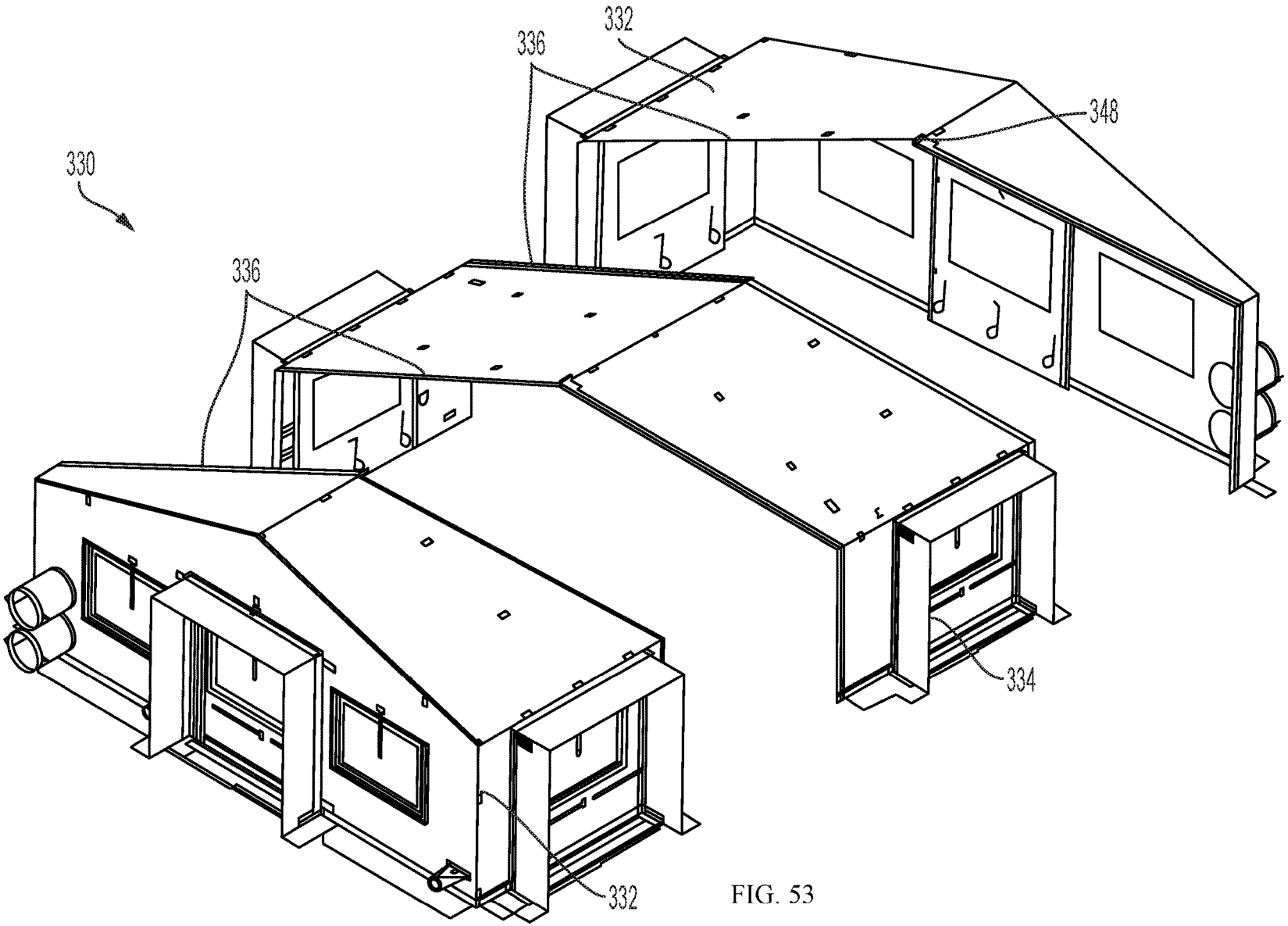
FIG. 53 is a perspective view of the tent body for the 2-module frame used in the tent-based shelter system as shown in FIG. 51 with sections separated.

The tent body 330 as shown for the 2-module shelter in FIG. 53 is preferably made of military-grade fabric and integrates wall and roof sections. The 1-module, 2-module, and 4-module shelters use multi-part fabric bodies as shown in FIG. 53. The multi-part bodies are composed of endwall sections 332 and barrel sections 334 where required to add length. The 1-module shelter uses two endwall sections 332 directly joined together. The 2-module shelter uses one barrel section 334 between the endwall sections 332 to provide the required length (as illustrated) and the 4-module shelter uses three barrel sections 334. The endwall and barrel sections are joined using heavy-duty zippers 336 which start at the roof peak 338. The section roof panel edges are diagonal in order to facilitate a modular design with identical endwall and barrel sections 332, 334. The connecting edges of each endwall and barrel are identical so that they may be joined in any sequence—there is no front or back orientation. This design simplifies deployment compared to other systems that have directional connections and must be oriented in a specific way in order to assemble.

Figure 54:
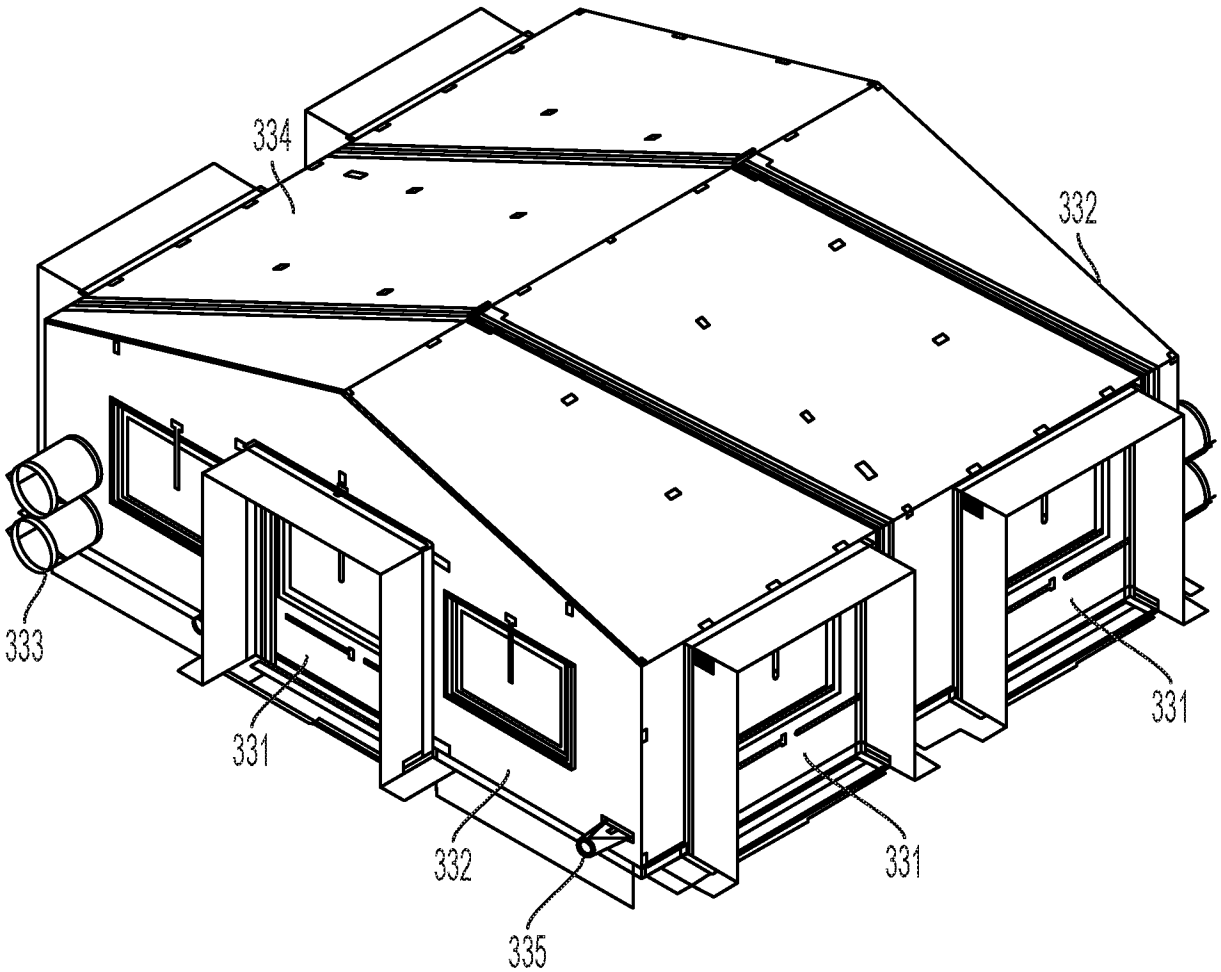
FIG. 54 is a perspective view of the assembled tent body for the 2-module frame used in the tent-based shelter system as shown in FIG. 51.
Figure 55:
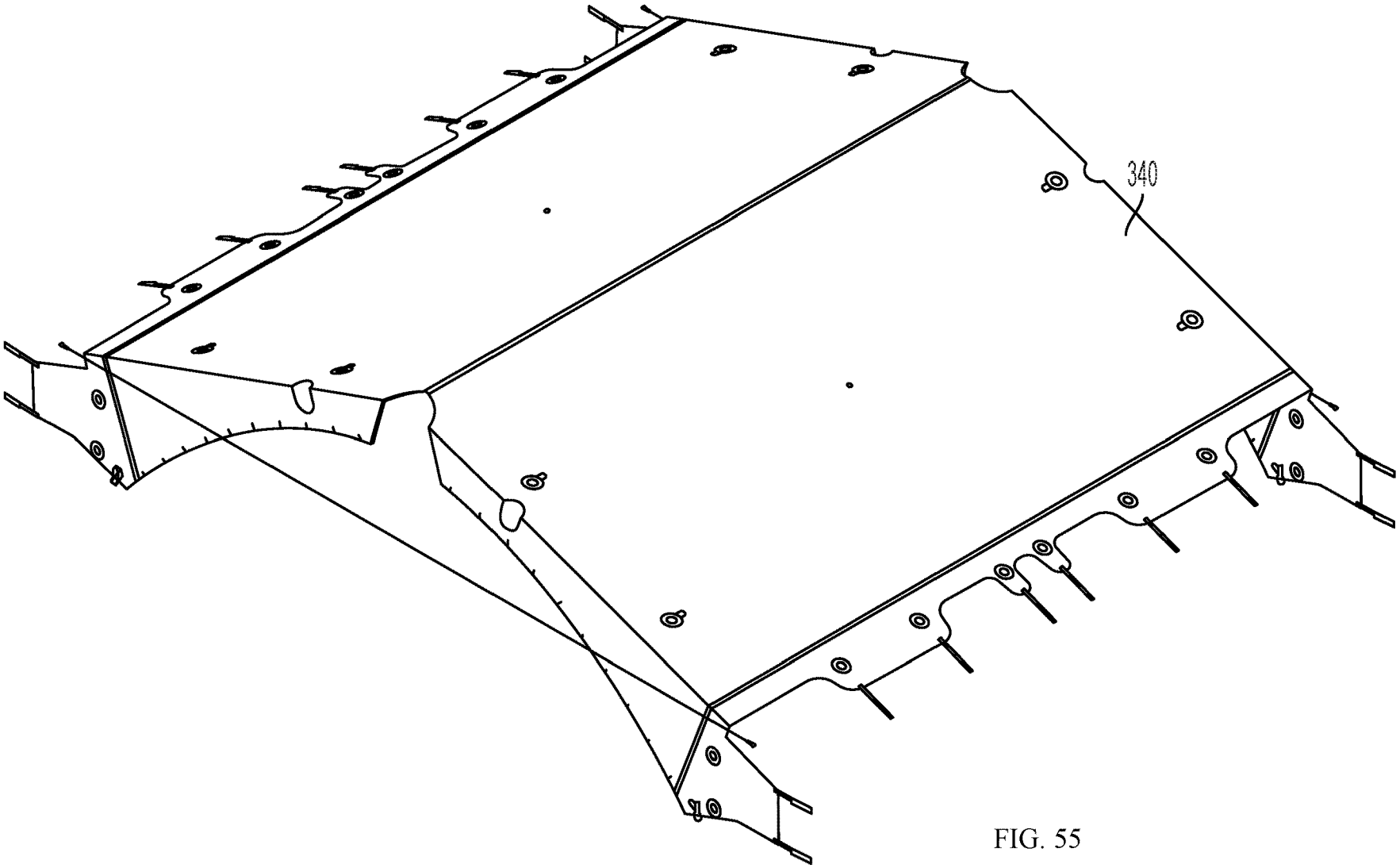
FIG. 55 is a perspective view of a shelter fly for the 2-module shelter as shown in FIG. 51.

FIG. 54 illustrates the assembled 2-module shelter 330 using one barrel section 334 between the endwall sections 332. The endwall sections 332 preferably have two soft doors 331, one on the end face and one on the sidewall section, each with a window panel and a window opening on each side of the door. The soft doors may be replaced with hard doors if required. The endwall sections 332 may incorporate two large sleeves 333 to accommodate external heating or air conditioning ducts. Two small sleeves 335 may also be incorporated to pass power and communication cables in and out of the shelter. Each barrel section 334 preferably also has two soft doors 331 which can remain sealed, used as windows, or as connections to other modules in the complex. An example of a shelter fly for the 2-module shelter is shown as 340 in FIG. 55.

Figure 56:
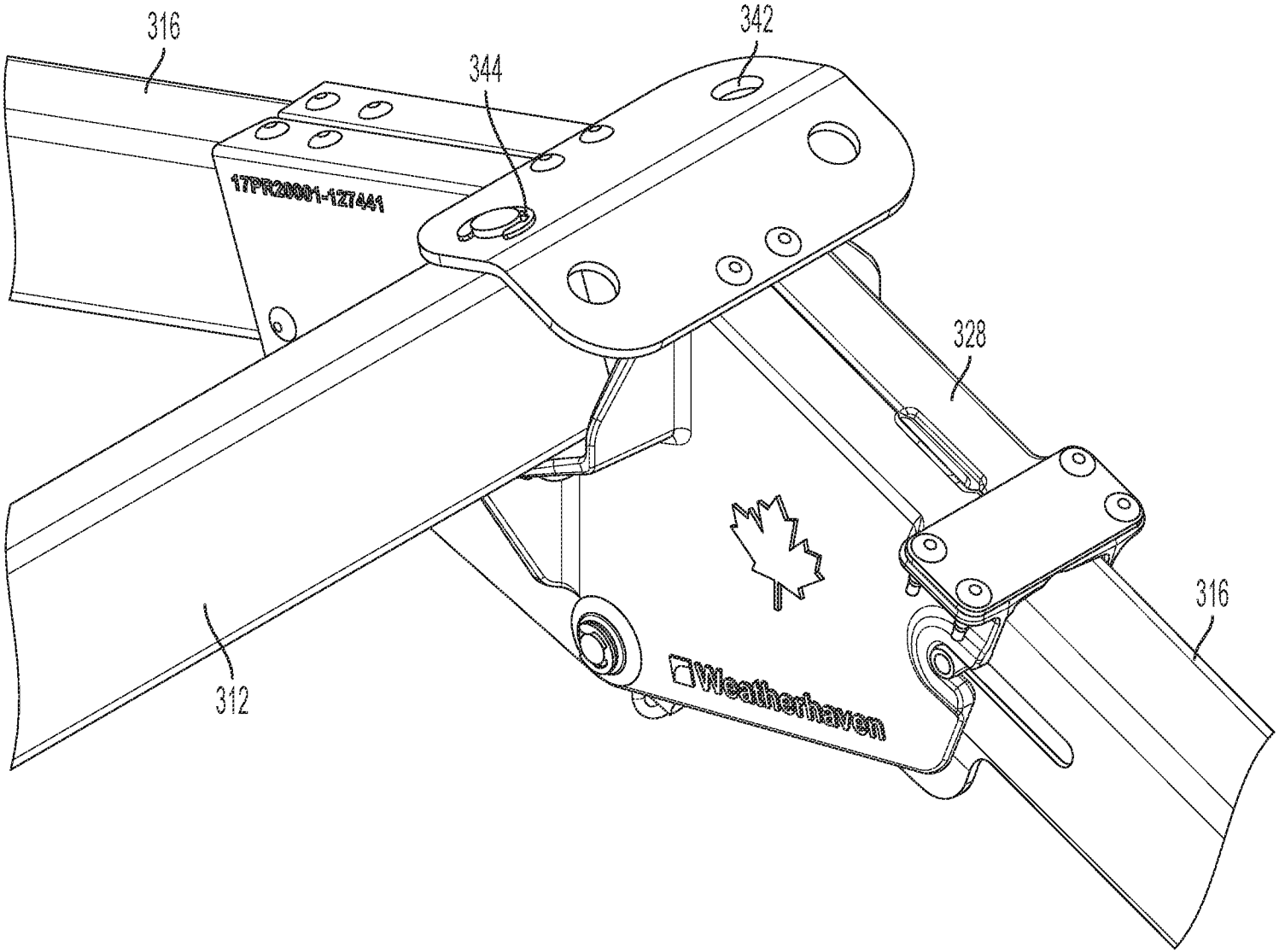
FIG. 56 is a detail perspective view of the peak bracket.
Figure 57:
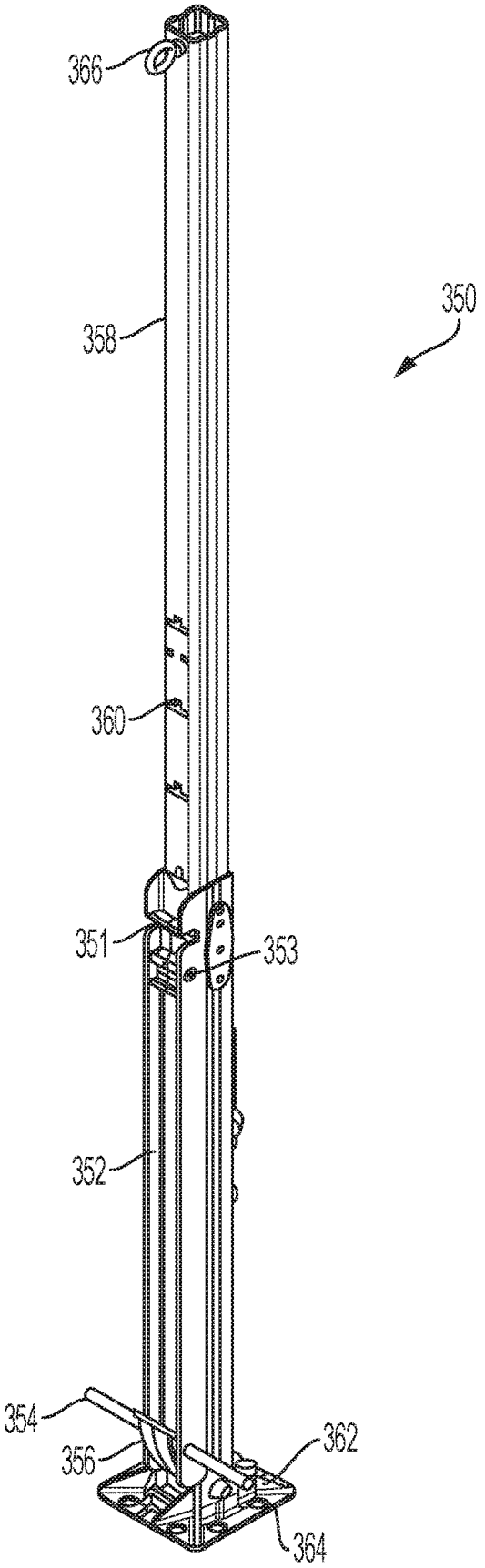
FIG. 57 is a perspective view of the leg element 350 in lowered position.
Figure 58:
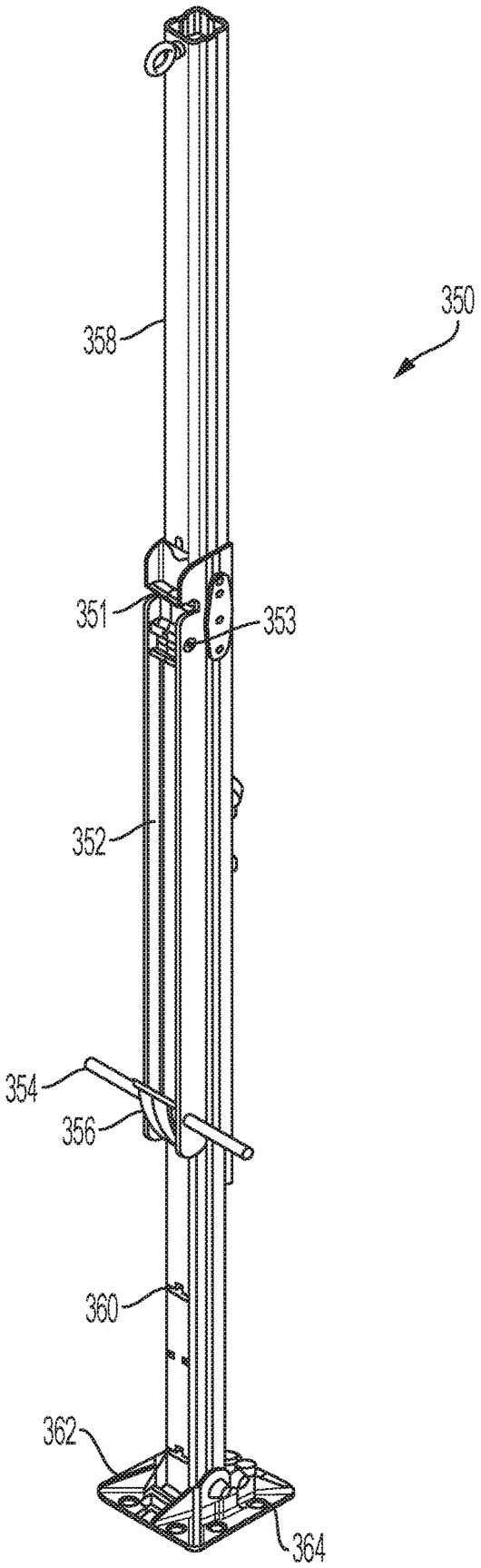
FIG. 58 is a perspective view of the leg element 350 in semi-raised position.
Figure 59:
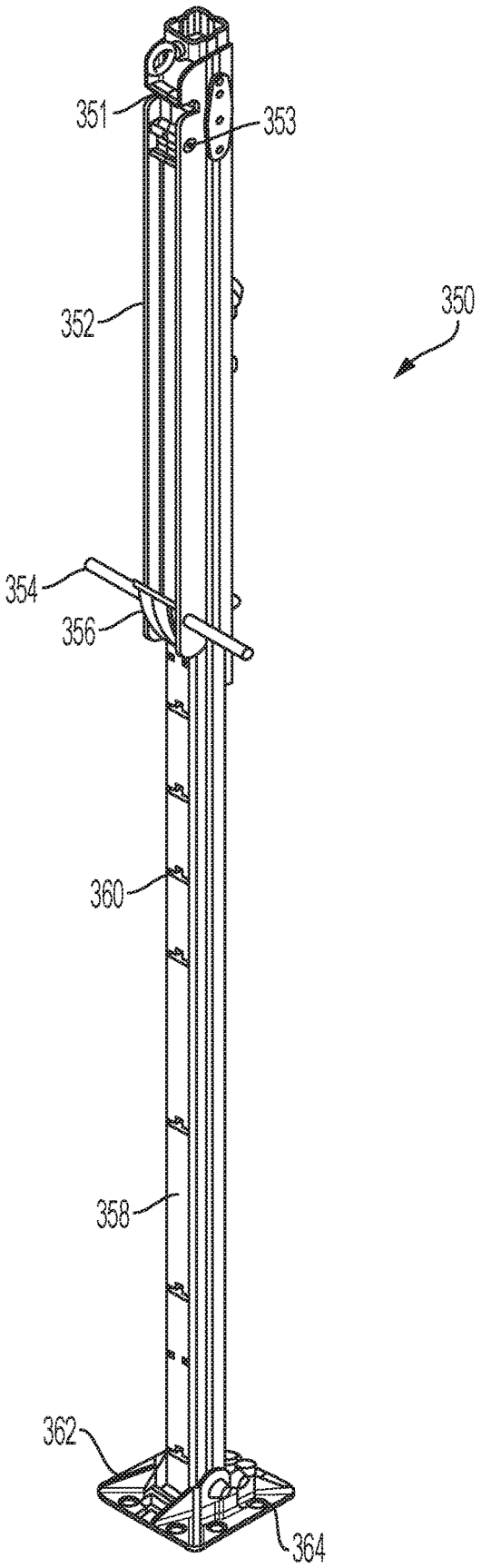
FIG. 59 is a perspective view of the leg element 350 in fully-raised position.
Figure 60:
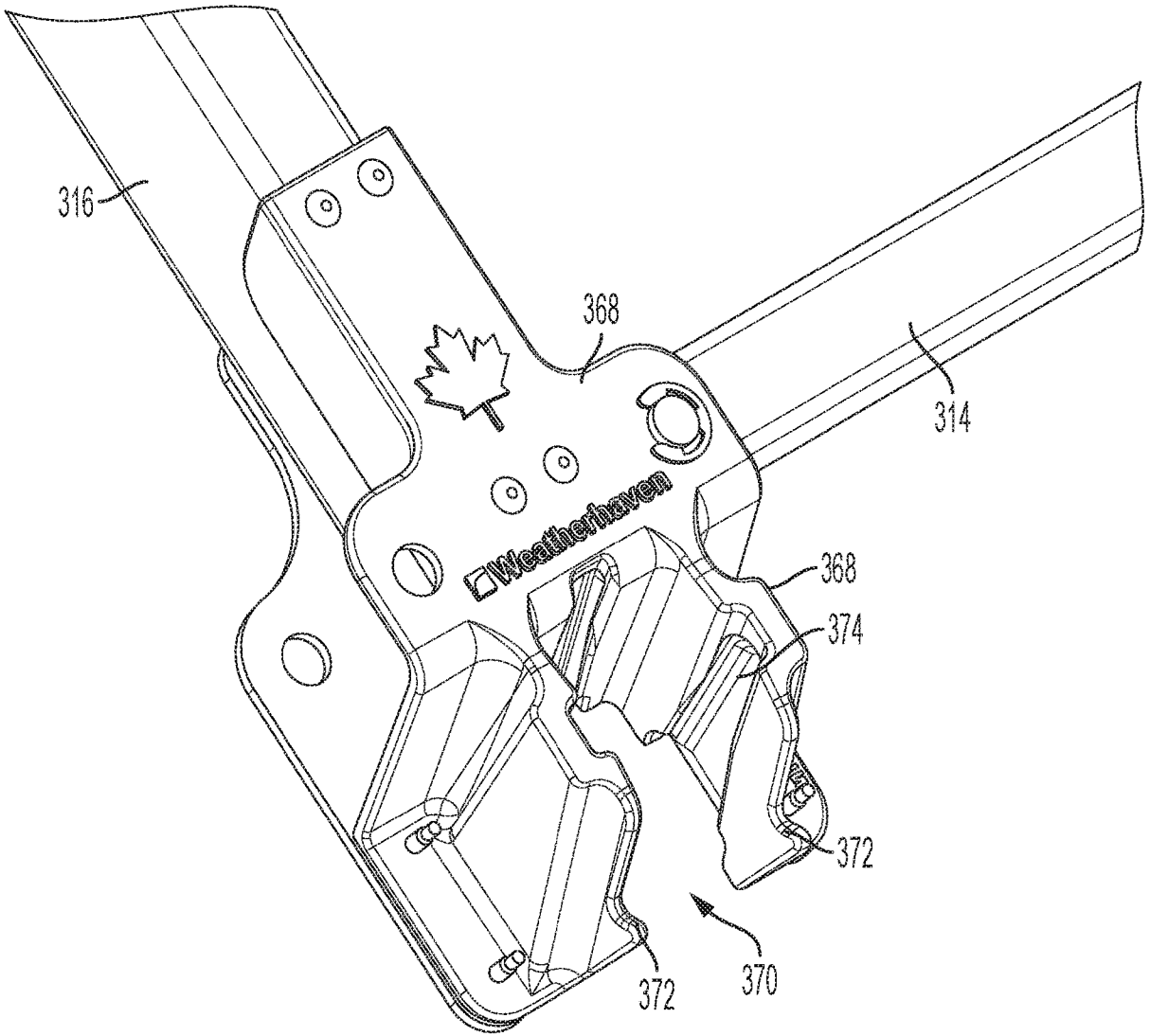
FIG. 60 is a detail perspective view of a frame leg socket at the end of an arch.
Figure 61:
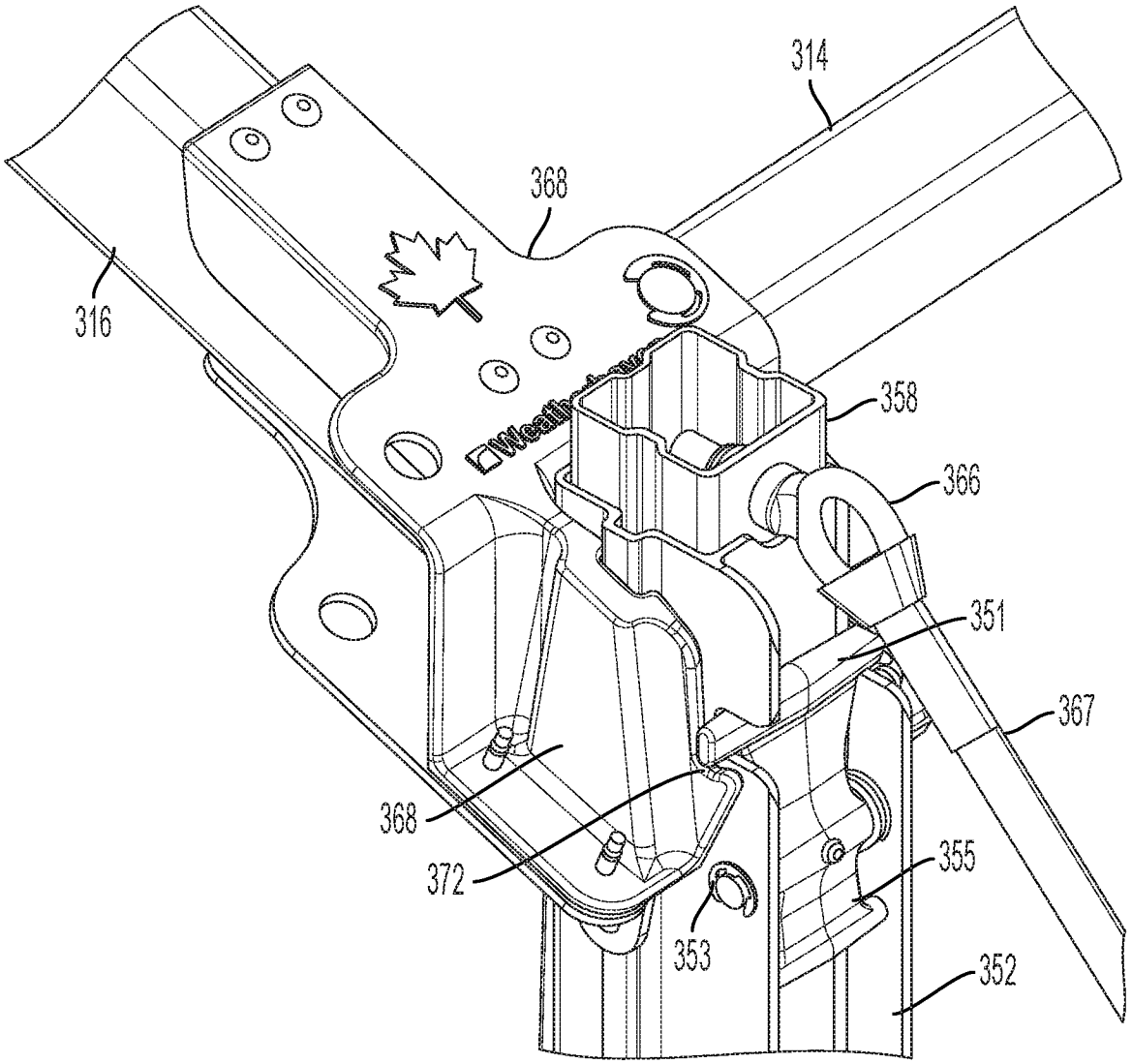
FIG. 61 is a detail perspective view of the frame leg socket shown in FIG. 60 with a leg element in place.

A detail perspective view of the peak bracket 328 is shown in FIG. 56. It receives the ends of ridge beams 312, of the 2-module shelter frame as shown or potentially of the extension frame for a 4-module shelter frame, and is provided with apertures 342 to accept ridge beams 312 and secure them by a hitch pin 344. FIGS. 57, 58 and 59 are perspective views of the leg element 350 in lowered, semi-raised and fully-raised positions respectively. Leg element 350 consists of outer sliding leg element 352 with lifting handle 354 and spring-loaded lift handle latch 356, inner leg element 358 having latch slots 360 mounted on base 362 having base apertures 364. Upper supporting horizontal leg latch bar 351 forms the upper end of a T-shaped spring loaded lever 355 which rotates about axis 353 to facilitate removal of the legs 350 from frame leg socket 368. As outer sliding leg element 352 is slid up the inner leg element 358, lift handle latch 356 slides out of the prior latch slot 360 and is then biased into the next higher latch slot 360 where it secures the leg element 352 until it is again moved upwardly. FIG. 60 is a detail perspective view of the frame leg socket 368 on arch 316. It has open front face 370 to receive the leg 350, so that bar latch 351 engages socket latch flanges 372 as shown in FIG. 61. The outer surface of sliding leg element 352 engages the tapered inner surface 374 of frame leg socket 368 so that arch bracket 368 and attached frame 310 is firmly supported on the sliding leg element 352. In FIG. 61 the sliding leg element 352 has been slid upwardly to the fully raised position on inner leg element 358. An eye bolt 366 can be bolted to the upper edge of inner leg element 358 with an attached ratchet strap 367 to secure the frame corners to a stake.

Figure 62A:
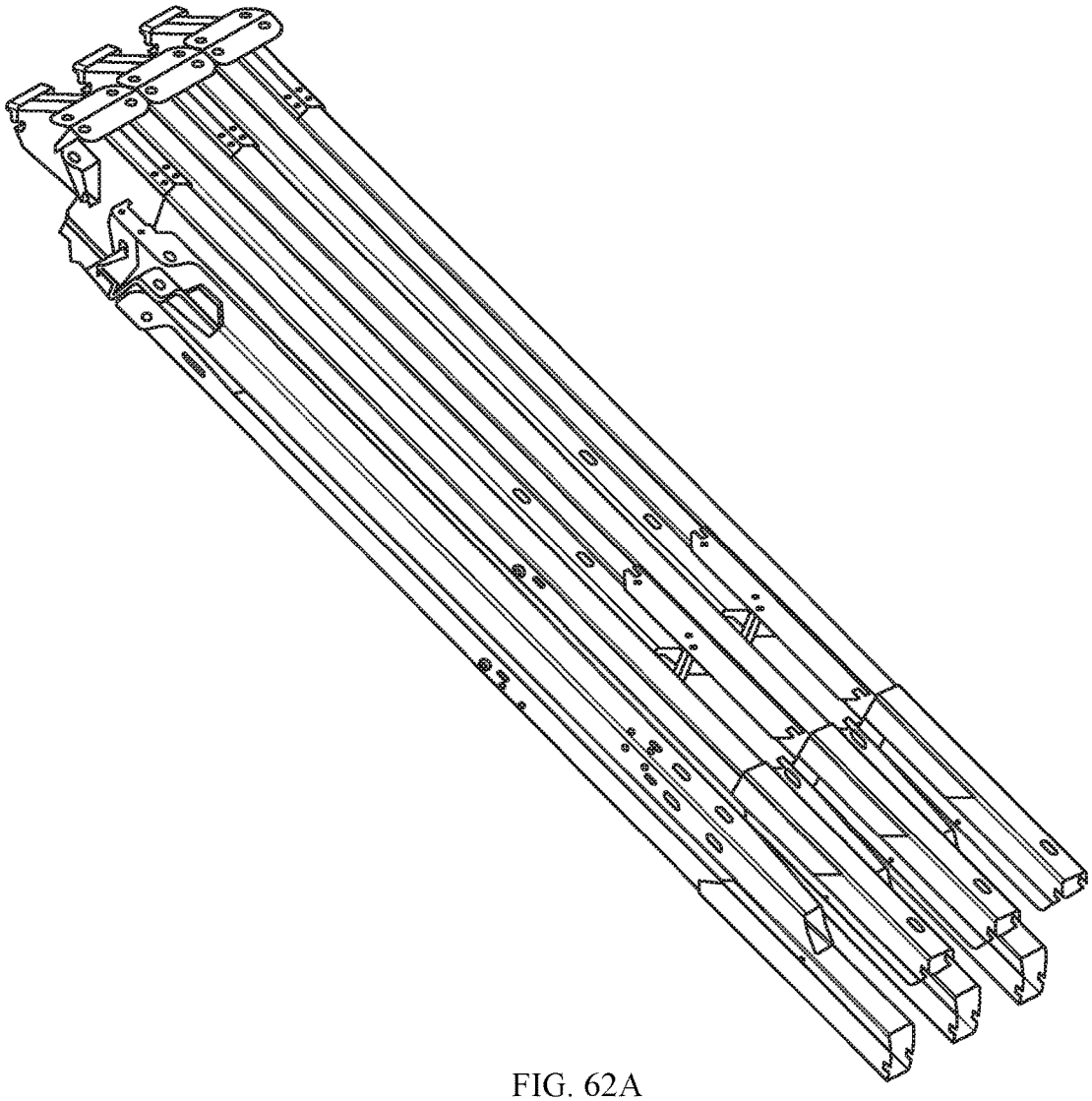
FIG. 62A-F is a series of schematic drawings illustrating the initial steps in the assembly process for the 2-module shelter.
Figure 62B:
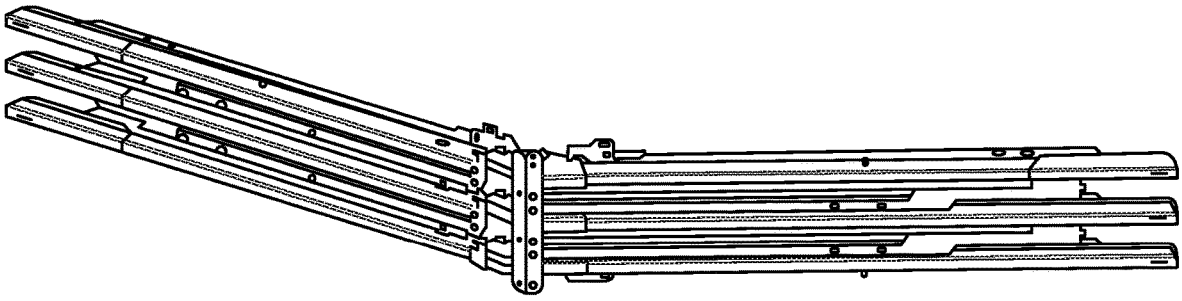
Figure 62C:
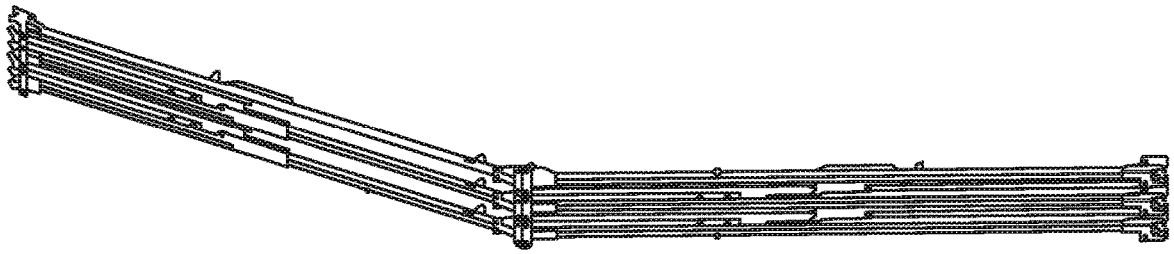
Figure 62D:
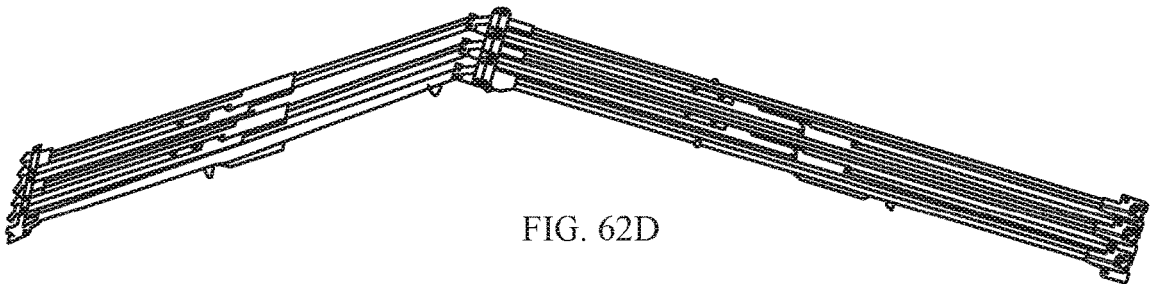
Figure 62E:
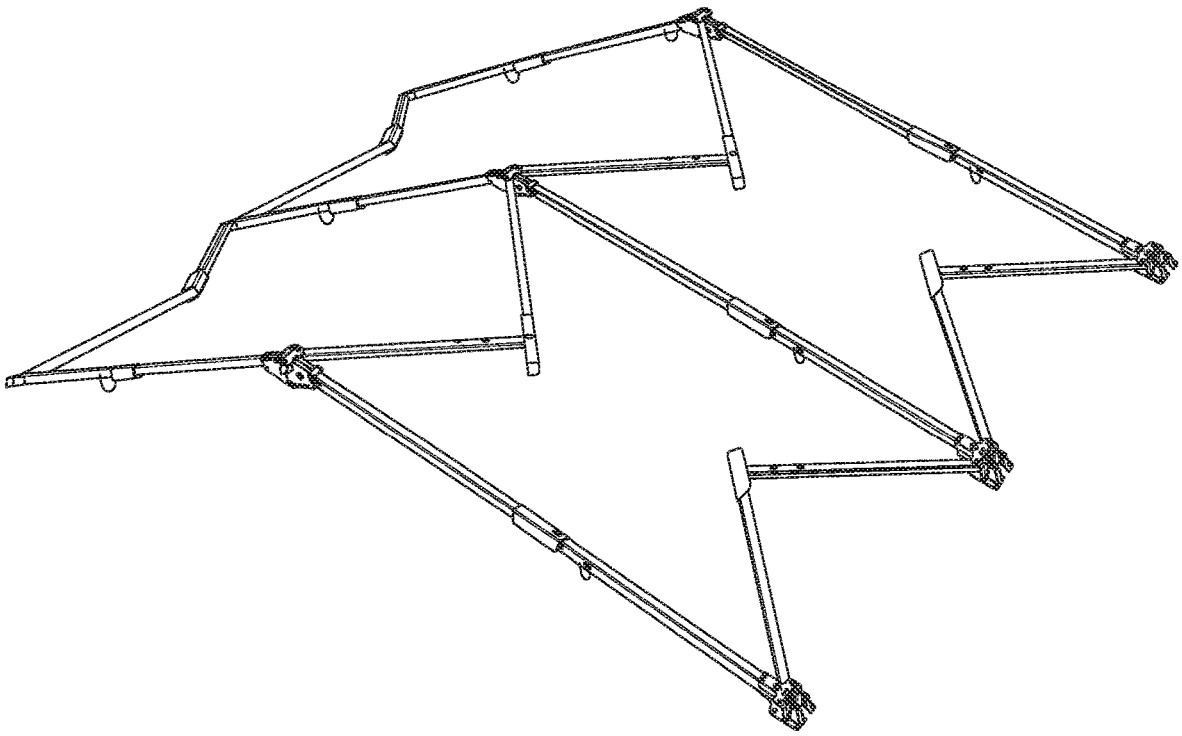
Figure 62F:
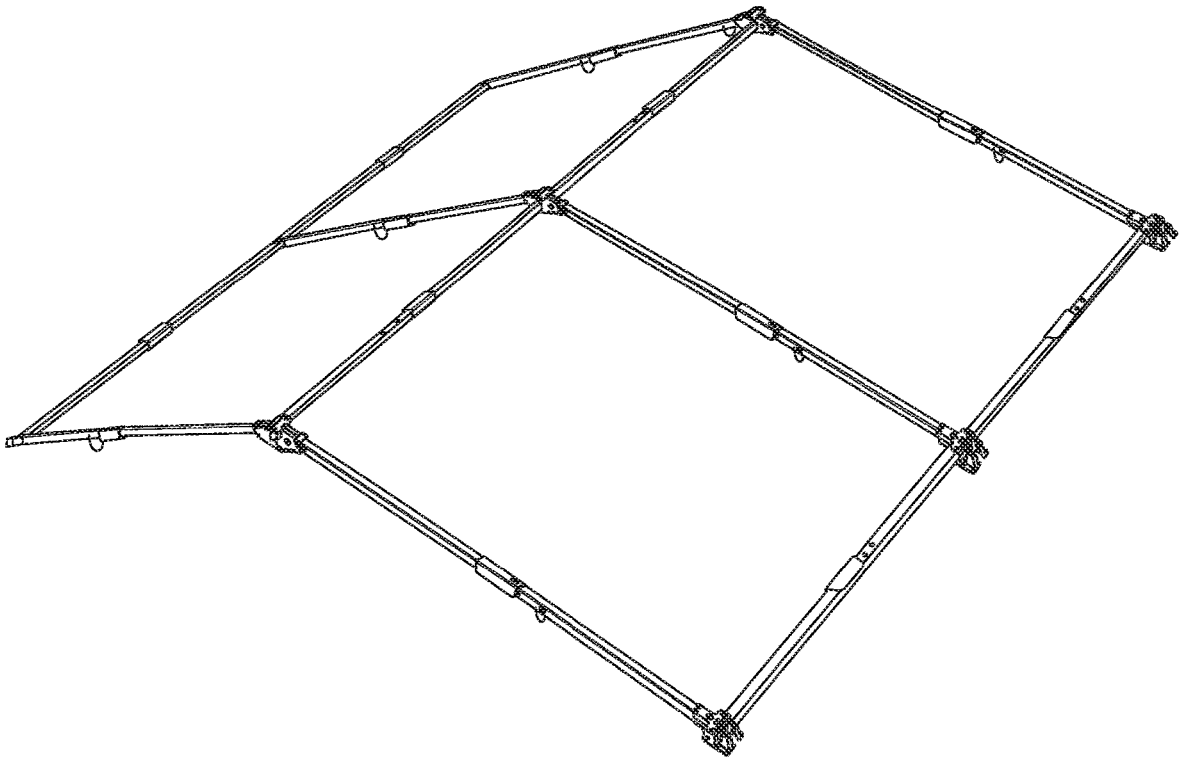

The following describes the assembly process for the 2-module shelter. The assembly process is essentially the same for all of the shelters, the difference being that the Vestibule, 4-Door Hub, and Vehicle Interface shelter use specific one-piece covers, and the 1-module, 2-module, and 4-module shelters use two endwall sections 332 and 0, 1 or 2 barrel sections 334. Initially the shelter fabric sections are laid out on the ground in their intended locations and joined by aligning the zipper starting points in the middle at the roof peak, and closing the zippers a short distance. The folded roof frame (FIG. 62A) is then deployed before proceeding with joining the remainder of the fabric. The frame is unfolded on the ground adjacent to one end of the laid-out shelter fabric to allow it to be expanded out over the fabric (FIG. 62B). With the frame lying on one side, the arches are unfolded at the roof peak hinges to their full length at the centre hinges so the arch hinges lock securely (FIG. 62C). The unfolded frame is stood on the eave beam ends as shown in FIG. 62D. The arches are pulled apart as in FIG. 62E, unfolding the beam sections so the beam hinges lock securely as shown in FIG. 62F. Arch cables are secured between the lower ends of the arches and roof fabric is partially secured to the roof beams by connecting cables from the tent roof to the ends of the respective arches by engaging cable hooks in slots on the underside of the arches where they join the eave beam 14 (not shown). The tent fabric is secured by roof attachment straps to roof beam D-rings (not shown).

Figure 8:
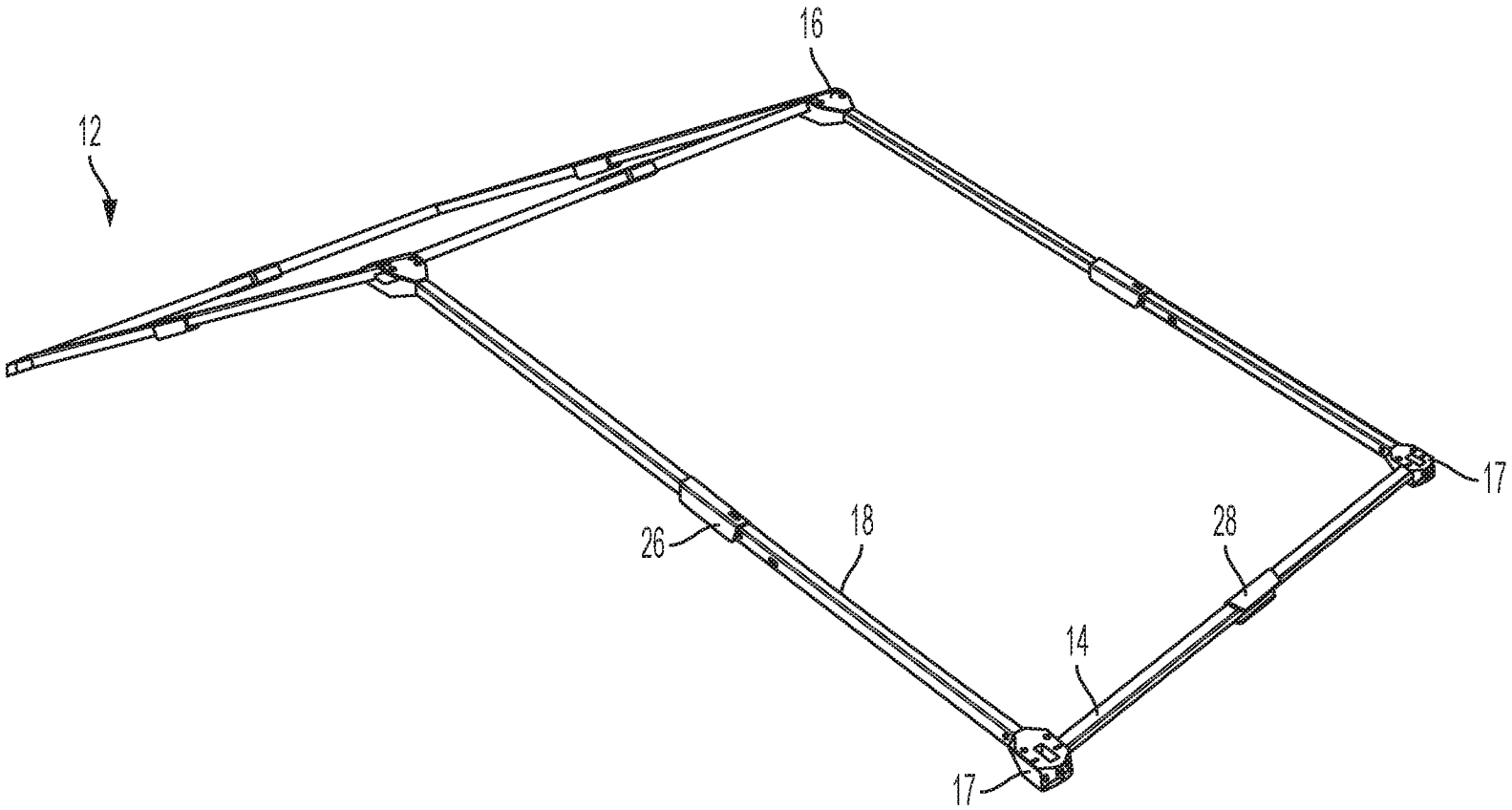
FIG. 8 is a perspective view of the upper folding assembly for the frame as shown in FIG. 2, standing upright completely unfolded.
Figure 63A:
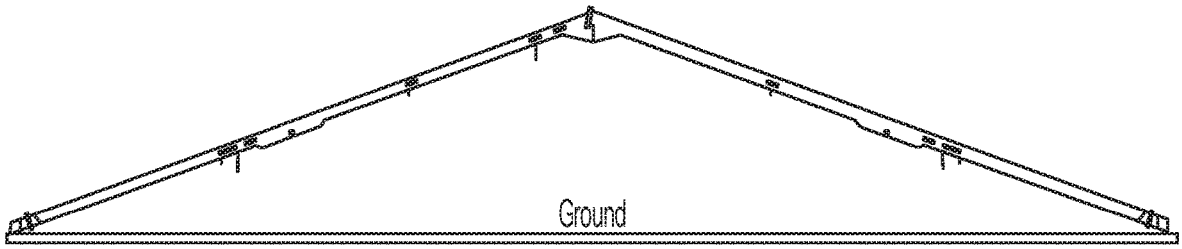
FIG. 63A-G is a series of schematic drawings illustrating the steps in raising of the tent frame for the 2-module shelter.
Figure 63B:
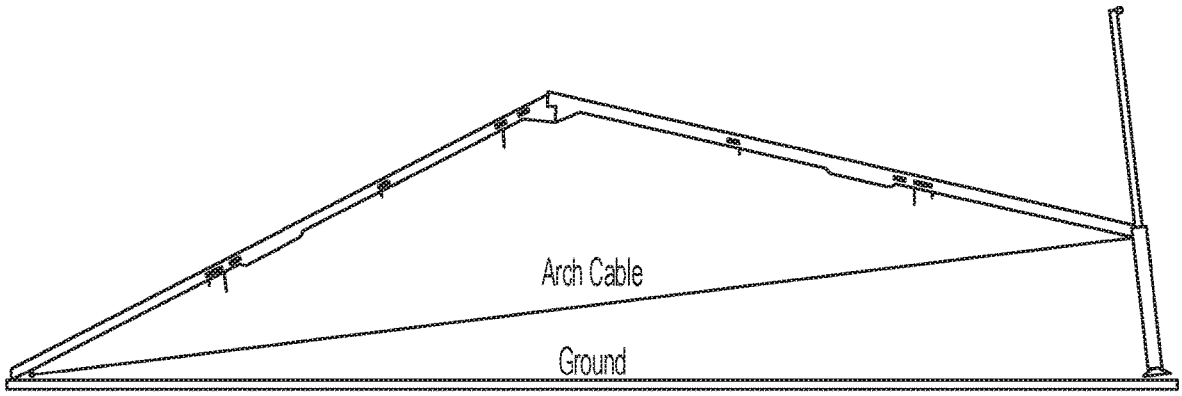
Figure 63C:
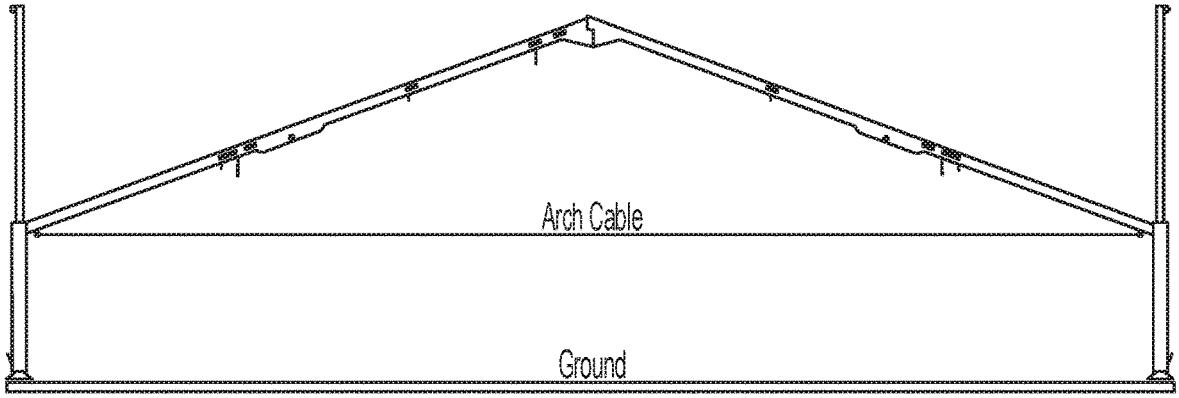
Figure 63D:
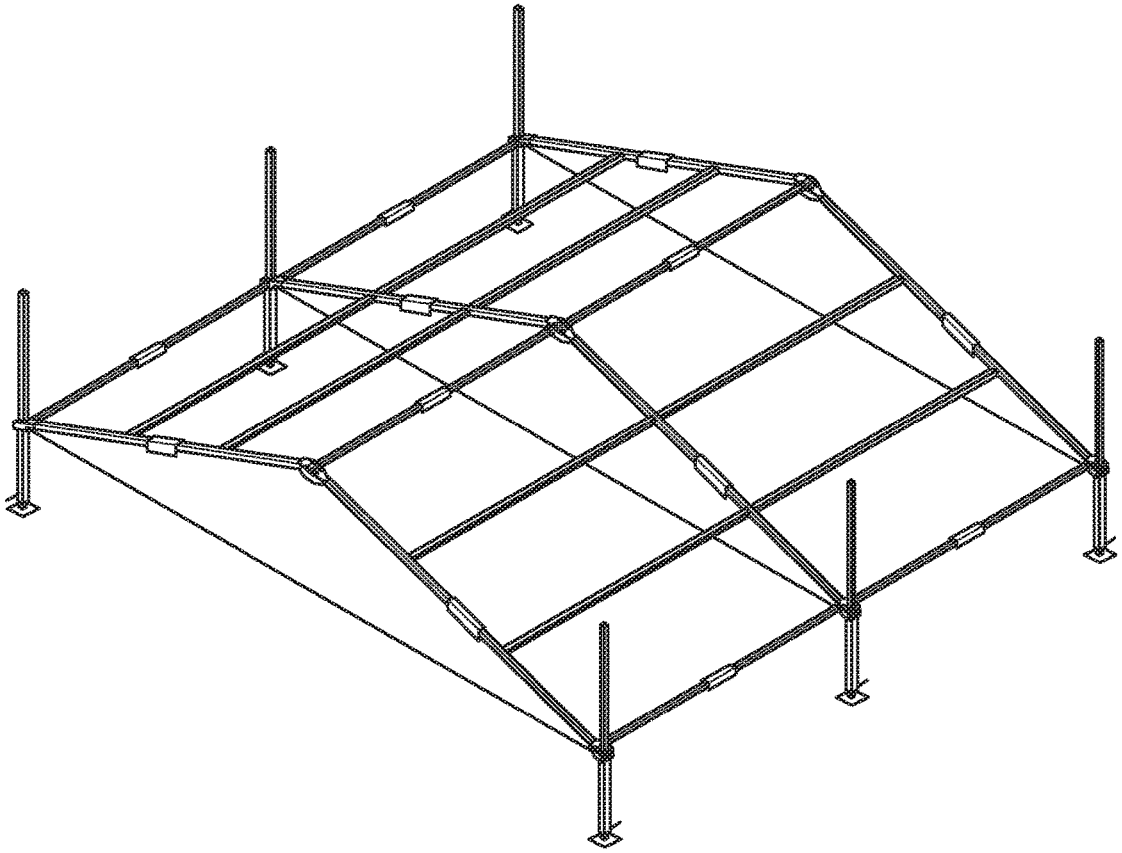
Figure 63E:
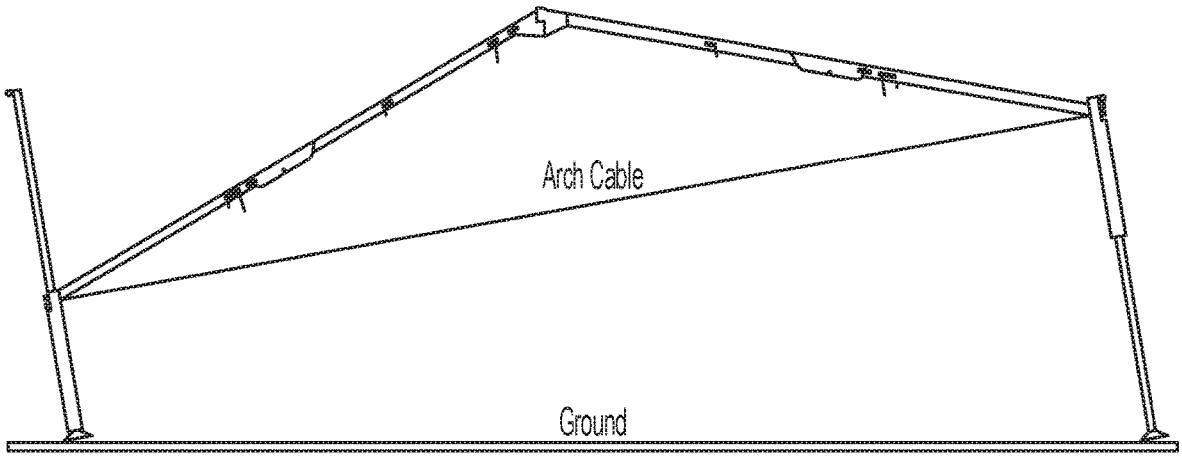
Figure 63F:
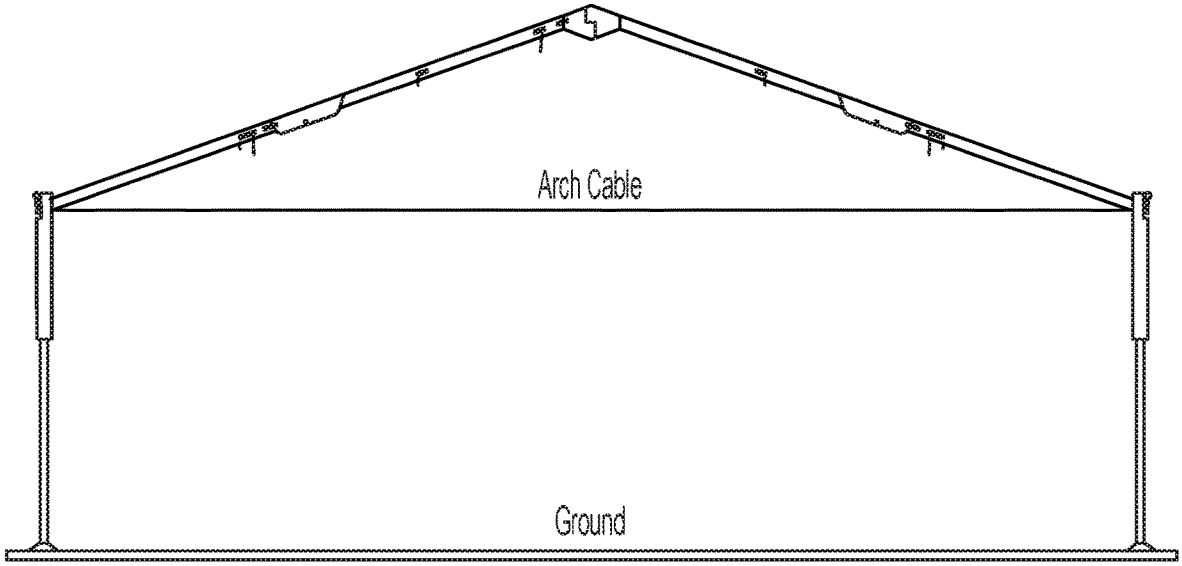
Figure 63G:
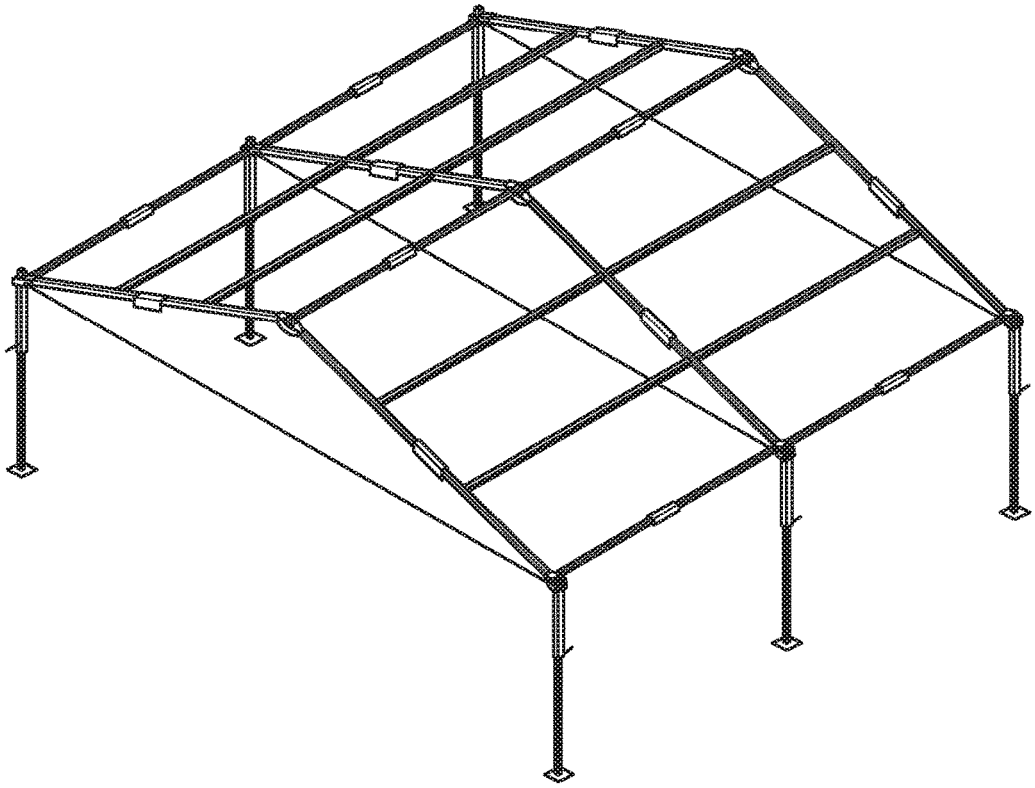

With reference to FIGS. 52 and 62F, 8 modular purlins 322 are then installed between arches 316. The ends of each purlin may have a T-shaped head to slide into securement slots in the sides of arches 316. The roof fabric is then further secured to the frame arches 316 and purlins 322, and fly 340 is centered over the frame 301. The raising of the frame 301 is illustrated in FIG. 63A-G. The frame with attached fabric is positioned on the ground as shown in FIG. 63A. The first side of the frame is lifted and the collapsed legs 350 inserted into the frame arch brackets 368 (FIG. 63B) so that upper latch 351 is positioned in socket latch flanges 372. The second side of the frame is lifted and the collapsed legs 350 similarly inserted into the frame arch brackets 368 on the second side of the frame (FIG. 63C). The frame 301 is now supported off the ground with the shelter fabric suspended below as shown in FIG. 63D. The bases 362 of the legs 350 can be secured to the ground at each stage of the setup as required using takes through apertures 364 of each base. Using the handles 354 on the legs 350 the frame is lifted further, ensuring the latches 356 fully engage the leg tube slots 360 (FIG. 63E). The shelter may be raised incrementally, one side at a time, or fully, both sides at once, depending on the number of personnel available to lift, to the position shown in FIGS. 63F and G. Insulation and sun shades may be installed as described in the previous embodiment.

While a number of exemplary aspects and embodiments have been discussed above, those of skill in the art will recognize certain modifications, permutations, additions and sub combinations thereof. It is therefore intended that the invention be interpreted to include all such modifications, permutations, additions and sub combinations as are within their true spirit and scope.

The invention claimed is:

1. A leg element for use in a folding tent frame system, said folding tent frame system having a roof frame comprising arch brackets configured to receive a plurality of said leg elements, each said leg element comprising:

a) a first inner leg element comprising a base and a rigid vertical element mounted on said base, said rigid vertical element having a plurality of vertically spaced latch-receiving slots; and b) a second outer sliding leg element slideably movable vertically on said first inner leg element, said second outer sliding leg element comprising a horizontally extending lifting bar secured thereto and a spring-biased latch element for securing said outer sliding leg element at selected vertical locations on said inner leg element, wherein said second outer sliding leg element further comprises adjacent the upper end thereof a spring-biased T-shaped lever rotatable about a central horizontal axis and forming a horizontal bar at the upper end thereof.

2. A folding tent frame comprising a folding roof frame, and a plurality of leg elements according to claim 1 engageable with said folding roof frame wherein said folding roof frame comprises a plurality of arch brackets located on the periphery thereof for releasably receiving and securing said plurality of leg elements.

3. The folding tent frame of claim 2 wherein each said arch bracket comprises a vertical passage open on the outer side thereof for receiving one of said outer sliding leg elements and opposed tapered interior surfaces for bearing against an outer surface of said outer sliding leg elements.

4. The folding tent frame of claim 2 wherein each said arch bracket comprises a flange for removably receiving said horizontal latch bar of said T-shaped lever.

5. The folding tent frame of claim 2 wherein said outer sliding leg elements comprise tapered outer surfaces configured to engage said tapered interior surfaces of said plurality of arch brackets.

6. A shelter system comprising a folding tent frame according to claim 2, and a flexible tent body removably suspended from said folding tent frame when said folding tent frame is in an unfolded and locked configuration.

7. A method of deploying a shelter wherein said shelter comprises a folding tent frame according to claim 2 and a flexible tent body, said method comprising the steps of:

a) unfolding said roof frame, reversibly locking said roof frame in an unfolded configuration and placing said unfolded roof frame on a generally horizontal surface such as the ground;

b) removably securing said flexible tent body to said unfolded roof frame at a plurality of points;

c) securing said plurality of leg elements to said arch brackets of said unfolded roof frame wherein said leg elements are in a first lowered configuration to thereby raise one or both sides of said unfolded roof frame above said surface;

d) raising said roof frame further above said surface by sliding each said outer sliding leg elements of said plurality of leg elements vertically on each said first inner leg element to thereby secure each said leg element in a further extended configuration;

e) repeating step d) until said unfolded roof frame has been raised to a selected extended height;

f) before or in the course of any one of steps c), d) or e) securing each base of said plurality of leg elements to said generally horizontal surface; and g) further securing said flexible tent body to said roof frame and extended leg elements and said generally horizontal surface.

8. The method of claim 7 wherein said bases of said leg elements comprise apertures and in step f) each base of said plurality of leg elements is secured to said surface using stakes extending through said apertures into said surface.

9. The method of claim 7 wherein in step d) said outer sliding leg elements are slid vertically on each said first inner leg element by lifting said horizontally extending lifting bars.

* * * * *